US011407242B2

(12) United States Patent
Mimoto et al.

(10) Patent No.: US 11,407,242 B2
(45) Date of Patent: Aug. 9, 2022

(54) IMAGE RECORDING APPARATUS

(71) Applicant: BROTHER KOGYO KABUSHIKI KAISHA, Nagoya (JP)

(72) Inventors: Masao Mimoto, Nagoya (JP); Kengo Noda, Inazawa (JP); Shohei Ichikawa, Kasugai (JP); Yoshimitsu Taniguchi, Tajimi (JP); Tsuyoshi Ito, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 45 days.

(21) Appl. No.: 17/128,300

(22) Filed: Dec. 21, 2020

(65) Prior Publication Data

US 2021/0107304 A1 Apr. 15, 2021

Related U.S. Application Data

(62) Division of application No. 16/292,948, filed on Mar. 5, 2019, now Pat. No. 10,870,293.

(30) Foreign Application Priority Data

Mar. 30, 2018 (JP) ..... JP2018-067692

(51) Int. Cl.
*B41J 13/00* (2006.01)
*B41J 29/393* (2006.01)

(52) U.S. Cl.
CPC ..... *B41J 13/0009* (2013.01); *B41J 29/393* (2013.01)

(58) Field of Classification Search
CPC .... B41J 13/0009; B41J 29/393; B41J 2/2132; B41J 2/2135; B41J 19/145; B41J 11/0005
See application file for complete search history.

(56) References Cited

U.S. PATENT DOCUMENTS

2003/0043219 A1 3/2003 Kojima
2009/0244138 A1* 10/2009 Konno ..... B41J 2/145 347/12

(Continued)

FOREIGN PATENT DOCUMENTS

JP 2003-62984 A 3/2003
JP 2004-58617 A 2/2004

(Continued)

OTHER PUBLICATIONS

IP.com search (Year: 2022).*
IP.com search (Year: 2020), as in parent application.

*Primary Examiner* — Lisa Solomon
(74) *Attorney, Agent, or Firm* — Merchant & Gould P.C.

(57) ABSTRACT

When an image recording apparatus records an specific image over a boundary between a first dot formation range where dots are to be formed in a preceding recording operation of two consecutive recording operations and a second dot formation range where dots are to be formed in a subsequent recording operation of the two consecutive recording operations, the apparatus sets, as a correction portion, an end portion in a scanning direction of a specific region including at least one of a first boundary region adjacent to the second dot formation range and a second boundary region adjacent to the first dot formation range in the specific image, and forms the dot placed at the correction portion by discharging liquid of a discharge amount smaller than the discharge amount set for a dot element corresponding to the dot from nozzles.

7 Claims, 27 Drawing Sheets

(56) References Cited

U.S. PATENT DOCUMENTS

| | | | |
|---|---|---|---|
| 2009/0251499 | A1 | 10/2009 | Santo et al. |
| 2015/0254538 | A1 | 9/2015 | Fukazawa et al. |

FOREIGN PATENT DOCUMENTS

| | | | |
|---|---|---|---|
| JP | 2010-194737 | A | 9/2010 |
| JP | 2015-168086 | A | 9/2015 |

* cited by examiner

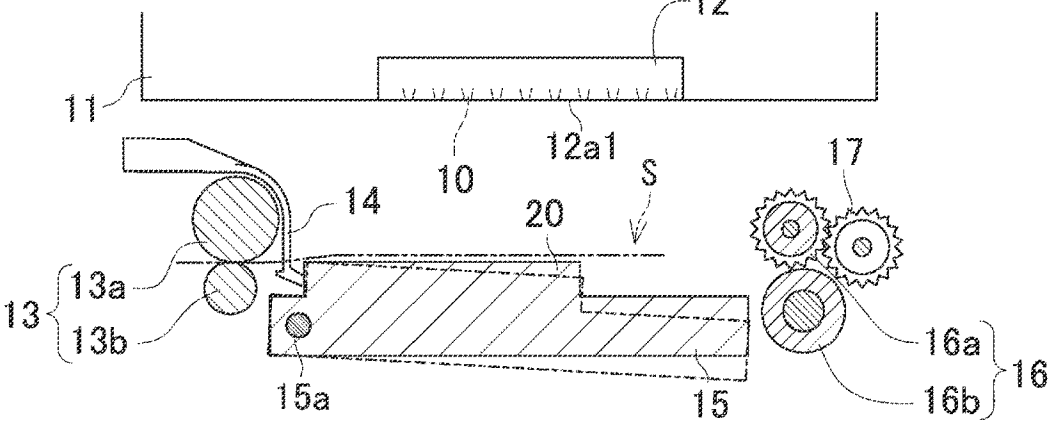
FIG. 5A
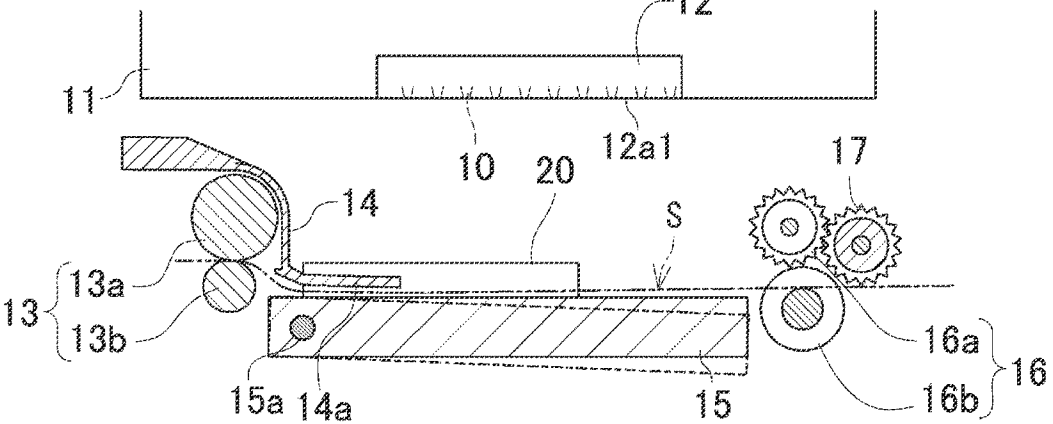
FIG. 5B
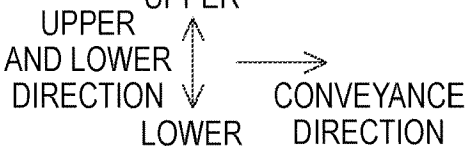

FIG. 8A BIDIRECTIONAL RECORDING MODE IN THE CASE WHERE THE GAP IS UNIFORM

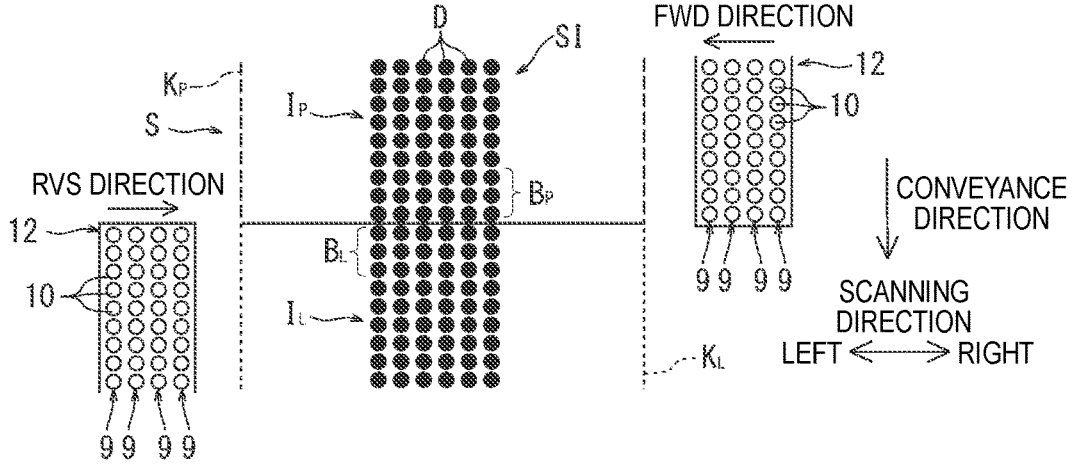

FIG. 8B BIDIRECTIONAL RECORDING MODE IN THE CASE WHERE THE GAP INCREASES TOWARD THE DOWNSTREAM SIDE WITH RESPECT TO THE CONVEYANCE DIRECTION (NO CORRECTION OF IMAGE DATA)

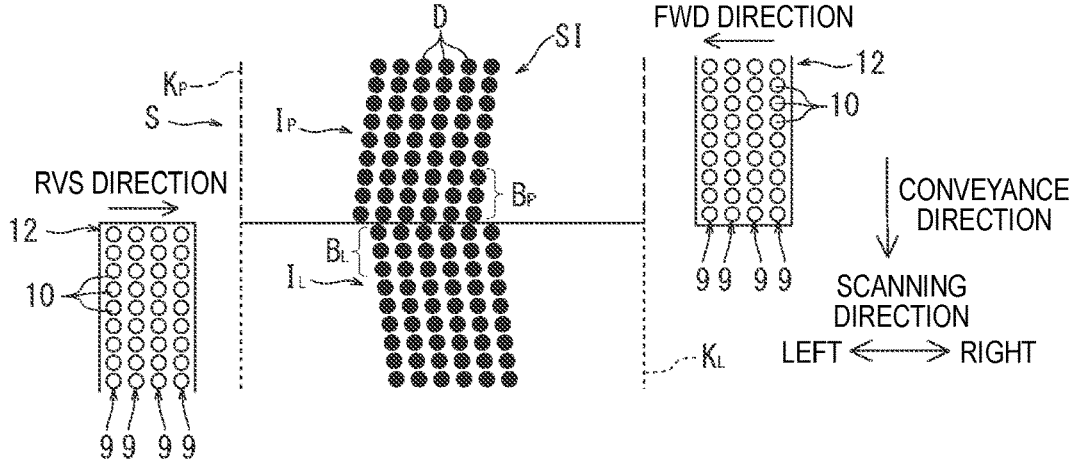

FIG. 8C BIDIRECTIONAL RECORDING MODE IN THE CASE WHERE THE GAP INCREASES TOWARD THE DOWNSTREAM SIDE WITH RESPECT TO THE CONVEYANCE DIRECTION (IMAGE DATA IS CORRECTED)

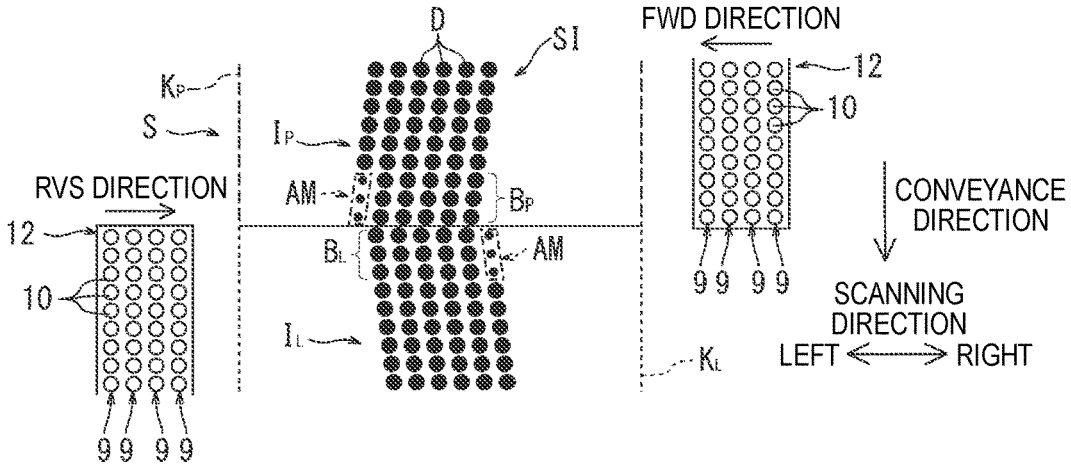

FIG. 9A SPECIFIC IMAGE DATA (BEFORE CORRECTION)
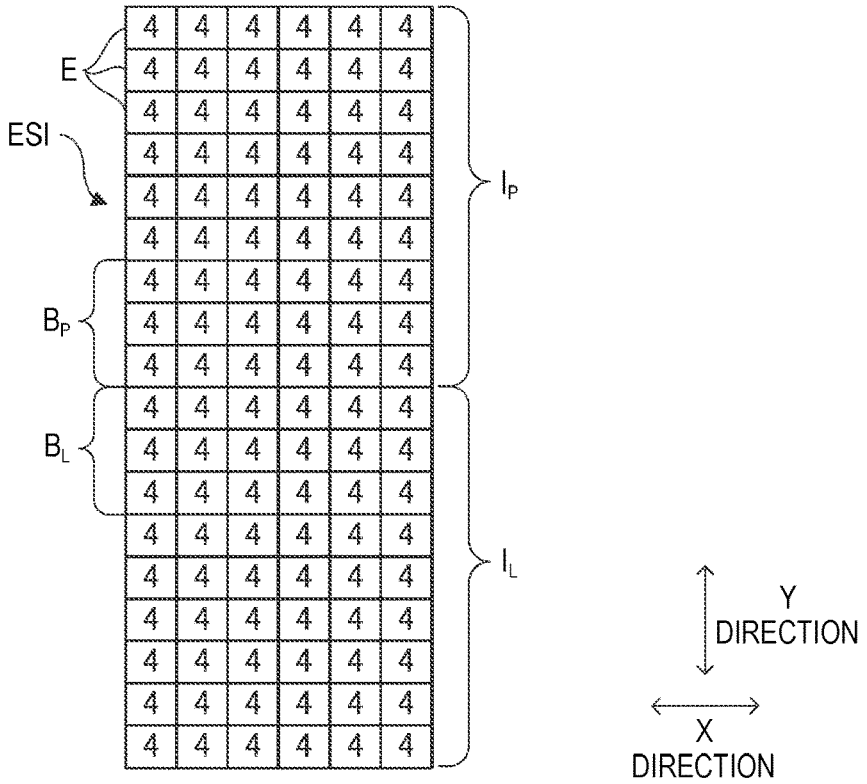
FIG. 9B SPECIFIC IMAGE DATA (AFTER CORRECTION)
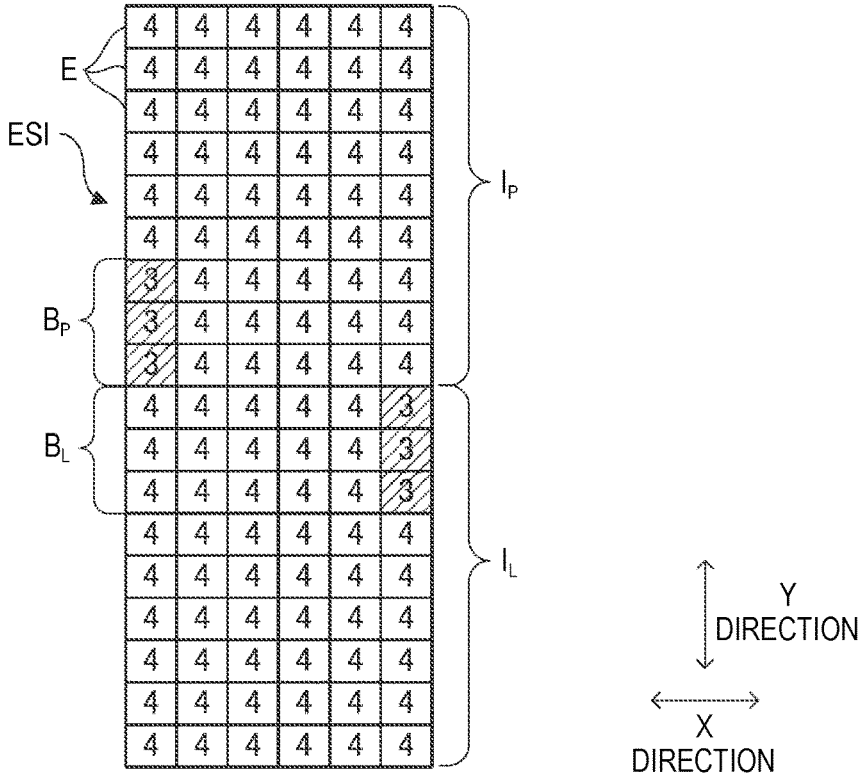

FIG. 10A UNIDIRECTIONAL RECORDING MODE IN THE CASE WHERE THE GAP INCREASES TOWARD THE DOWNSTREAM SIDE WITH RESPECT TO THE CONVEYANCE DIRECTION (IMAGE DATA IS CORRECTED)
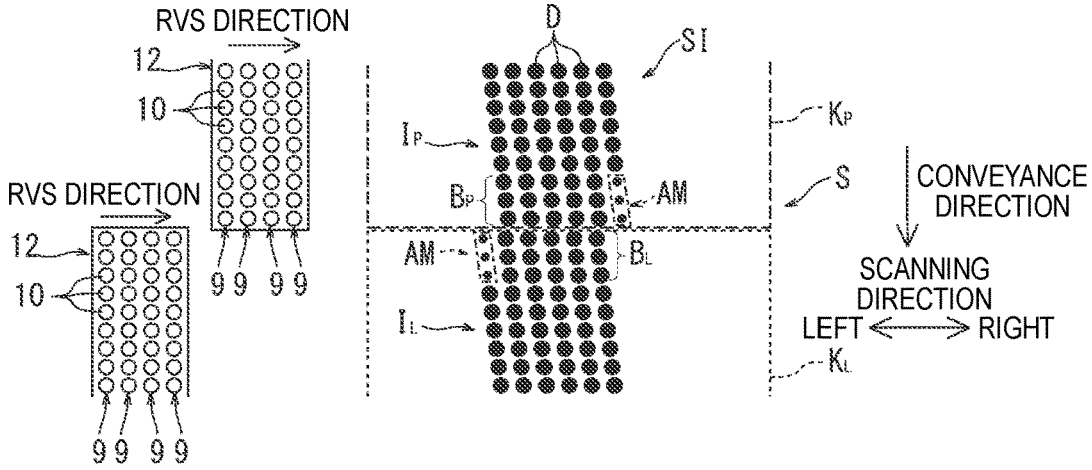
FIG. 10B
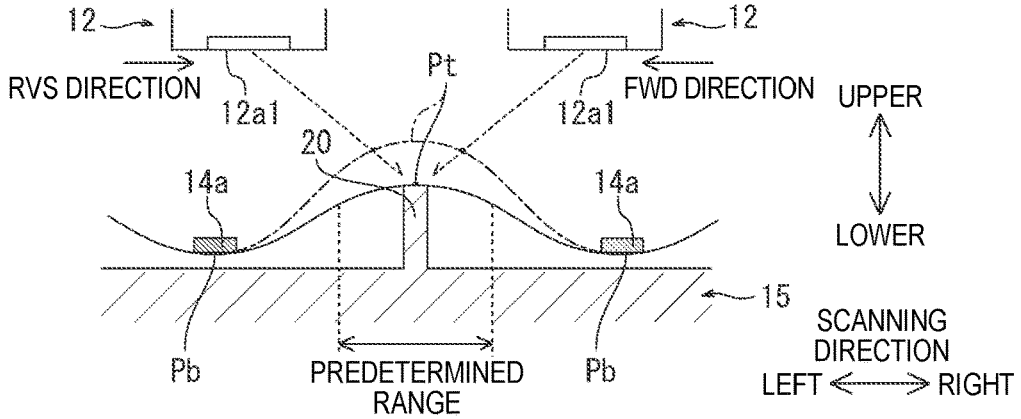
FIG. 10C IN THE CASE WHERE THE RECORDING POSITION IS WITHIN THE PREDETERMINED RANGE (IMAGE DATA IS CORRECTED)
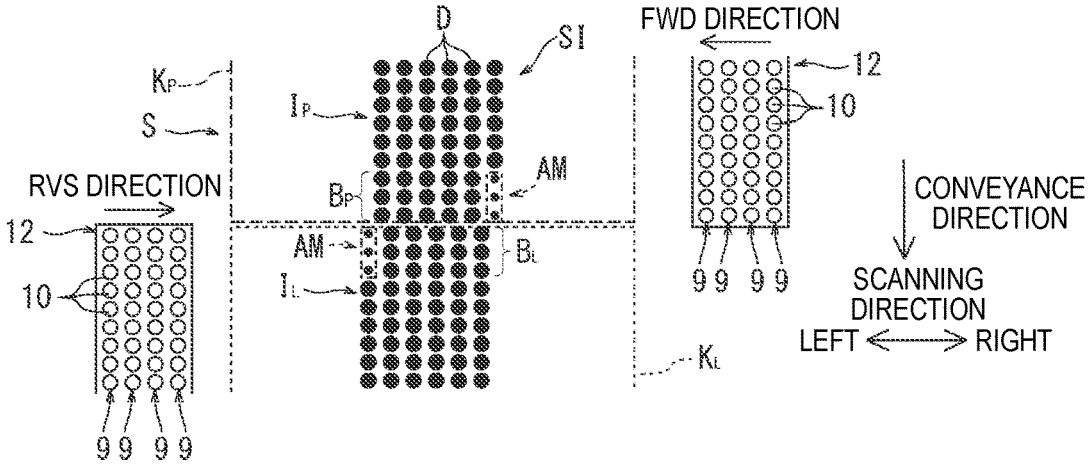

FIG. 11A
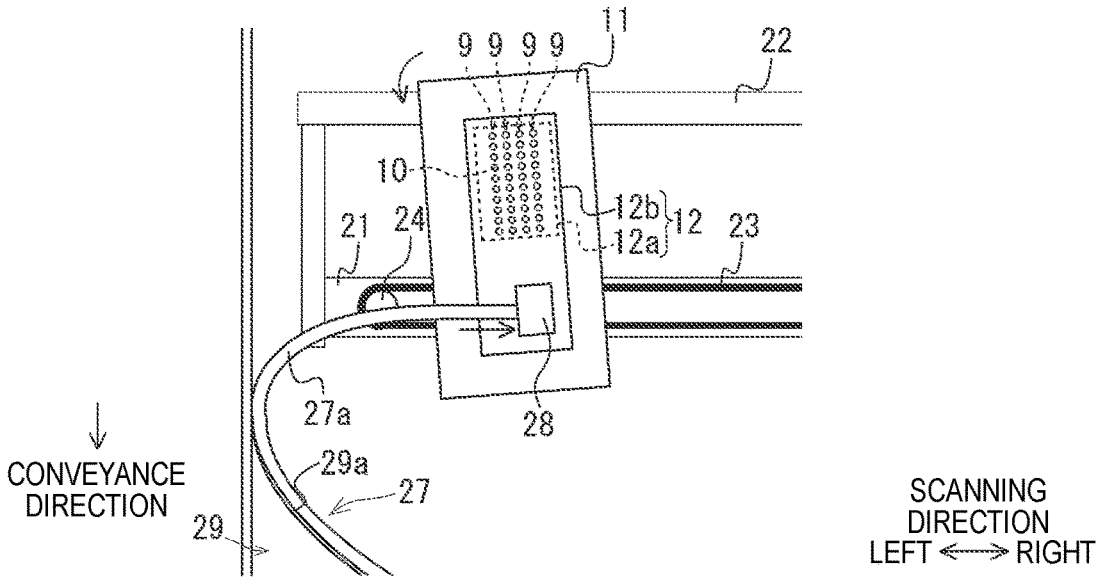
FIG. 11B IN THE CASE WHERE THE POSITION OF THE CARRIAGE IS WITHIN THE LEFT END PORTION RANGE (IMAGE DATA IS CORRECTED)
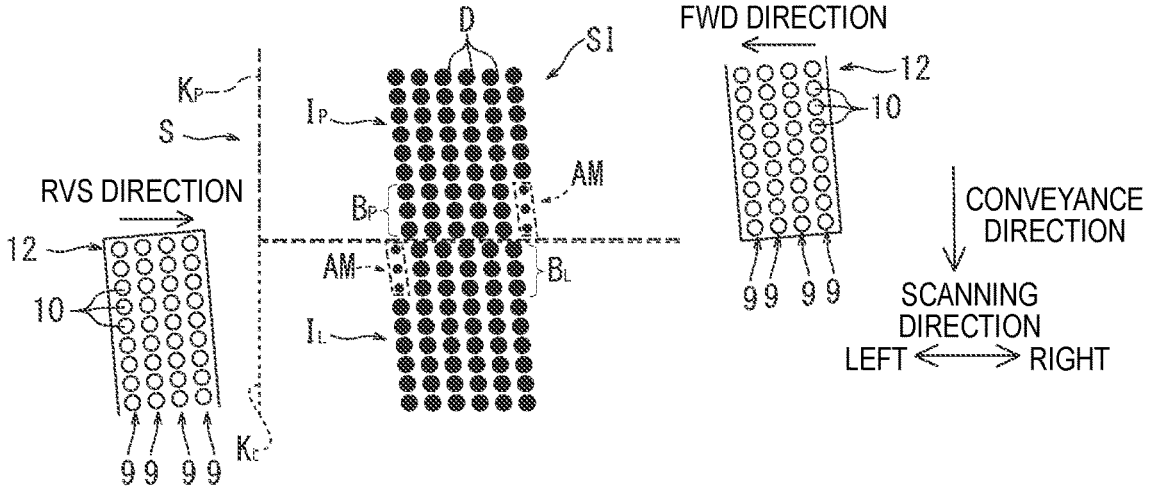

FIG. 13A
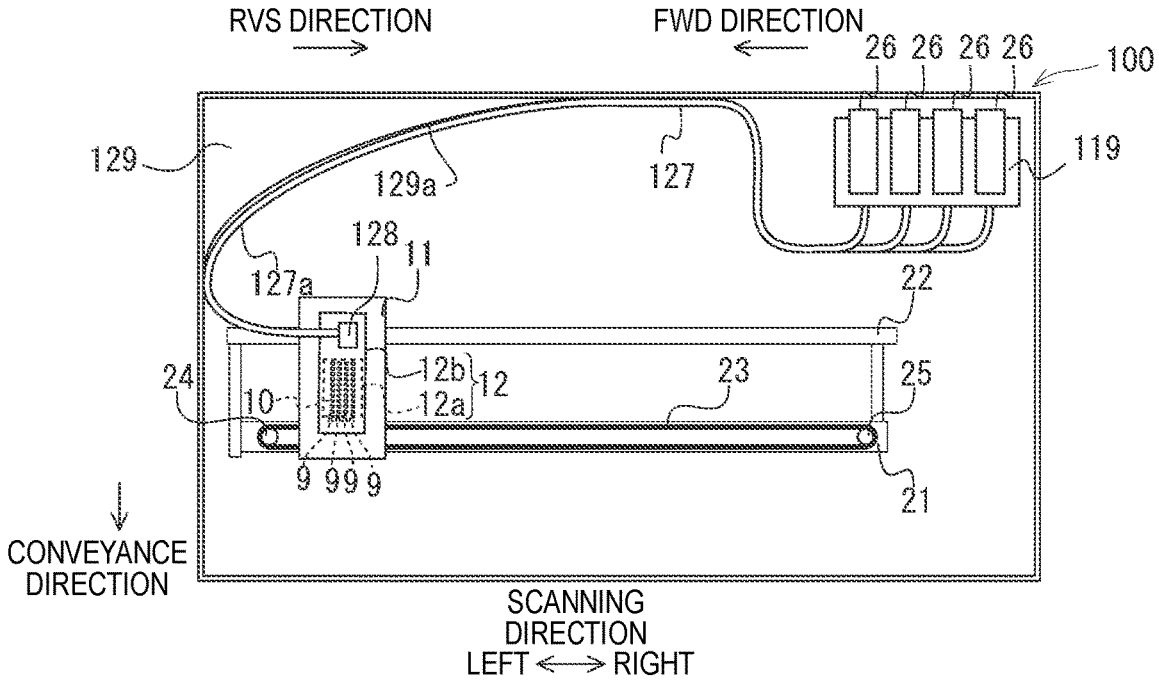
FIG. 13B IN THE CASE WHERE THE POSITION OF THE CARRIAGE IS WITHIN THE LEFT END PORTION RANGE (IMAGE DATA IS CORRECTED)
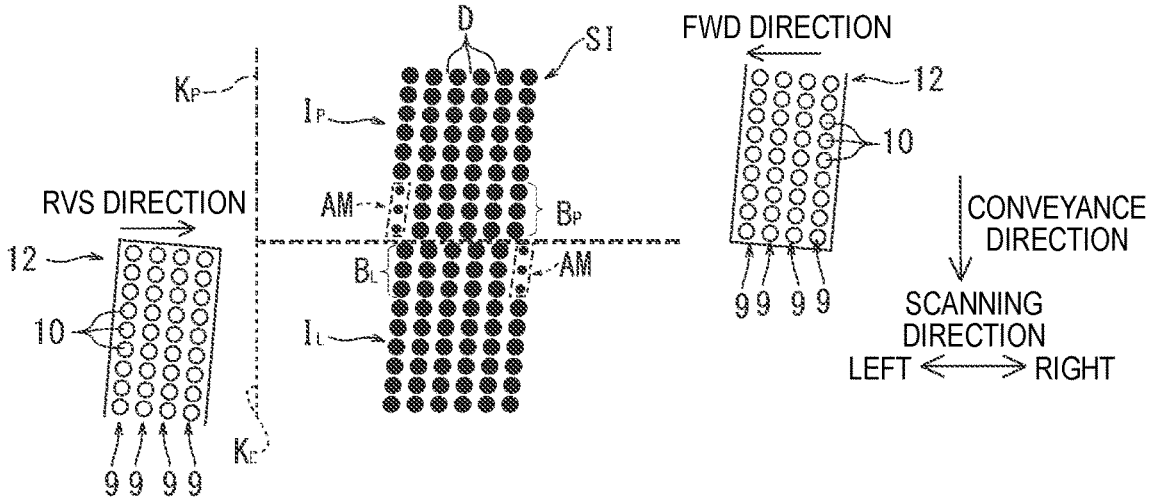

FIG. 14A
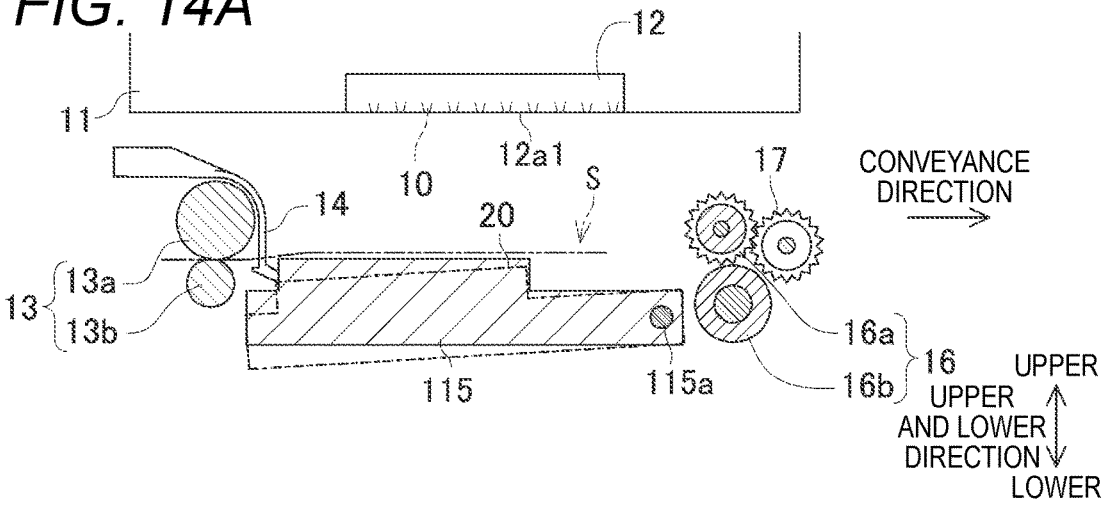
FIG. 14B BIDIRECTIONAL RECORDING MODE IN THE CASE WHERE THE GAP INCREASES TOWARD THE UPSTREAM SIDE WITH RESPECT TO THE CONVEYANCE DIRECTION (IMAGE DATA IS CORRECTED)
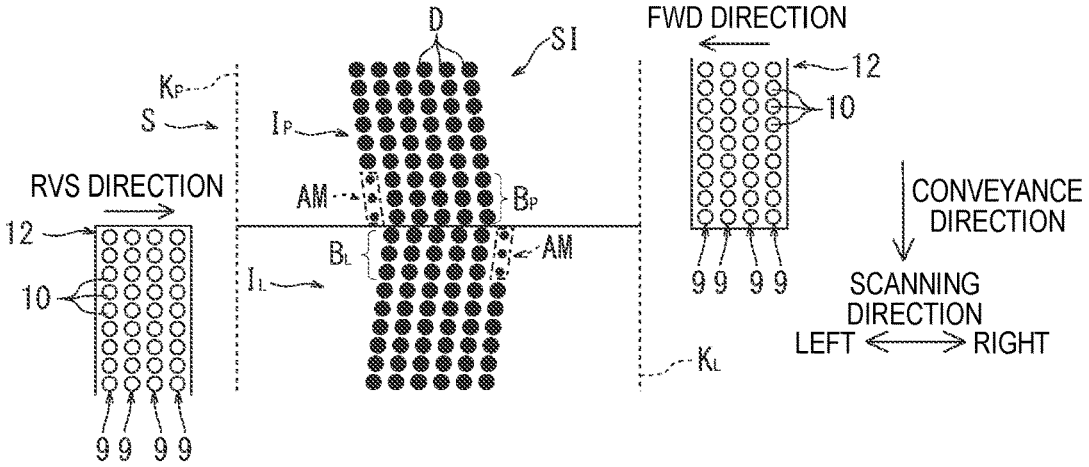
FIG. 14C UNIDIRECTIONAL RECORDING MODE IN THE CASE WHERE THE GAP INCREASES TOWARD THE UPSTREAM SIDE WITH RESPECT TO THE CONVEYANCE DIRECTION (IMAGE DATA IS CORRECTED)
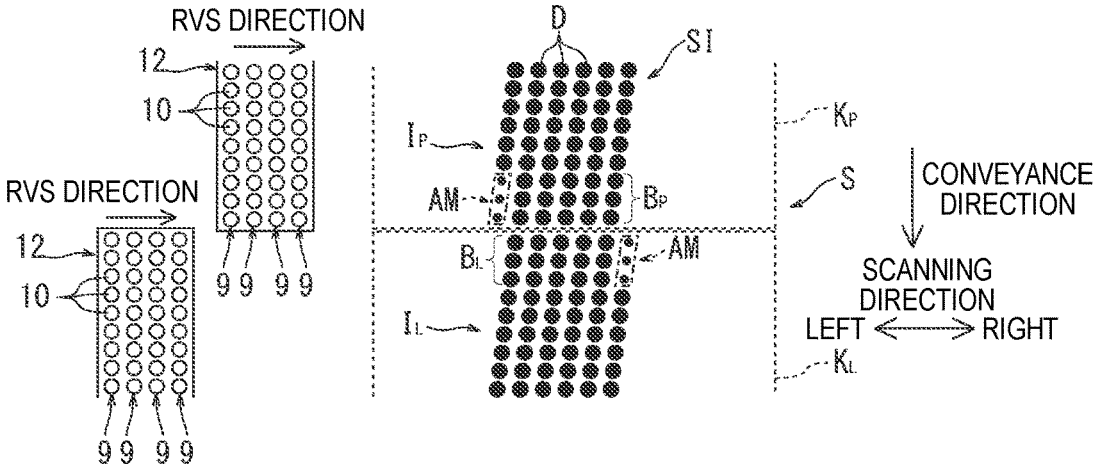

FIG. 19A IN THE CASE WHERE THERE IS NO STEP IN IMAGE
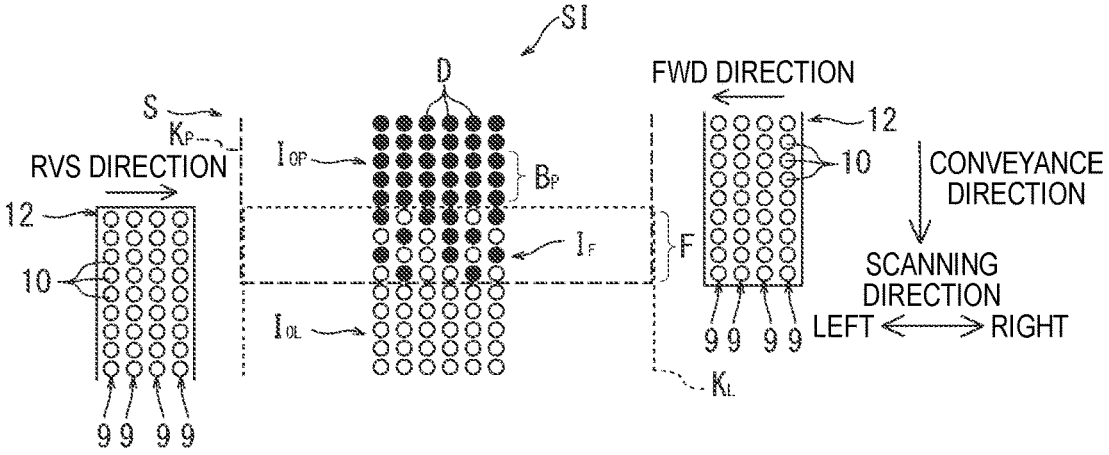
FIG. 19B IN THE CASE WHERE THERE IS STEP IN IMAGE (NO CORRECTION OF IMAGE DATA)
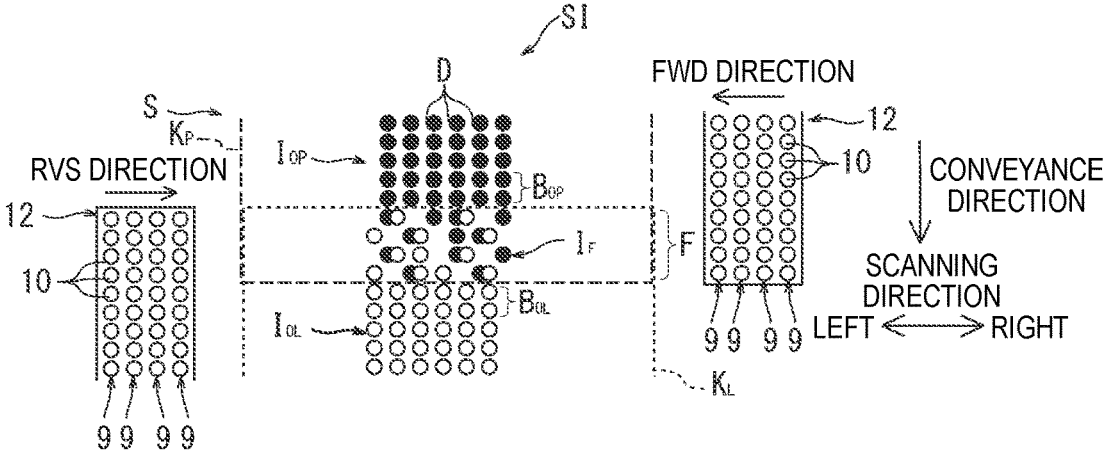
FIG. 19C IN THE CASE WHERE THERE IS STEP IN IMAGE (IMAGE DATA IS CORRECTED)
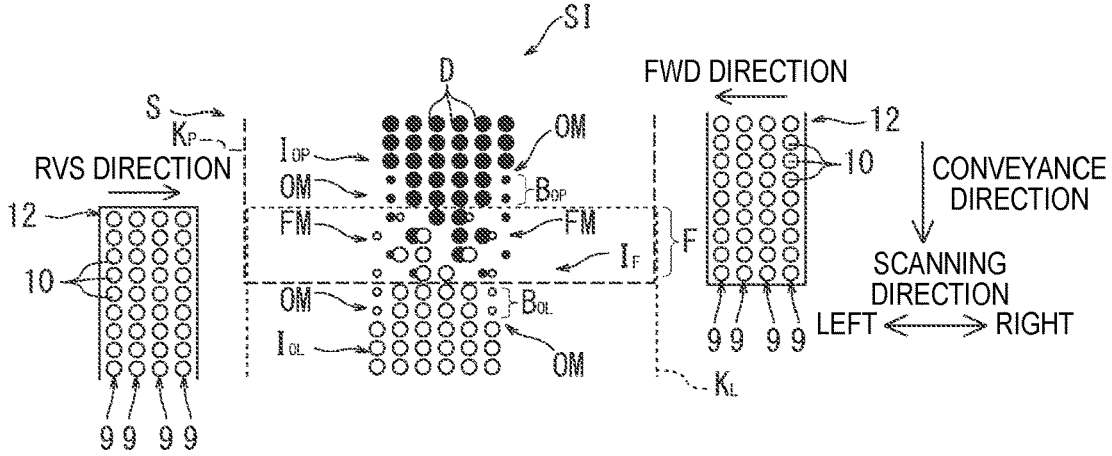

FIG. 21A
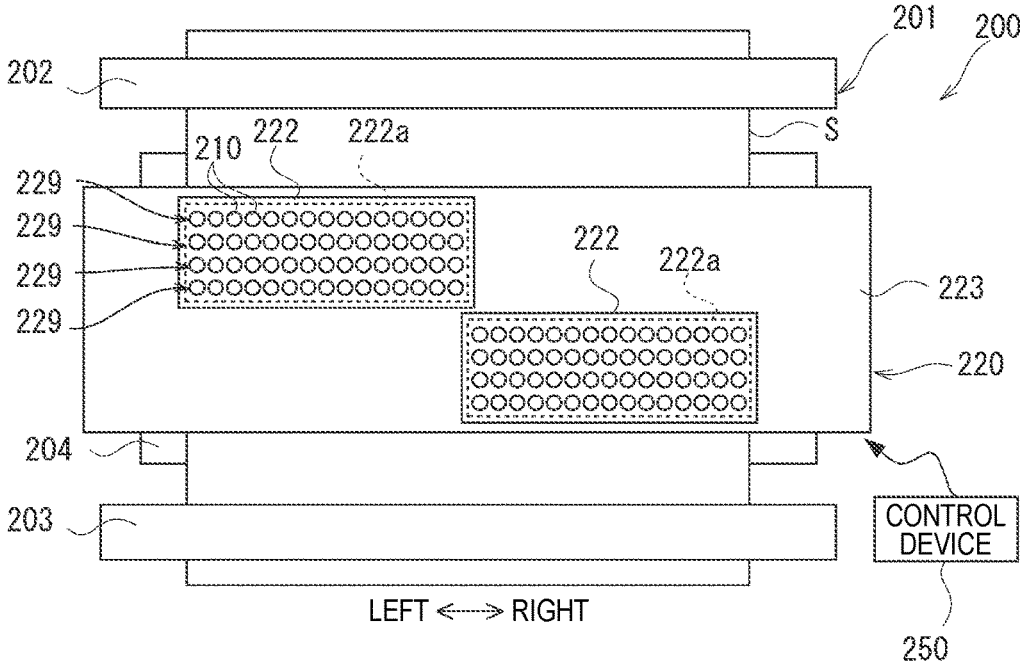
FIG. 21B IN THE CASE WHERE IMAGE DATA IS NOT CORRECTED
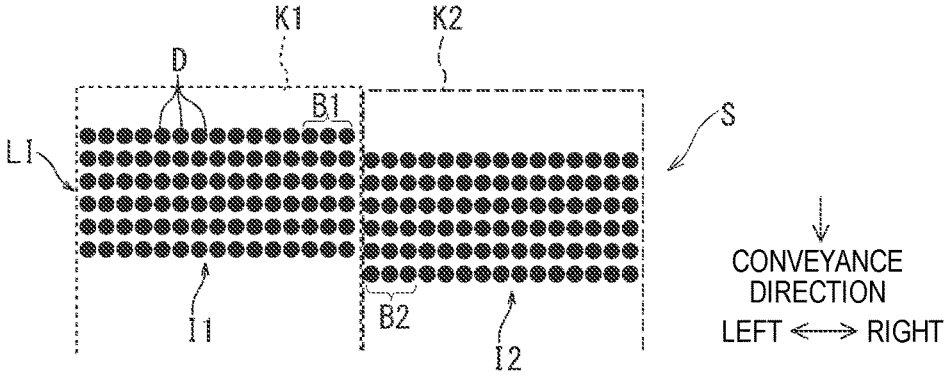
FIG. 21C IN THE CASE WHERE IMAGE DATA IS CORRECTED
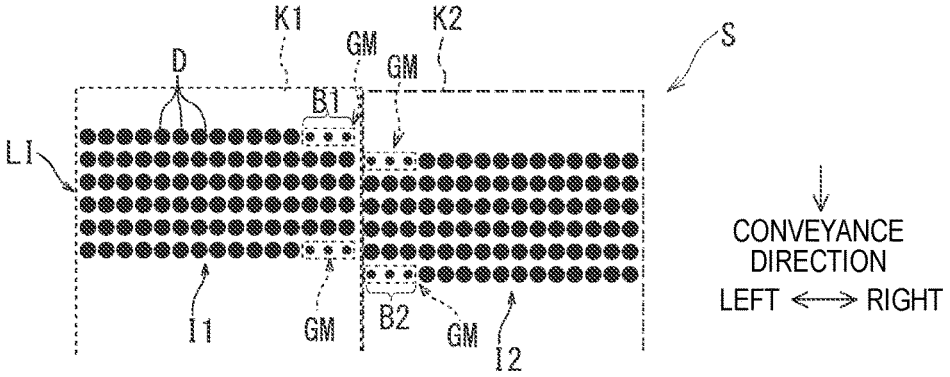

FIG. 22A
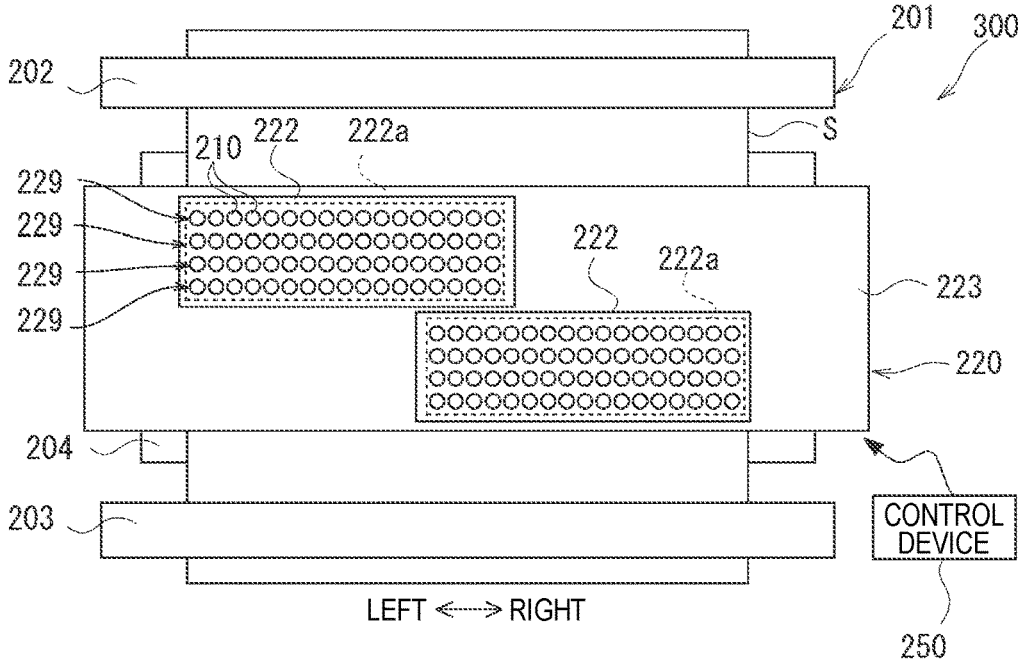
FIG. 22B IN THE CASE WHERE IMAGE DATA IS NOT CORRECTED
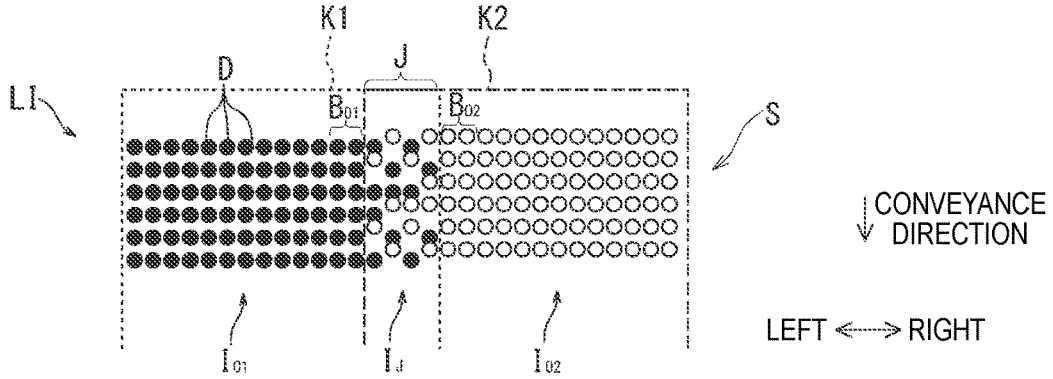
FIG. 22C IN THE CASE WHERE IMAGE DATA IS CORRECTED
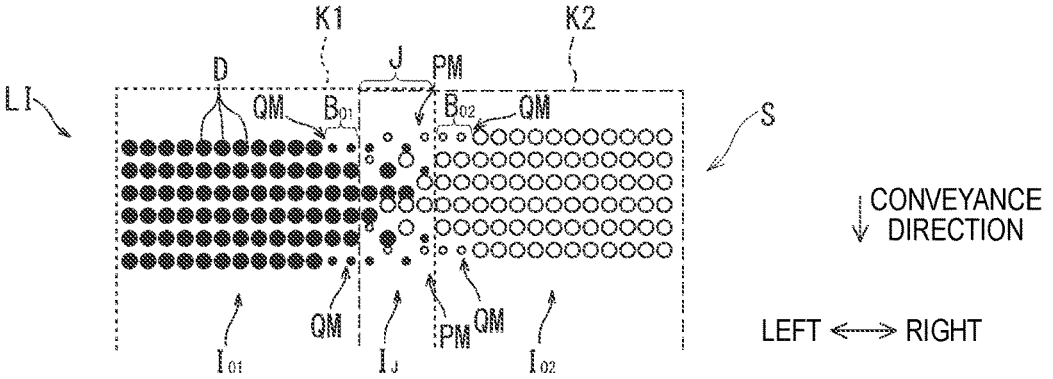

FIG. 23A UNIDIRECTIONAL RECORDING MODE (IMAGE DATA IS CORRECTED)
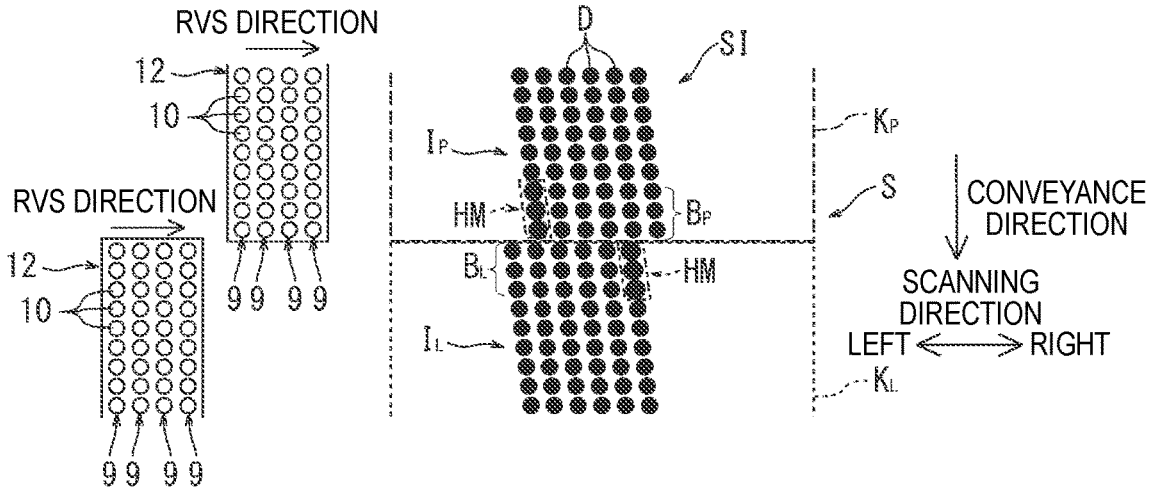
FIG. 23B IMAGE DATA IS CORRECTED
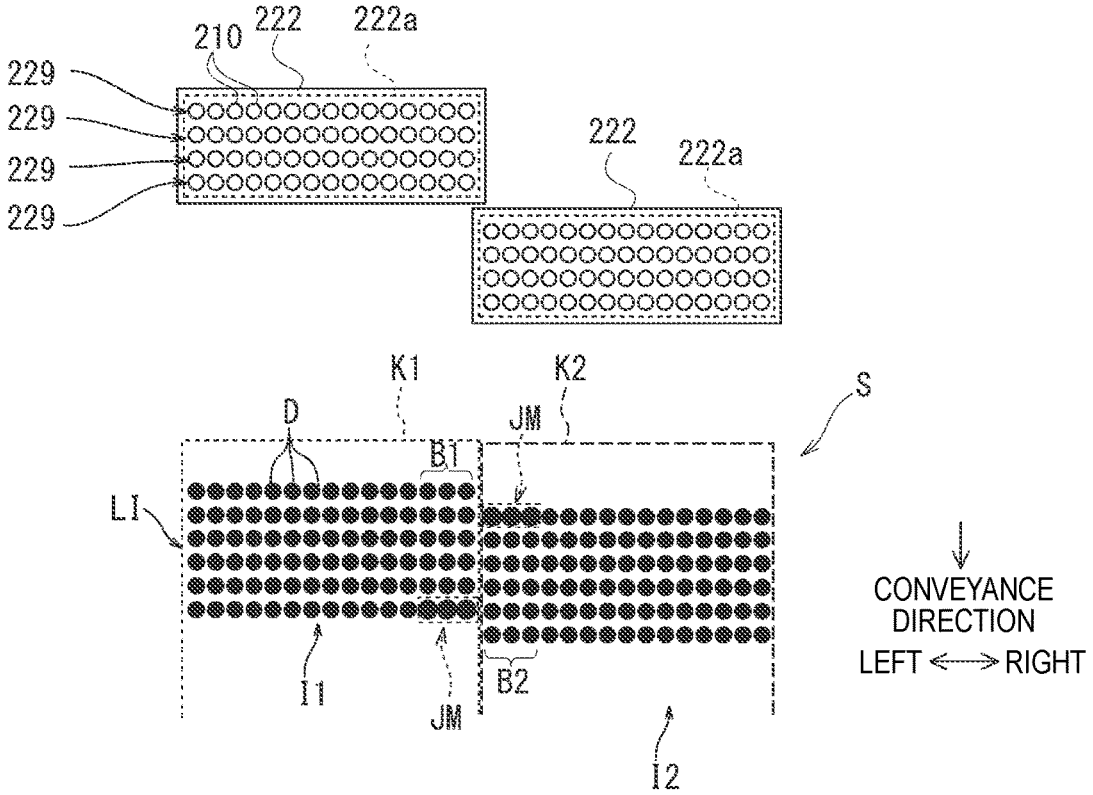

FIG. 24A UNIDIRECTIONAL RECORDING MODE (IMAGE DATA IS CORRECTED)
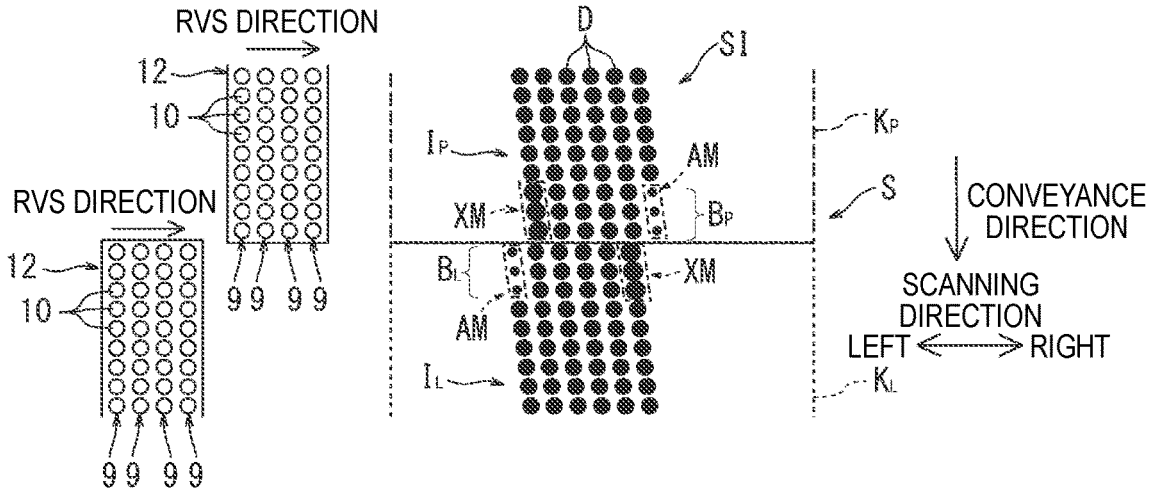
FIG. 24B IMAGE DATA IS CORRECTED
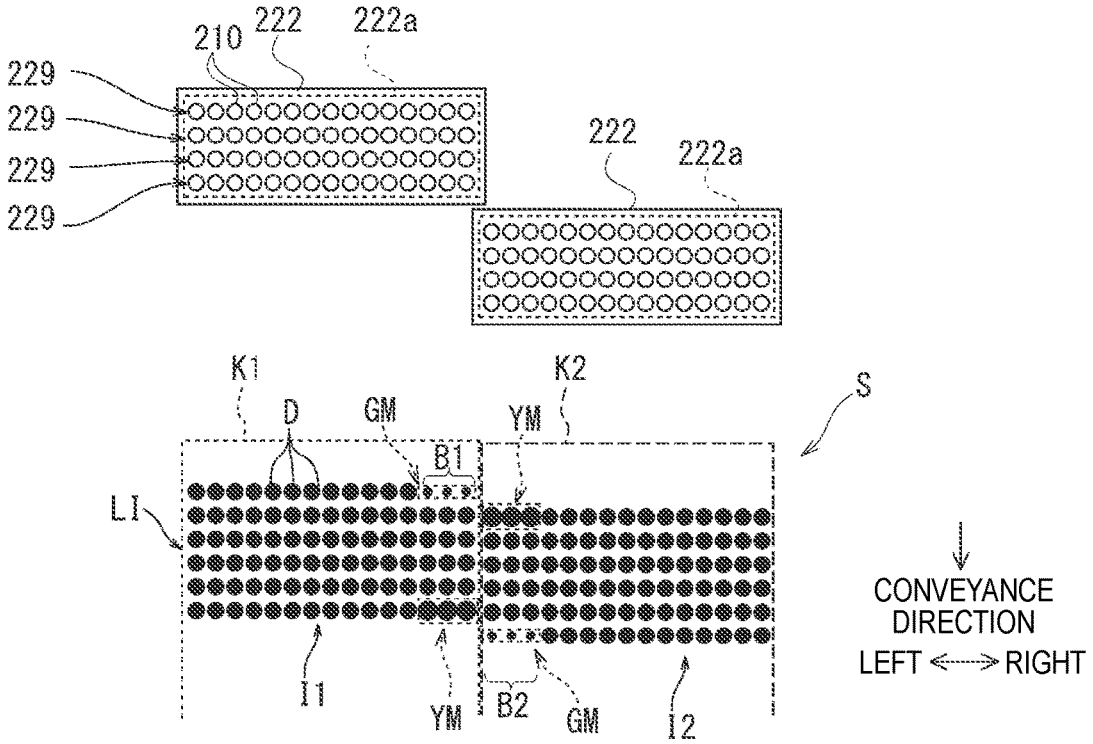

IMAGE RECORDING APPARATUS

CROSS-REFERENCE TO RELATED APPLICATION

This application is a divisional of U.S. patent application Ser. No. 16/292,948, filed Mar. 5, 2019, which claims priority from Japanese Patent Application No. 2018-067692 filed on Mar. 30, 2018. The entire subject matter of these applications are incorporated herein by reference.

TECHNICAL FIELD

The present disclosure relates to an image recording apparatus.

BACKGROUND

As an example of an image recording apparatus configured to record an image, JP-A-2004-58617 discloses an inkjet printer configured to discharge ink from a head, thereby recording an image. The inkjet printer of JP-A-2004-58617 is configured to alternately repeat a conveyance operation of moving a sheet (an example of a medium) in a conveyance direction and a printing operation of discharging ink to form dot rows while moving nozzles in a scanning direction, thereby printing an image on the sheet.

In the inkjet printer, when any image is printed by the two consecutive printing operations, diverse image quality degradations may be generated. JP-A-2004-58617 discloses a technology of suppressing banding, which is a kind of the image quality degradation. Specifically, when the adjacent dot rows are formed by the different printing operations, a mixed degree of the inks between the dot rows is different from a case where the adjacent dot rows are formed by the same printing operation, so that the banding may be generated. In JP-A-2004-58617, in order to suppress the banding, when forming the adjacent dot rows by the different printing operations, an amount of the ink to be discharged is regulated on the basis of information about a color of the image upon formation of at least one dot row.

As one kind of the image quality degradation, a step in an image has been known which is generated at a connecting region of images of the two consecutive printing operations. The step in the image is generated when a formation position of a dot row to be formed by one printing operation entirely deviates in the scanning direction elative to a formation position of a dot row to be formed by the other printing operation, at a connecting region of images of the two consecutive printing operations. For example, the deviation of the formation position of the dot row may be caused when a spaced distance between the head and the sheet is different at upstream and downstream sides with respect to the conveyance direction upon the printing operation.

As the image recording apparatus, a line-type image recording apparatus including a plurality of recording heads arranged in a direction intersecting with a conveyance direction of a medium has been also known (refer to FIG. 21A). In the line-type image recording apparatus, a step in an image may be generated when a formation position of a dot row to be formed by one recording head entirely deviates in the conveyance direction relative to a formation position of a dot row to be formed by the other recording head, in a connecting region of images of the two adjacent recording heads. However, JP-A-2004-58617 does not disclosure countermeasures against the step in the image.

SUMMARY

An object of the present disclosure is to provide an image recording apparatus enables to record an image where a step in the image is inconspicuous.

One illustrative aspect provides an image recording apparatus having:

a conveyer configured to convey a medium in a conveyance direction;

a carriage configured to reciprocally move in a scanning direction intersecting with the conveyance direction;

a recording head mounted to the carriage and including a discharge surface in which a plurality of nozzles are aligned in the conveyance direction;

a memory configured to store image data including a plurality of dot elements corresponding to a plurality of dots to be formed on a medium, a discharge amount of liquid discharged for forming a corresponding dot is set for each of the plurality of dot elements in the image data; and a controller configured to alternately execute a recording operation in which while moving the carriage in the scanning direction, the recording head discharges liquid of the discharge amount set for the dot elements of the image data from the plurality of nozzles to form dots on the medium, and a conveyance operation in which the conveyer conveys the medium in the conveyance direction, to record an image on the medium, in which in a case of recording the image, the controller causes the conveyer, in the conveyance operation, to convey a medium in the conveyance direction such that a first dot formation range where dots are to be formed in a preceding recording operation of two consecutive recording operations and a second dot formation range where dots are to be formed in a subsequent recording operation of the two consecutive recording operations do not overlap each other, and in which in a case of recording a specific image over a boundary between the first dot formation range and the second dot formation range, the specific image consisting of a plurality of discharged dots corresponding to dot elements having the set discharge amounts greater than zero among the plurality of dot elements of the image data, and having widths for a plurality of dots in the conveyance direction and in the scanning direction, the controller:

sets, as a correction portion, an end portion in the scanning direction of a specific region including at least one of a first boundary region and a second boundary region in the specific image, the first boundary region being located in a first image region recorded within the first dot formation range, the first boundary region being adjacent to the second dot formation range and having a length shorter than a length of the first dot formation range in the conveyance direction, and the second boundary region being located in a second image region recorded within the second dot formation range, the second boundary region being adjacent to the first dot formation range and having a length shorter than a length of the second dot formation range in the conveyance direction; and forms the dot placed at the correction portion by discharging liquid of a discharge amount smaller than the discharge amount set for the dot element corresponding to the dot from at least one of the plurality of nozzles.

According to the above configuration, the size of the dot placed at the end portion in the scanning direction of at least one of the first boundary region and the second boundary region becomes smaller than the size of the dot formed in the discharge amount set for the dot element corresponding to the dot. Thereby, even when the formation position of the dot formed by the preceding recording operation and the formation position of the dot formed by the subsequent recording operation entirely deviate in the scanning direction and a step is thus generated in the image, it is possible to reduce the size of the dot formed at a corner portion of the step. As a result, it is possible to record an image where a step in the image is inconspicuous.

Another illustrative aspect provides an image recording apparatus having:

a conveyer configured to convey a medium in a conveyance direction;

a recording head unit including a plurality of recording heads each of which includes a nozzle row having a plurality of nozzles aligned in an intersection direction intersecting with the conveyance direction, the plurality of recording heads being aligned in the intersection direction such that arrangement regions having the nozzles arranged in two recording heads being adjacent to each other in the intersection direction among the plurality of recording heads, do not overlap each other in the conveyance direction;

a memory configured to store image data including a plurality of dot elements corresponding to a plurality of dots formed on a medium, a discharge amount of liquid discharged for forming a corresponding dot is set for each of the plurality of dot elements in the image data; and a controller configured to cause the conveyer to convey a medium in the conveyance direction and cause the recording head unit to discharge liquid of the discharge amount set for the dot elements of the image data from the plurality of nozzles to form dots on the medium, to record an image on the medium, and in which in a case of recording a specific image over a boundary between a first dot formation range where dots are formed by one of the two adjacent recording heads and a second dot formation range where dots are formed by the other of the two adjacent recording heads, the specific image consisting of a plurality of discharged dots corresponding to dot elements having the set discharge amounts greater than zero among the plurality of dot elements of the image data, and the specific image having widths for a plurality of dots in the conveyance direction and in the scanning direction, the controller:

sets, as a correction portion, an end portion in the conveyance direction of a specific region including at least one of a first boundary region and a second boundary region in the specific image, the first boundary region being located in a first image region recorded within the first dot formation range, the first boundary region being adjacent to the second dot formation range and having a length shorter than a length of the first dot formation range in the intersection direction, and the second boundary region being located in a second image region recorded within the second dot formation range, the second boundary region being adjacent to the first dot formation range and having a length shorter than a length of the second dot formation range in the intersection direction; and forms the dot placed at the correction portion by discharging liquid of a discharge amount different from the discharge amount set for the dot element corresponding to the dot from at least one of the plurality of nozzles.

According to the above configuration, the size of the dot placed at the end portion in the conveyance direction of at least one of the first boundary region and the second boundary region is different from the size of the dot formed in the discharge amount set for the dot element corresponding to the dot. Thereby, even when the formation position of the dot formed by one of the two recording heads adjacent to each other and the formation position of the dot formed by the other entirely deviate in the conveyance direction and a step is thus generated in the image, it is possible to reduce the size of the dot formed at a corner portion of the step. As a result, it is possible to record an image where a step in the image is inconspicuous.

According to the present disclosure, is possible to record an image where a step in the image is inconspicuous.

BRIEF DESCRIPTION OF DRAWINGS

FIG. 5A is a sectional view taken along a line IVA-IVA of FIG. 3, and FIG. 5B is a sectional view taken along a line IVB-IVB of FIG. 3.

FIG. 8A depicts a specific image when no gap difference is generated at upstream and downstream sides in a conveyance direction, FIG. 8B depicts a specific image when a gap difference is generated at the upstream and downstream sides in the conveyance direction and image data is not corrected in a bidirectional recording mode, and FIG. 8C depicts a specific image when a gap difference is generated at the upstream and downstream sides in the conveyance direction and the image data is corrected in the bidirectional recording mode.

FIG. 9A depicts specific image data before correction, and FIG. 9B depicts specific image data after correction.

FIG. 10A depicts a specific image when a gap difference is generated at the upstream and downstream sides in the conveyance direction and the image data is corrected in a unidirectional recording mode, FIG. 10B illustrates variation in gap at a convex part, and FIG. 10C depicts a specific image when a recording position is within a predetermined range and the image data is corrected in the bidirectional recording mode.

FIG. 11A illustrates a posture change of a carriage, and FIG. 11B depicts a specific image when a position of the carriage is within a left end portion range and the image data is corrected.

FIG. 13A is a view equivalent to FIG. 2A, in accordance with a second embodiment, and FIG. 13B depicts a specific image when a position of the carriage of the second embodiment is within the left end portion range and the image data is corrected.

FIG. 14A is a view equivalent to FIG. 5A, in accordance with the second embodiment, FIG. 14B depicts a specific image when the image data is corrected n the bidirectional recording mode, in the second embodiment, and FIG. 14C depicts a specific image when the image data is corrected in the unidirectional recording mode.

FIG. 19A depicts a specific image in which a step is not generated, in a fifth embodiment, FIG. 19B depicts a specific image when the image data is not corrected, and FIG. 19C depicts a specific image when the image data is corrected.

FIG. 21A is a plan view of an inkjet printer of a sixth embodiment, FIG. 21B depicts a specific image when the image data is not corrected, and FIG. 21C depicts a specific image when the image data is corrected.

FIG. 22A is a plan view of an inkjet printer of a seventh embodiment, FIG. 22B depicts a specific image when the image data is not corrected, and FIG. 22C depicts a specific image when the image data is corrected.

FIG. 23A depicts a specific image when the image data is corrected, in an eighth embodiment, and FIG. 23B depicts a specific image when the image data is corrected, in a ninth embodiment.

FIG. 24A depicts a specific image when the image data is corrected, in a modified embodiment of the first embodiment, and FIG. 24B depicts a specific image when the image data is corrected, in a modified embodiment of the sixth embodiment.

DETAILED DESCRIPTION

First Embodiment

<Overall Configuration of Printer>

Figure 1:
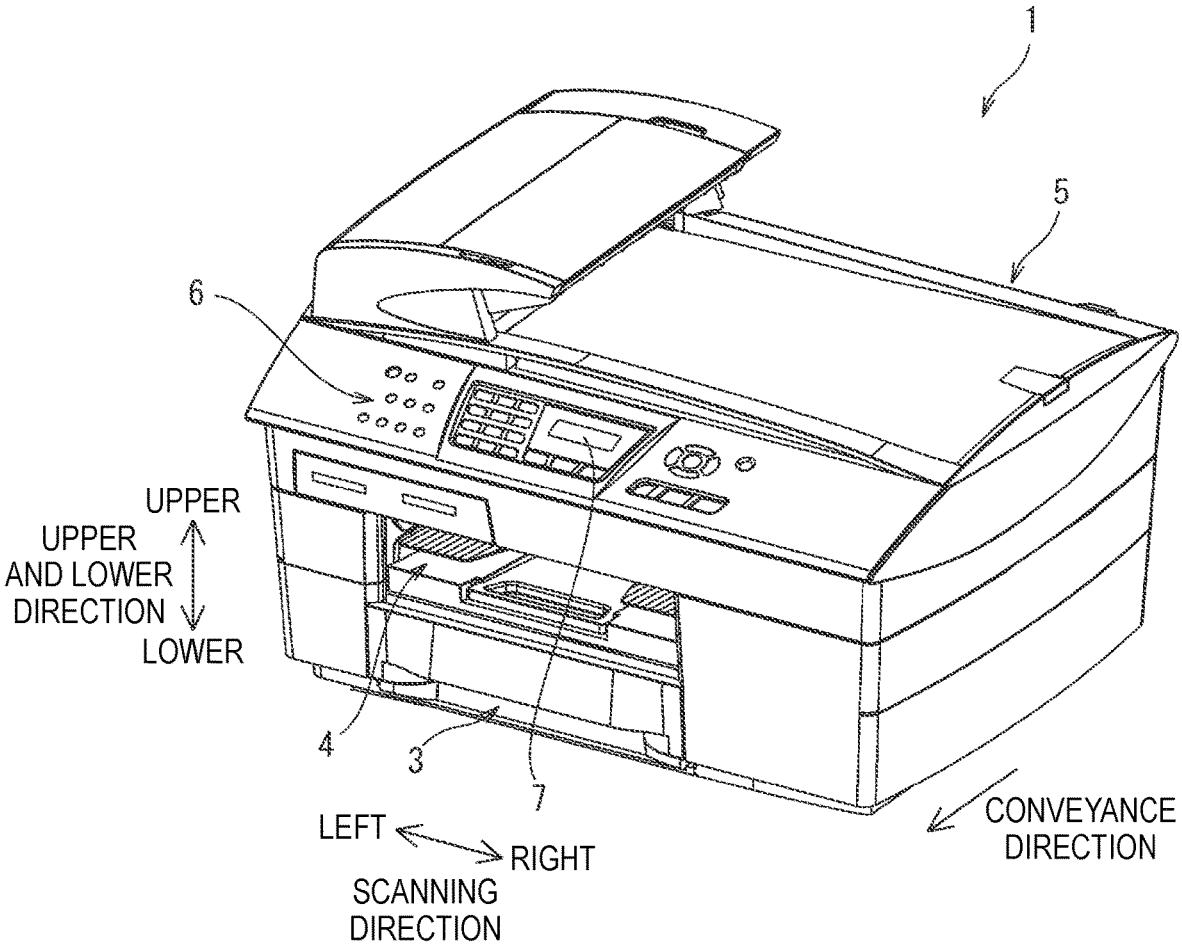
FIG. 1 is an outer perspective view of an inkjet printer of a first embodiment.

A printer 1 ("image recording apparatus" of the present disclosure) of a first embodiment is a so-called complex machine capable of recording an image on a sheet S ("medium" of the present disclosure) and reading an image. As shown in FIG. 1, the printer 1 includes a recording unit 2 (refer to FIG. 2), a feeder unit 3, a discharge unit 4, a readout unit 5, an operation unit 6, a display unit 7 and the like. Operations of the printer 1 are controlled by a control device 50 (refer to FIG. 6A).

The recording unit 2 is provided in the printer 1 and is configured to record an image on the sheet S. In the meantime, the recording unit 2 will be described in detail later. The feeder unit 3 is a unit for feeding the sheet S to the recording unit 2. The feeder unit 3 is configured to accommodate a plurality of types of sheets S having different sizes, and to selectively feed any one of the plurality of types of sheets S to the recording unit 2. The discharge unit 4 is a unit to which the sheet S, on which the image has been recorded by the recording unit 2, is to be discharged. The readout unit 5 is a scanner or the like, and is configured to read a document. The operation unit 6 includes a button and the like. A user operates the button of the operation unit 6, thereby performing a necessary operation on the printer 1. The display unit 7 is a liquid crystal monitor or the like, and is configured to display information that is necessary when using the printer 1.

Figure 2A:
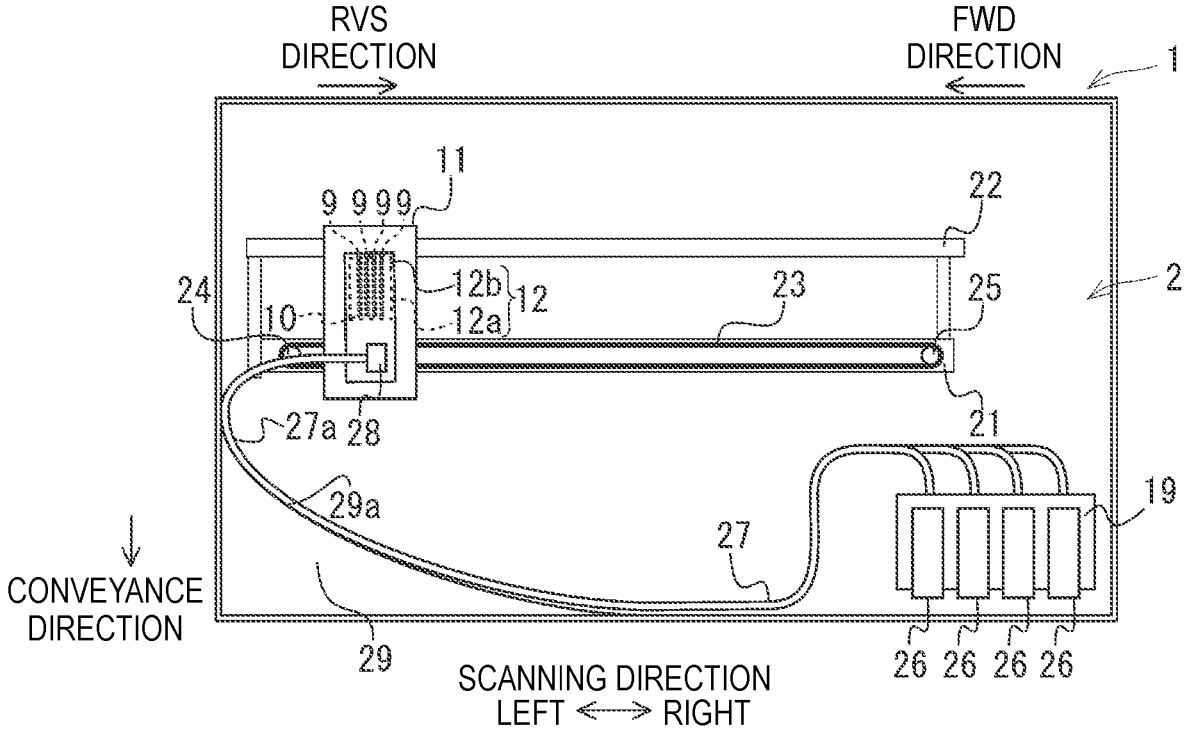
FIGS. 2A and 2B are plan views of the inkjet printer.

Subsequently, the recording unit 2 is described. As shown in FIGS. 2A to 5B, the recording unit 2 includes a carriage 11, an inkjet head 12 ("recording head" of the present disclosure), a conveyance roller pair 13, nine plates 14, a platen 15, eight discharge roller pairs 16, nine spurs 17, a holder 19 and the like. In FIG. 2, the conveyance roller pair 13, the plates 14, the platen 15, the discharge roller pairs 16, the spurs 17 and the like are not shown. In FIG. 3, in order to easily see the plates 14, ribs 20 (which will be described later) and the like, the carriage 11 is shown with the dashed-two dotted line, and members that are not actually seen with being hidden by the carriage 11 and are arranged below the carriage 11 are shown with the solid line. In FIG. 3, guide rails configured to support the carriage 11, and the like are not shown.

As shown in FIG. 2, the carriage 11 is mounted to two guide rails 21, 22 extending in parallel with each other in a right and left direction, and is configured to be moveable along the guide rails 21, 22. The carriage 11 is mounted with a drive belt 23. The drive belt 23 is an endless belt wound on two pulleys 24, 25. One pulleys 24 is coupled to a carriage motor 56 (refer to FIG. 6A). When the carriage motor 56 is rotated in forward and reverse directions, the pulleys 24, 25 are rotated, so that the drive belt 23 travels and thus the carriage 11 reciprocally moves in the right and left direction, which is a scanning direction. More specifically, when the carriage motor 56 is rotated in the forward direction, the carriage 11 moves in an FWD direction facing from a right end toward a left end, and when the carriage motor 56 is rotated in the reverse direction, the carriage 11 moves in an RVS direction facing from the left end toward the right end.

The holder 19 is arranged in front of the carriage 11. To the holder 19, four ink cartridges 26 ("tank" of the present disclosure) are detachably mounted. In the case of the printer 1, the user can perform operations of mounting and demounting the ink cartridges 26 from a front face-side of the printer 1. In the four ink cartridges 26, inks of black, yellow, cyan and magenta are respectively stored.

The inkjet head 12 is mounted to the carriage 11, and is configured to reciprocally move in the scanning direction, together with the carriage 11. The inkjet head 12 has a head main body 12*a*, and a buffer tank 12*b*. A tube joint 28 is provided at a part of the buffer tank 12*b* located downstream of an intermediate position of the inkjet head 12 in a conveyance direction, with respect to the conveyance direction. One end of each of the four supply tubes 27 is connected to the tube joint 28. Each of the four supply tubes 27 is a flexible tube. The other ends of the four supply tubes 27 are respectively connected to the four ink cartridges 26 mounted to the holder 19. The inks in the four ink cartridges 26 mounted to the holder 19 are supplied to the buffer tank 12*b* via the supply tubes 27. Each of the four supply tubes 27 has a curved part 27*a* extending leftward from a connection part to the tube joint 28, bent at the left of the inkjet head 12 in the printer 1 and extending rightward.

The head main body 12*a* is mounted to a lower part of the buffer tank 12*b*. The head main body 12*a* has a flow path unit and an actuator, which are not shown. The flow path unit is formed with an internal flow path including a plurality of nozzles 10 formed in a discharge surface 12*a*1, which is a lower surface of the flow path unit. The internal flow path is configured to communicate with the buffer tank 12*b*, and the plurality of nozzles 10 is configured to discharge the inks supplied from the buffer tank 12*b* through the internal flow path. The discharge surface 12*a*1 is a planar surface parallel in the front and rear direction and in the right and left direction.

As shown in FIG. 3, the plurality of nozzles 10 is aligned with constant nozzle intervals G over a length Ln in the conveyance direction (front and rear direction) perpendicular to the scanning direction, thereby forming nozzle rows 9. From the plurality of nozzles 10, the inks of black, yellow, cyan and magenta are discharged in order from the nozzles forming the right nozzle row 9. The actuator is provided to apply discharge energy to the ink in each nozzle 10, individually. For example, the actuator is configured to apply a pressure to the inks by changing a volume of a pressure chamber (not shown) configured to communicate with the nozzles 10 or to apply a pressure to the inks by generating air bubbles in the pressure chamber through heating. Since the configuration of the actuator is well known, the detailed description thereof is omitted.

In the first embodiment, discharge amounts of the inks that can be discharged from the nozzles 10 within one discharge period so as to record an image on the sheet S include five types (outsize droplet, large droplet, medium droplet, small droplet and not-discharge). That is, the printer 1 can perform recording of five gradations. In the first embodiment, the actuator is controlled to change at least one of the number of droplets to be discharged from the nozzles 10 within one discharge period and a droplet amount (volume) per one droplet, thereby regulating a discharge amount of the inks to be discharged from the nozzles 10 within one discharge period. Here, the discharge period means a time that is necessary for the carriage 11 to move by a unit distance corresponding to a resolution in the scanning direction (right and left direction).

Figure 2B:
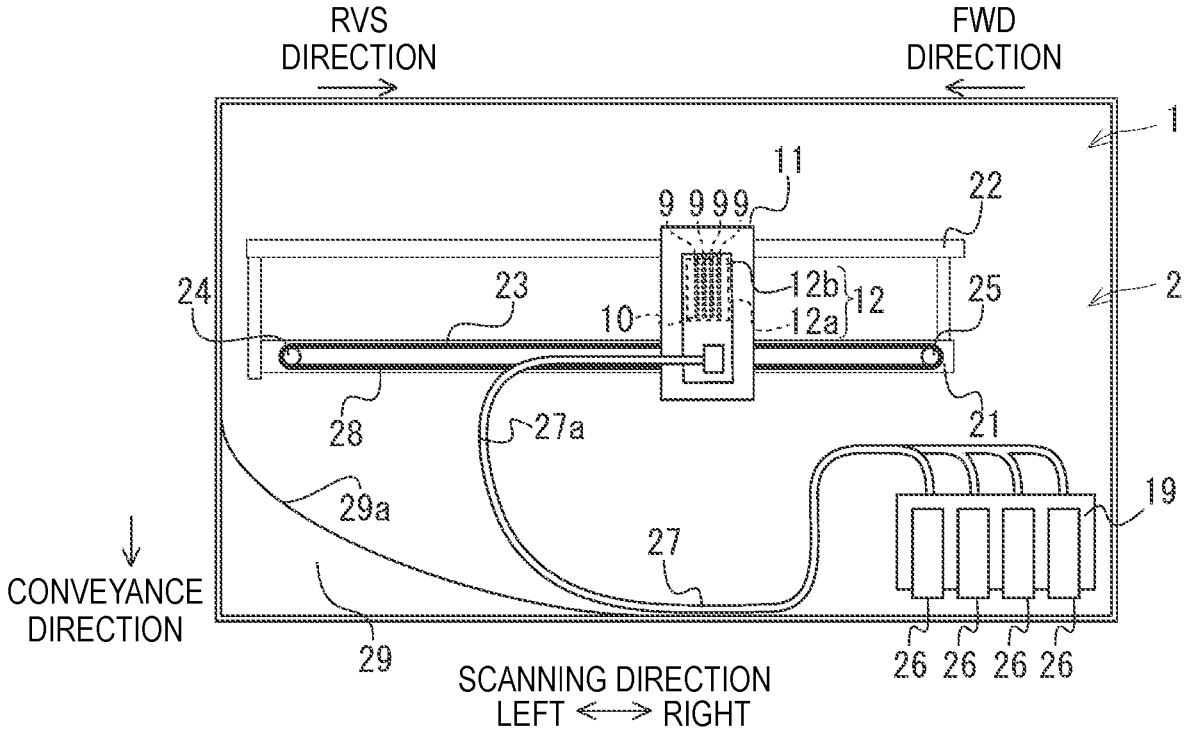
Figure 3:
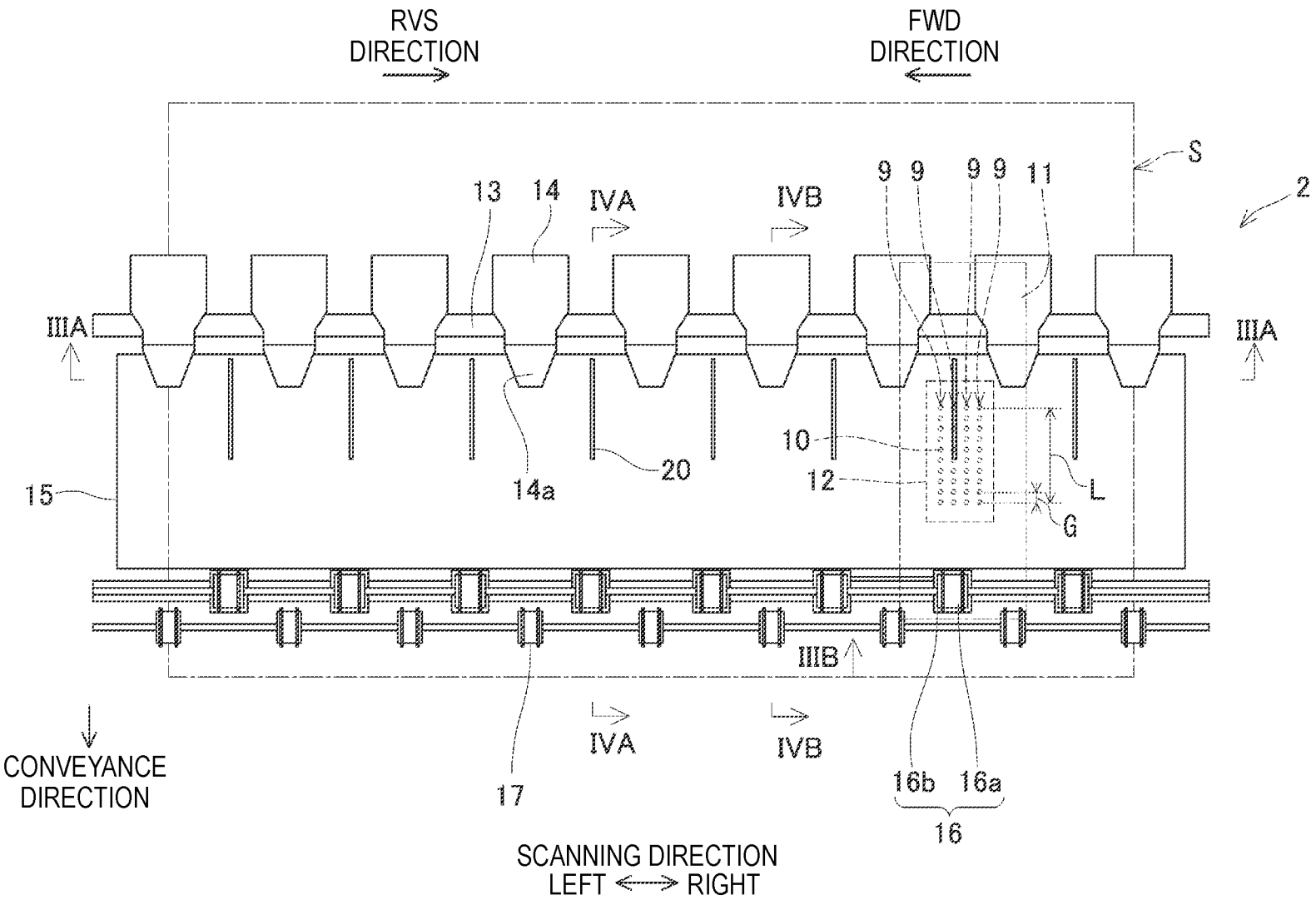
FIG. 3 is a plan view of a recording unit of FIG. 1.

As shown in FIG. 2, the printer 1 has therein a contact member 29 provided at a position in front of the carriage 11 and configured to support the four supply tubes 27. The contact member 29 has a contact surface 29*a* configured to support the curved parts 27*a* of the four supply tubes 27 with being in lateral contact with the same. As shown in FIG. 2A, the contact surface 29*a* extends so that it can be in contact with outer bent parts of the supply tubes 27 along the curved shape of the curved parts 27*a* of the supply tubes 27 in a state where the contact surface is located in a left end portion range of a moveable range of the carriage 11. Therefore, the four supply tubes 27 are in contact with the contact surface 29*a* with being curved and keeps the curved postures thereof. In the meantime, as shown in FIG. 2B, when the carriage 11 is located at the right of the left end portion range, the four supply tubes 27 are not in contact with the contact surface 29*a*.

As shown in FIG. 5, the conveyance roller pair 13 is arranged upstream of the inkjet head 12 with respect to the conveyance direction. The conveyance roller pair 13 has an upper roller 13*a* and a lower roller 13*b*. By the rollers, the sheet S fed from the feeder unit 3 is conveyed in the conveyance direction with being nipped in the upper and lower direction. The upper roller 13*a* is a drive roller that is to be driven by a conveyance motor 57 (refer to FIG. 6A). The lower roller 13*b* is a driven roller configured to rotate in conjunction with rotation of the upper roller 13*a*.

The platen 15 is arranged to face the discharge surface 12*a*1, downstream of the conveyance roller pair 13 with respect to the conveyance direction. The platen 15 extends in the scanning direction over an entire length of the range in which the carriage 11 can move upon recording of an image. The platen 15 is swingably supported to a swing shaft 15*a* provided at an upstream end portion with respect to the conveyance direction and extending in the scanning direction and is urged by a spring or the like (not shown), so that it is located at the position shown with the solid line in FIG. 5 in a state where the sheet S has not been conveyed thereto yet.

The nine plates 14 extend from positions overlapping with the conveyance roller pair 13 to positions downstream of the conveyance roller pair 13 with respect to the conveyance direction, and are aligned with equal intervals in the scanning direction. Each plate 14 has a pressing part 14*a* provided at a downstream end portion with respect to the conveyance direction for pressing the sheet S from above. The sheet S that is conveyed by the conveyance roller pair 13 passes between the plates 14 and the platen 15. At this time, the sheet S is pressed from above by the pressing parts 14*a* of the plates 14. The platen 15 is pressed downward due to the sheet S pressed by the plates 14, so that the platen swings about the swing shaft 15*a*, as shown with the dashed-dotted line in FIG. 5. At this time, the platen 15 more swings when the sheet S has a larger thickness. Thereby, an upper surface of the platen 15 is more spaced from the discharge surface 12*a*1 as the thickness of the sheet S increases. As a result, it is possible to substantially equalize a spaced distance (hereinafter, referred to as 'gap') in the upper and lower direction between the sheet S placed on the upper surface of the platen 15 and the discharge surface 12*a*1, irrespective of types of the sheet S.

The upper surface of the platen 15 is formed with eight ribs 20. The eight ribs 20 extend in the conveyance direction, respectively, and are aligned with equal intervals in the scanning direction so that each rib is located between the adjacent plates 14. The ribs 20 protrude from the upper surface of the platen 15 to positions higher than the pressing parts 14*a* of the plates 14, and extend from an upstream end portion of the platen 15 with respect to the conveyance direction toward a downstream side with respect to the conveyance direction, respectively. Thereby, the ribs 20 are configured to support the sheet S from below at positions higher than positions at which the pressing parts 14*a* press the sheet S.

The eight sets of the discharge roller pairs 16 are arranged downstream of the inkjet head 12 with respect to the conveyance direction. Positions of the discharge roller pairs 16 in the scanning direction are substantially the same as the ribs 20. Each discharge roller pair 16 has an upper roller 16*a* and a lower roller 16*b*. By the rollers, the sheet S is received from the conveyance roller pair 13, and is further conveyed in the conveyance direction with being nipped in the upper and lower direction. The discharge roller pairs 16 are configured to discharge the sheet S toward the discharge unit 4. The lower roller 16*b* is a drive roller configured to be driven by the conveyance motor 57 (refer to FIG. 6A). The upper roller 16*a* is a spur and is a driven roller configured to rotate in conjunction with rotation of the lower roller 16*b*. Here, the upper roller 16*a* is in contact with a recording surface of the recorded sheet S. However, since the upper roller 16*a* is the spur, not a roller having a smooth outer peripheral surface, the inks on the sheet S are difficult to be attached to the upper roller 16*a*.

The nine spurs 17 are arranged downstream of the discharge roller pairs 16 with respect to the conveyance direction, and are configured to press the sheet S from above. Positions of the nine spurs 17 in the scanning direction are substantially the same as the pressing parts 14*a* of the nine plates 14. Since the spur 17 is a spur, not a roller having a smooth outer peripheral surface, the inks on the sheet S are difficult to be attached to the spur.

In the meantime, the numbers of the plates 14 and the discharge roller pairs 16 and the numbers of the ribs 20 and the spurs 17 are exemplary and may be arbitrarily set. The plate 14, the discharge roller pair 16, the rib 20 and the spur 17 may be provided by at least one, respectively.

Figure 4A:
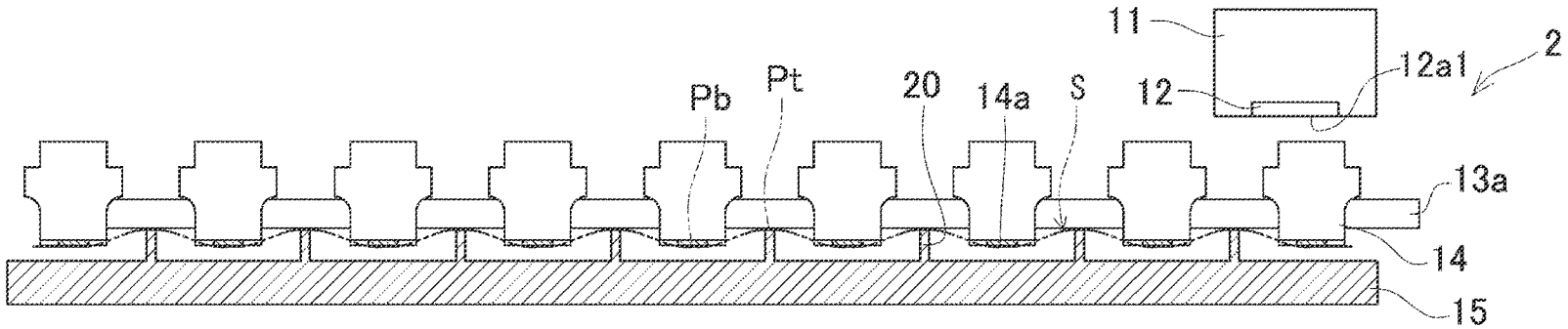
FIG. 4A is a sectional view taken along a line IIIA-IIIA of FIG. 3.
Figure 4B:
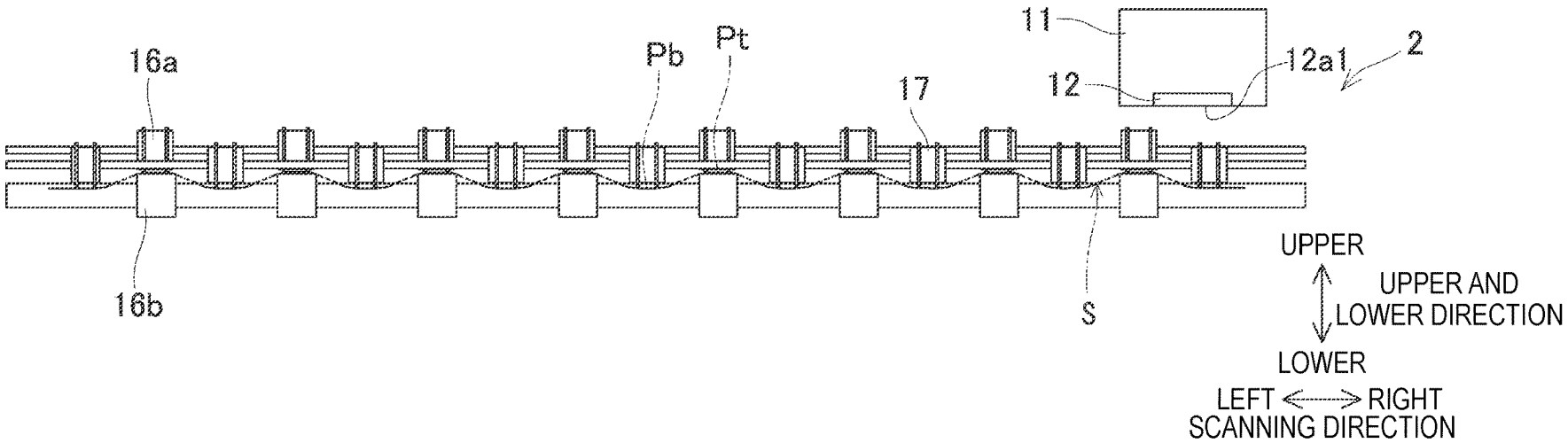
FIG. 4B is a view, as seen from an arrow IIIB of FIG. 3.

The sheet S is supported by the eight ribs 20 and the eight lower rollers 16*b* from below and are pressed and bent from above by the pressing parts 14*a* of the nine plates 14 and the nine spurs 17, so that the sheet has a waveform in the scanning direction, as shown in FIGS. 4A and 4B.

Positions of the waveform-shaped sheet S in the scanning direction at which the ribs 20 and the discharge roller pairs 16 are respectively arranged are convex apexes Pt having maximum heights. Positions of the sheet S in the scanning direction at which the pressing parts 14*a* of the plates 14 and the spurs 17 are respectively arranged are concave apexes Pb having minimum heights. That is, the sheet S has a waveform in which convex parts protruding toward the discharge surface 12*a*1 about the convex apexes Pt and concave parts more spaced from the discharge surface 12*a*1 than the convex parts about the concave apexes Pb are alternately arranged. In the first embodiment, the eight ribs 20, and the eight lower rollers 16*b* correspond to the "support member" of the present disclosure. The nine plates 14 and the spurs 17 correspond to the "pressing member" of the present disclosure. The entirety of the eight ribs 20, the eight lower rollers 16*b*, the nine plates 14 and the spurs 17 corresponds to the "waveform generation mechanism" of the present disclosure. The entirety of the conveyance roller pair 13, the discharge roller pairs 16 and the platen 15 corresponds to the "conveyer" of the present disclosure.

Figure 6A:
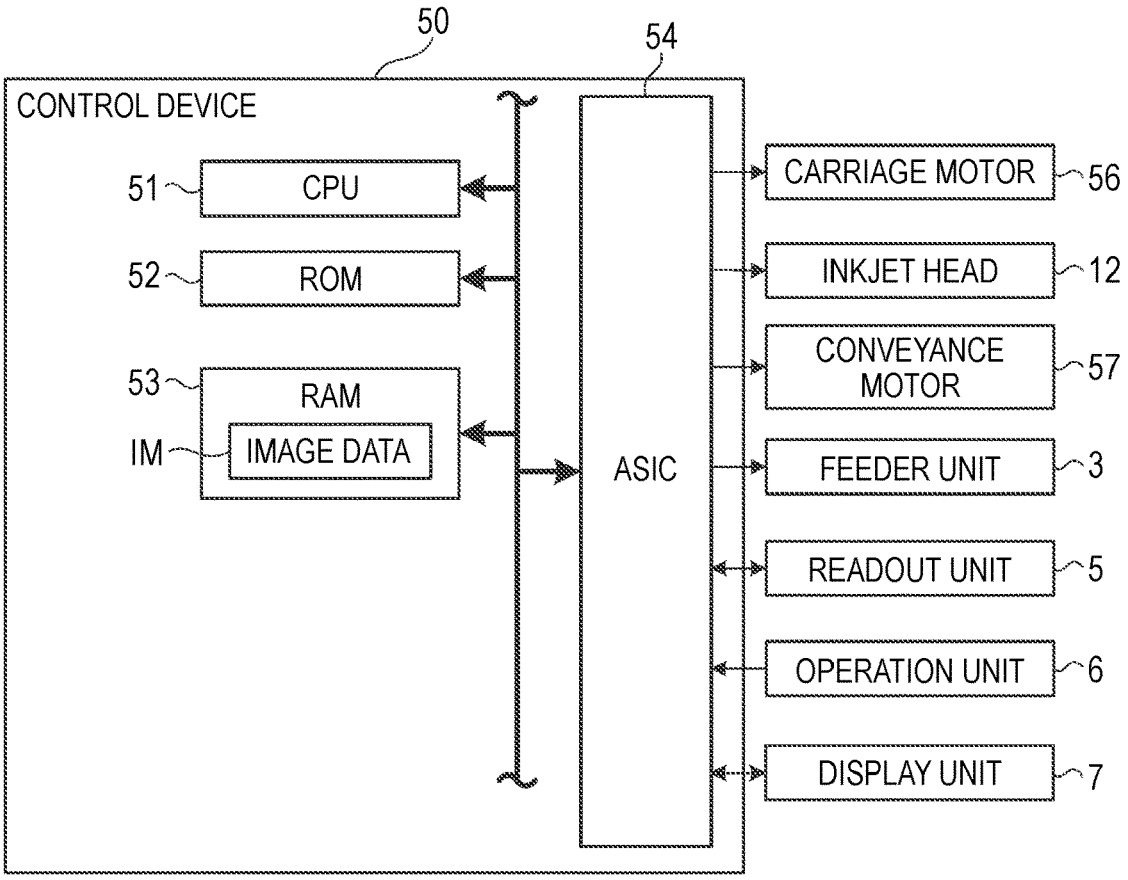
FIG. 6A is a block diagram depicting an electrical configuration of the inkjet printer.

Subsequently, an electrical configuration of the printer 1 is described. Operations of the printer 1 are controlled by a control device 50. As shown in FIG. 6A, the control device 50 includes a CPU (Central Processing Unit) 51, a ROM (Read Only Memory) 52, a RAM (Random Access Memory) 53, an ASIC (Application Specific Integrated Circuit) 54 including diverse control circuits, and the like. The ASIC 54 is electrically connected with the inkjet head 12, the feeder unit 3, a carriage motor 56, a conveyance motor 57, and the like.

In the ROM 5, a program that is to be executed by the CPU 51, a variety of fixed data, and the like are stored. In the RAM 53, data necessary upon execution of the program, image data IM relating to an image to be recorded on the sheet S, and the like are temporarily stored.

Figure 6B:
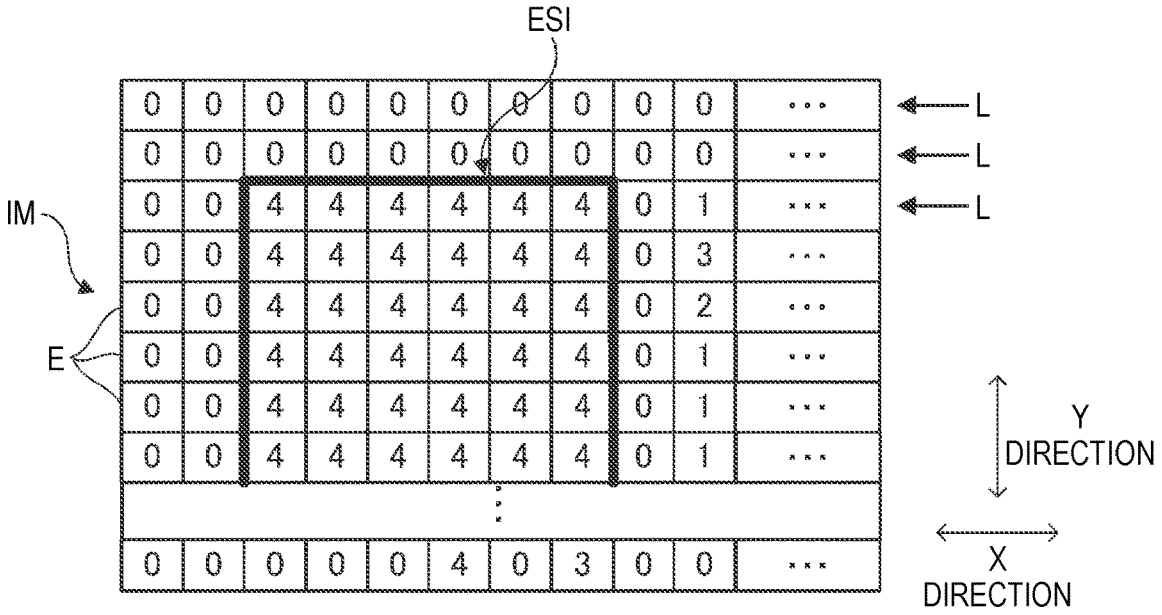
FIG. 6B depicts image data.

As shown in FIG. 6B, the image data IM has a plurality of dot elements E corresponding to a plurality of dots (including not-discharged dots to which the ink has not been spotted) to be formed on the sheet S. Specifically, the image data IM is formed by the plurality of dot elements E arranged in an X direction and in a Y direction perpendicular to each other. The X direction and the Y direction correspond to the scanning direction and the conveyance direction, respectively. For each dot element E, a discharge amount of ink that is to be discharged from the nozzle 10 when forming a corresponding dot is set. Specifically, for each dot element E, any one of the five types of the discharge amounts (outsize droplet, large droplet, medium droplet, small droplet and not-discharge) is set. The five types of the discharge amounts are larger in order of outsize droplet, large droplet, medium droplet, small droplet and not-discharge. Also, 'not-discharge' indicates a discharge amount of zero. That is, a dot corresponding to the dot element E for which 'not-discharge' is set is a not-discharged dot to which the ink is not spotted. The image data IM has a plurality of line data L. Each of the line data L is data consisting of the plurality of dot elements E corresponding to the plurality of dots aligned in the scanning direction on the sheet S. In the meantime, in the image data IM of FIG. 6B, the dot element E for which 'outsize droplet' is set denoted with "4", the dot element E for which 'large droplet' is set denoted with "3", the dot element E for which 'medium droplet' is set denoted with "2", the dot element E for which 'small droplet' is set denoted with "1" and the dot element E for which 'not-discharge' is set denoted with "0".

The control device 50 is configured to execute a variety of processing including recording processing of recording an image relating to the image data IM to the sheet S by controlling the inkjet head 12, the feeder unit 3, the carriage motor 56, the conveyance motor 57 and the like. In the meantime, the control device 50 may be configured so that only the CPU 51 is to execute the variety of processing, only the ASIC 54 is to execute the variety of processing or the CPU 51 and the ASIC 54 are to execute the variety of processing in cooperation with each other. The control device 50 may be configured so that one CPU 51 is singularly to execute the processing or a plurality of CPUs 51 is to execute the processing in a distributed manner. The control device 50 may be configured so that one ASIC 54 is singularly to execute the processing or a plurality of ASICs 54 is to execute the processing in a distributed manner.

(Flow of Recording Processing)

In the below, the recording processing that is to be executed by the control device 50 when recording an image on the sheet S is described. In the first embodiment, when a recording command to instruct the printer 1 to execute the recording is input, the control device 50 executes the processing in accordance with a flow of FIG. 7, thereby recording an image on the sheet S.

Figure 7:
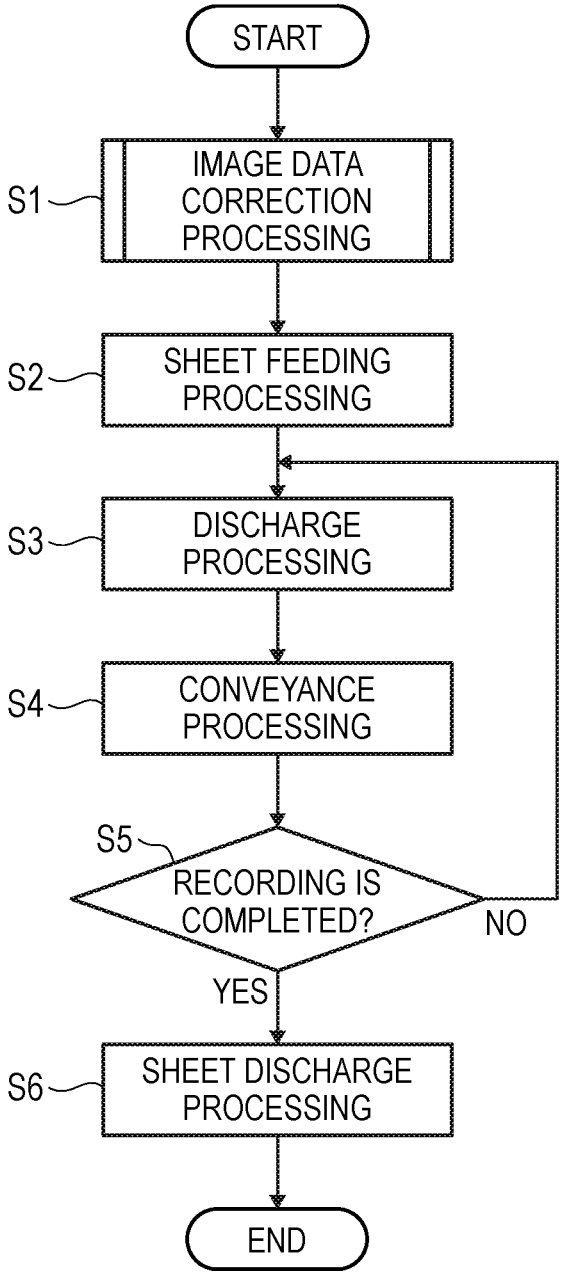
FIG. 7 is a flowchart of recording processing.

As shown in FIG. 7, the control device 50 first executes image data correction processing of correcting the image data IM (hereinafter, referred to as 'image data IM before correction', too) of a recording target stored in the RAM 53 (S1). The image data correction processing is processing for making it difficult for image quality degradation of an image to be recorded on the sheet S to be conspicuous. The image data correction processing will be described in detail later. Then, the control device 50 executes sheet feeding processing of controlling the feeder unit 3 to feed the sheet S to the recording unit 2 (S2). In the sheet feeding processing, the sheet S is conveyed up to a recording start position. The recording start position is a position at which a region of the sheet S, on which the image is to be first recorded, and the discharge surface 12*a*1 of the inkjet head 12 face each other.

Subsequently, the control device 50 executes discharge processing (S3). In the discharge processing, the control device 50 executes a recording operation in which while the control device 50 controls the carriage motor 56 to move the carriage 11 in the scanning direction, the control device 50 controls the inkjet head 12 to discharge the inks from the plurality of nozzles 10 at predetermined timings, thereby forming dots on the sheet S. More specifically, in the discharge processing, each nozzle 10 of the inkjet head 12 is associated with any one of the line data L of the image data IM (hereinafter, referred to as 'image data IM after correction') corrected in the image data correction processing of S1. Then, the inks of the discharge amounts set for the dot elements E of the corresponding line data L are discharged from the respective nozzles 10 to form dots on the sheet S, in each discharge period. Thereby, on the sheet S, one line-part image (hereinafter, referred to as 'line image', too) consisting of the plurality of dots arranged in the scanning direction is recorded for each nozzle 10.

In the meantime, as described above, since the sheet S has the waveform along the scanning direction, the gap from the discharge surface 12*a*1 changes in the scanning direction. Since the inks are discharged from the nozzles 10 during movement of the carriage 11, the inertial force is applied to the inks discharged from the nozzles 10. For this reason, a flying direction of the ink is not the just below direction, and includes a component of the moving direction of the carriage 11. As a result, when intervals of the discharge timings are made constant, intervals of dots in the scanning direction are not constant. Therefore, in the recording operation, the discharge timing at which the ink is to be discharged from the nozzle 10 is adjusted at each position, at which the dot is to be formed, in the scanning direction on the sheet S, in correspondence to the gap from the discharge surface 12*a*1. In the meantime, the discharge timing is adjusted on the assumption that the waveform of the sheet S is kept.

Continuously, the control device 50 executes conveyance processing (S4). In the conveyance processing, the control device 50 executes a conveyance operation of controlling the conveyance motor 57 to convey the sheet S to the conveyance roller pair 13 and the discharge roller pairs 16 by the length Ln of the nozzle row 9. Thereby, as shown in FIG. 8A, a first dot formation range $K_P$ where dots are to be formed in a preceding recording operation of two consecutive recording operations and a second dot formation range $K_L$ where dots are to be formed in a subsequent recording operation of the two consecutive recording operations are adjacent to each other in the conveyance direction without overlapping each other on the sheet S.

When the recording of the image on the sheet S has not completed yet (S5: NO), the control device 50 returns to the processing of S3. Thereby, the recording operation and the conveyance operation are alternately repeated until the recording of the image on the sheet S is to complete.

When the recording of the image on the sheet S has completed (S5: YES), the control device 50 executes sheet discharge processing (S6). In the sheet discharge processing, the control device 50 controls the conveyance motor 57 to discharge the sheet S to the sheet discharge unit 4 by the conveyance roller pair 13 and the discharge roller pairs 16.

Here, in the first embodiment, as a recording mode of the recording processing, a unidirectional recording mode and a bidirectional recording mode are provided. In the recording processing, the control device 50 records an image by any one recording mode of the unidirectional recording mode and the bidirectional recording mode. In the below, the unidirectional recording mode and the bidirectional recording mode are described.

The unidirectional recording mode is a recording mode of discharging the inks from the plurality of nozzles 10 only when moving the carriage 11 in one side (the RVS direction, in the first embodiment) of the scanning direction. Therefore, in the unidirectional recording mode, in all the recording operations executed when recording an image on one sheet S, the moving direction of the carriage 11 in each of the two consecutive recording operations is the same. That is, in each of the two consecutive recording operations, the moving direction of the carriage 11 during the preceding recording operation and the moving direction of the carriage 11 during the subsequent recording operation are the same.

The bidirectional recording mode is a recording mode of discharging the inks from the plurality of nozzles 10 when moving the carriage 11 in any side of one and other sides (the RVS direction and the FWD direction, in the first embodiment) of the scanning direction. Therefore, in the bidirectional recording mode, in all the recording operations executed when recording an image on one sheet S, the moving direction of the carriage 11 in the recording operation alternately changes. That is, in each of the two consecutive recording operations, the moving direction of the carriage 11 during the preceding recording operation and the moving direction of the carriage 11 during the subsequent recording operation are different from each other.

In the unidirectional recording mode, after moving the carriage 11 in the RVS direction to execute one recording operation, a return operation of moving the carriage 11 in the FWD direction should be executed before starting a subsequent recording operation. On the other hand, in the bidirectional recording mode, it is not necessary to execute the return operation after executing one recording operation. For this reason, in the bidirectional recording mode, it is possible to improve the throughput, as compared to the unidirectional recording mode. On the other hand, in the bidirectional recording mode, an image quality of an image to be recorded on the sheet S is likely to be degraded, as compared to the unidirectional recording mode. For example, when an actual gap between the sheet S and the discharge surface 12*a*1 is different from the assumed gap, the flying time of the inks discharged from the nozzles 10 also changes. Since the flying direction of the ink includes the component of the moving direction of the carriage 11, too, when the flying time changes, a spotting position of the ink on the sheet S deviates from an ideal spotting position with respect to the scanning direction. At this time, in the unidirectional recording mode, since the moving directions of the carriage 11 in the respective recording operations are the same, the deviation direction of the actual spotting position with respect to the ideal spotting position is the same. On the other hand, in the bidirectional recording mode, the moving directions of the carriage 11 in the two consecutive recording operations are different from each other. For this reason, the deviation direction during the preceding recording operation of the two consecutive recording operations and the deviation direction during the subsequent recording operation are different from each other. Therefore, in the bidirectional recording mode, an image quality is more likely to be degraded due to the deviation of the spotting position of the ink, as compared to the unidirectional recording mode.

(Image Data Correction Processing)

Subsequently, while describing the image data correction processing, matters that are premises thereof are also described.

As shown in FIG. 8A, when recording a specific image SI over a boundary of the first dot formation range $K_P$ and the second dot formation range $K_L$, a step may be generated in the specific image SI due to diverse factors. Here, the specific image SI indicates an image consisting of a plurality of discharged dots D and having widths of a plurality of dots in the conveyance direction and in the scanning direction. As the specific image SI, a ruled line sandwiched by not-discharged dots from both sides in the scanning direction, having a width for a plurality of dots (for example, six dots) in the scanning direction and extending in the conveyance direction may be exemplified. The discharged dot D is a dot of which the discharge amount set for the corresponding dot element E of the image data IM is one of outsize droplet, large droplet, medium droplet and small droplet. The not-discharged dot is a dot of which the discharge amount set for the corresponding dot element E of the image data IM is zero (not-discharge). In the meantime, in FIG. 8, only the discharged dots D are shown, and the not-discharged dot is not shown. This applies to FIGS. 10A to 10C, 11A, 11B, 13A, 13B, 14A, 14B, 16A, 16B, 19A to 19C and 21A to 24B (which will be referred to later), too.

In the below, it is assumed that the specific image SI is configured by the discharged dots D of which the discharge amounts set for the corresponding dot elements E are outsize droplets, and is a ruled line having a width for six dots in the scanning direction. Therefore, as shown in FIGS. 6B and 9A, in the image data IM, specific image data ESI corresponding to the specific image SI is data in which a plurality of dot element rows, each of which is configured by the six dot elements E having a discharge amount "outsize droplet" of "4" and aligned in the X direction, is aligned in the Y direction. In the meantime, in FIG. 9, only the specific image data ESI of the image data IM is shown.

In the first embodiment, as main factors of the step generated in the specific image SI, a factor that the gap between the sheet S and the discharge surface 12*a*1 is different at upstream and downstream sides with respect to the conveyance direction, a variation in gap at the convex part of the sheet S, and a factor that the posture of the carriage 11 is changed due to a reactive force applied to the supply tubes 27 from the contact surface 29*a* may be exemplified. In the below, each of the three factors is described. For convenience of descriptions, it is assumed that the step in the specific image SI is generated due to only one of the three factors.

First, the step in the specific image SI, which is caused when the gap is different at upstream and downstream sides with respect to the conveyance direction, is described. When the gap is uniform without variation at the upstream and downstream sides with respect to the conveyance direction, the flying times of the inks discharged from the respective nozzles 10 of the nozzle row 9 are the same. Therefore, as shown in FIG. 8A, in each of the recording operations, the discharged dots D to be formed by the inks from the respective nozzles 10 of the nozzle rows 9 within the same discharge period are formed at the same positions in the scanning direction. That is, the discharged dots D, which are to be formed by the same recording operation, of the plurality of discharged dots D corresponding to the plurality of dot elements E (the dot elements E of which positions in the X direction are the same) aligned in the Y direction of the specific image data ESI are formed at the same positions in the scanning direction.

However, in the first embodiment, as described above, the platen 15 is swingably supported to the swing shaft 15*a* provided at the upstream end portion with respect to the conveyance direction and is configured to swing due to the sheet S pressed by the plate 14. According to this configuration, the gap between the sheet S and the discharge surface 12*a*1 increases toward the downstream side with respect to the conveyance direction.

For this reason, in each of the recording operations, the flying time of the ink discharged from the nozzle 10 arranged downstream of the nozzle row 9 with respect to the conveyance direction increases, so that the spotting position of the corresponding ink is located downstream of the moving direction of the carriage 11. That is, as shown in FIG. 8B, in each of the recording operations, regarding the respective formation positions of the discharged dots D, which are to be formed by the inks discharged from the respective nozzles 10 of the nozzle row 9 within the same discharge period, the downstream discharged dot D with respect to the conveyance direction is located downstream with respect to the moving direction of the carriage 11. In the first embodiment, the nozzle 10, which is located most upstream of the nozzle row 9 with respect to the conveyance direction, is set as a reference nozzle. The discharge timings of the inks are set so that positions of the dot row, which is to be formed by the inks discharged from the reference nozzles in each of the recording operations, are the same in the scanning direction.

Accordingly, a step is generated between a first image region $I_P$, which is recorded in the first dot formation range $K_P$ of the specific image SI, and a second image region IL, which is recorded in the second dot formation range $K_L$ of the specific image SI. That is, a first boundary region $B_P$, which is adjacent to the second dot formation range $K_L$, in the first image region $I_P$ entirely deviates in the scanning direction relative to a second boundary region $B_L$, which is adjacent to the first dot formation range $K_P$, in the second image region IL. Specifically, in the case of the bidirectional recording mode, the first boundary region $B_P$ entirely deviates relative to the second boundary region $B_L$ toward the downstream side with respect to the moving direction of the carriage 11 during the preceding recording operation. In the meantime, a length of the first boundary region $B_P$ in the conveyance direction is shorter than a length of the first dot formation range $K_P$ in the conveyance direction. Likewise, a length of the second boundary region $B_L$ in the conveyance direction is shorter than a length of the second dot formation range $K_L$ in the conveyance direction.

As described above, since the swinging width of the platen 15 changes depending on the thickness of the sheet, the gap difference at the upstream and downstream sides with respect to the conveyance direction changes depending on the type of the sheet S on which an image is to be recorded. Therefore, the deviation amount of the first boundary region $B_P$ relative to the second boundary region $B_L$ changes depending on the type of the sheet S.

As countermeasures against the step in the specific image SI, which is caused due to the gap difference at the upstream and downstream sides with respect to the conveyance direction, the control device 50 corrects the specific image data ESI in the image data correction processing, as follows. That is, in the case of the bidirectional recording mode, as shown in FIG. 8C, the control device 50 sets, as a correction portion AM, a downstream end portion of the first boundary region $B_P$ with respect to the moving direction of the carriage 11 during the preceding recording operation and a downstream end portion of the second boundary region $B_L$ with respect to the moving direction of the carriage 11 during the subsequent recording operation, respectively.

Then, as shown in FIG. 9B, the control device 50 performs correction of reducing the discharge amounts set for the dot elements E, which correspond to the discharged dots D placed at the correction portion AM, of the specific image data ESI. Specifically, in the first embodiment, the correction of changing the discharge amounts set for the dot elements E, which correspond to the discharged dots D placed at the correction portion AM, from "outsize droplet" to "large droplet". In the meantime, in FIG. 9B, the dot elements E of which the discharge amounts have been corrected from "outsize droplet" to "large droplet" are all hatched.

When the image is recorded on the sheet S in accordance with the image data IM corrected as described above, even though step is generated in the specific image SI due to the gap difference at the upstream and downstream sides with respect to the conveyance direction, it is possible to reduce sizes of the discharged dots D formed at a corner portion thereof. That is, it is possible to chamfer the corner portion of the step generated in the specific image SI. As a result, it is possible to make it difficult for the step in the specific image SI to be conspicuous.

Here, an area and a shape of the correction portion AM are determined on the basis of a test and the like. For example, the area and shape of the correction portion AM are set so that, when the first image region $I_P$ and the second image region IL of the specific image SI are recorded so that they deviate from each other by a half amount of the maximum deviation amount to be estimated, the step in the specific image SI is difficult to be conspicuous. The inventors performed a test and the like, and found out that, when a length of the correction portion AM in the scanning direction is shorter that a length in the conveyance direction, the step in the specific image SI is difficult to be conspicuous. The inventors found out that when the length of the correction portion AM in the scanning direction is too great, the image quality degradation resulting from the reduction in the sizes of the discharged dots D placed at the correction portion AM is conspicuous, and that even when the length in the scanning direction is a length of one dot-part, the step in the specific image SI is difficult to be conspicuous. Therefore, in the first embodiment, the shape of the correction portion AM is set to a rectangular shape of which a length in the scanning direction is a length of one dot-part and a length in the conveyance direction is a length for three dots. However, the shape of the correction portion AM is not limited thereto. For example, the length in the scanning direction may be a length of one dot-part and the length in the conveyance direction may be a length of one dot-part.

In the case of the unidirectional recording mode, as shown in FIG. 10A, the control device 50 sets, as the correction portion AM, a downstream end portion (right end portion) of the first boundary region $B_P$ with respect to the RVS direction and an upstream end portion (left end portion) of the second boundary region $B_L$ with respect to the RVS direction, respectively. Thereby, also in the case of the unidirectional recording mode, it is possible to make it difficult for the step in the specific image SI to be conspicuous. In the first embodiment, each of the first boundary region $B_P$ and the second boundary region $B_L$ corresponds to the "specific region" of the present disclosure.

Then, the step in the specific image SI, which is generated due to the variation in gap at the convex part of the sheet S, is described. As described above, the sheet S is supported from below by the ribs 20 and the lower rollers 16*b* and is pressed from above by the pressing parts 14*a* of the plates 14 and the spurs 17, so that the sheet has the waveform where the convex part and the concave part are alternately arranged in the scanning direction, as shown in FIGS. 4A and 4B. Here, since the sheet S is pressed from above at the concave part of the sheet S by the pressing part 14*a* and the spur 17, the gap from the discharge surface 12*a*1 is difficult to vary. On the other hand, the sheet S is simply supported from below at the convex part by the rib 20 and the discharge roller pair 16 and is not pressed from above. For this reason, as shown with the dashed-dotted line in FIG. 10B, the convex part of the sheet S more floats than assumed, so that the actual gap from the discharge surface 12*a*1 is likely to be narrower than the assumed gap. As a result, in the case where the recording mode is the bidirectional recording mode, even though the discharge of the ink is controlled in each of the preceding recording operation and the subsequent recording operation so that the dot is to be formed at the same position on the convex part in the scanning direction, the dot to be formed in the preceding recording operation and the dot to be formed in the subsequent recording operation may be formed with being spaced from each other in the scanning direction.

Therefore, as countermeasures against the step in the specific image SI, which is caused due to the variation in gap at the convex part of the sheet S, the control device 50 corrects the specific image data ESI in the image data correction processing, as follows, when the recording mode of the recording processing is the bidirectional recording mode. That is, as shown in FIG. 10C, when the recording positions of the first boundary region $B_P$ and the second boundary region $B_L$ of the specific image SI are within a predetermined range about the convex apex Pt, the control device 50 sets, as the correction portion AM, an upstream end portion of the first boundary region $B_P$ with respect to the moving direction of the carriage 11 during the preceding recording operation and an upstream end portion of the second boundary region $B_L$ with respect to the moving direction of the carriage 11 during the subsequent recording operation, respectively. Then, the control device 50 corrects the discharge amounts set for the dot elements E, which correspond to the discharged dot D placed at the correction portion AM, of the specific image data ESI from "outsize droplet" to "large droplet". By the correction, even when the step is generated in the specific image SI due to the variation in gap at the convex part of the sheet S, it is possible to make it difficult for the step to be conspicuous.

Subsequently, the step in the specific image SI, which is caused due to the posture change of the carriage 11 as a result of the reactive force applied to the supply tube 27 from the contact surface 29*a*, is described. As described above, in the state where the carriage 11 is located in the left end portion range, the curved part 27*a* of the supply tube 27 is in contact with the contact surface 29*a*. At this time, the supply tube 27 is applied with the reactive force from the contact surface 29*a*, thereby pressing rightward the tube joint 28.

There is a slight play between the carriage 11 and the guide rails 21, 22. Thereby, as shown in FIG. 11A, in the state where the carriage 11 is located in the left end portion range, the posture of the carriage 11 is slightly changed by the pressing force applied to the inkjet head 12 from the supply tube 27. Specifically, the carriage 11 is slightly rotated so that the upstream nozzles 10 of the nozzle rows 9 with respect to the conveyance direction are to be moved leftward and the downstream nozzles 10 are to be moved rightward. As a result, the aligning direction of the nozzle rows 9 is not parallel with the conveyance direction and is slightly inclined relative to the conveyance direction. Therefore, as shown in FIG. 11B, in the state where the carriage 11 is located in the left end portion range, regarding the respective formation positions of the discharged dots D, which are to be formed by the inks discharged from the respective nozzles 10 of the nozzle rows 9 within the same discharge period, the downstream discharged dots D with respect to the conveyance direction are located more rightward with respect to the scanning direction, in each of the recording operations.

Therefore, as countermeasures against the step in the specific image SI, which is caused due to the posture change of the carriage 11, the control device 50 corrects the specific image data ESI in the image data correction processing, as follows. That is, as shown in FIG. 11B, when the position of the carriage 11 is within the left end portion range upon the recording of the specific image SI, the control device 50 sets, as the correction portion AM, a right end portion of the first boundary region $B_P$ and a left end portion of the second boundary region $B_L$, respectively. Then, the control device 50 corrects the discharge amounts set for the dot elements E, which correspond to the discharged dot D placed at the correction portion AM, of the specific image data ESI from "outsize droplet" to "large droplet". By the correction, even when the step is generated in the specific image SI due to the posture change of the carriage 11, it is possible to make it difficult for the step to be conspicuous.

As described above, in the first embodiment, when it is assumed that the first boundary region $B_P$ entirely deviates rightward relative to the second boundary region $B_L$, the right end portion of the first boundary region $B_P$ and the left end portion of the second boundary region $B_L$ are respectively set as the correction portion AM. On the other hand, when it is assumed that the first boundary region $B_P$ entirely deviates leftward relative to the second boundary region $B_L$, the left end portion of the first boundary region $B_P$ and the right end portion of the second boundary region $B_L$ are respectively set as the correction portion AM. That is, the end portion, which is closer to the right end of the sheet S, of the right end portion of the first boundary region $B_P$ and the right end portion of the second boundary region $B_L$ is set as the correction portion AM. Likewise, the end portion, which is closer to the left end of the sheet S, of the left end portion of the first boundary region $B_P$ and the left end portion of the second boundary region $B_L$ is set as the correction portion AM.

Figure 12A:
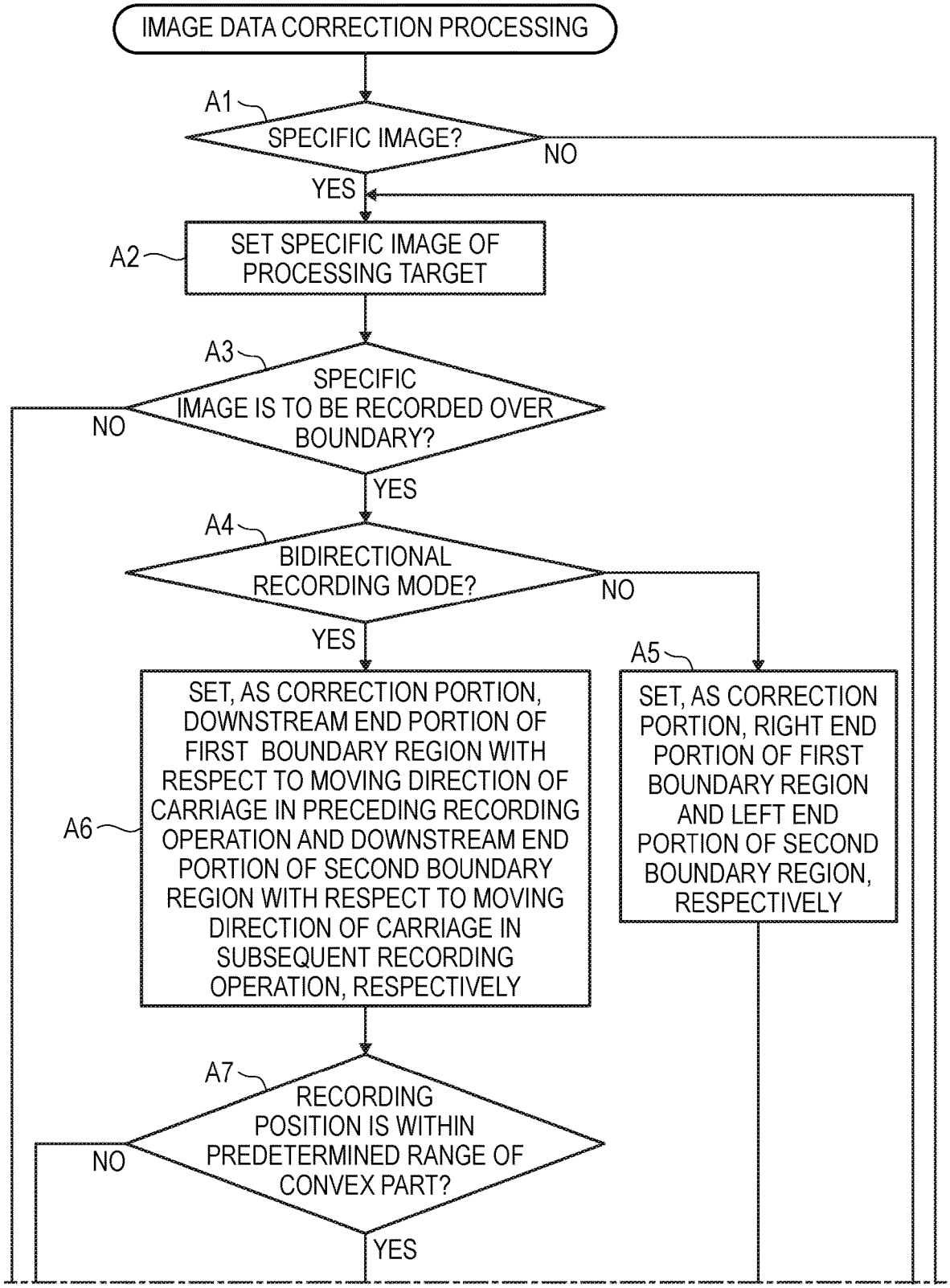
FIGS. 12A and 12B are flowcharts of image data correction processing.
Figure 12B:
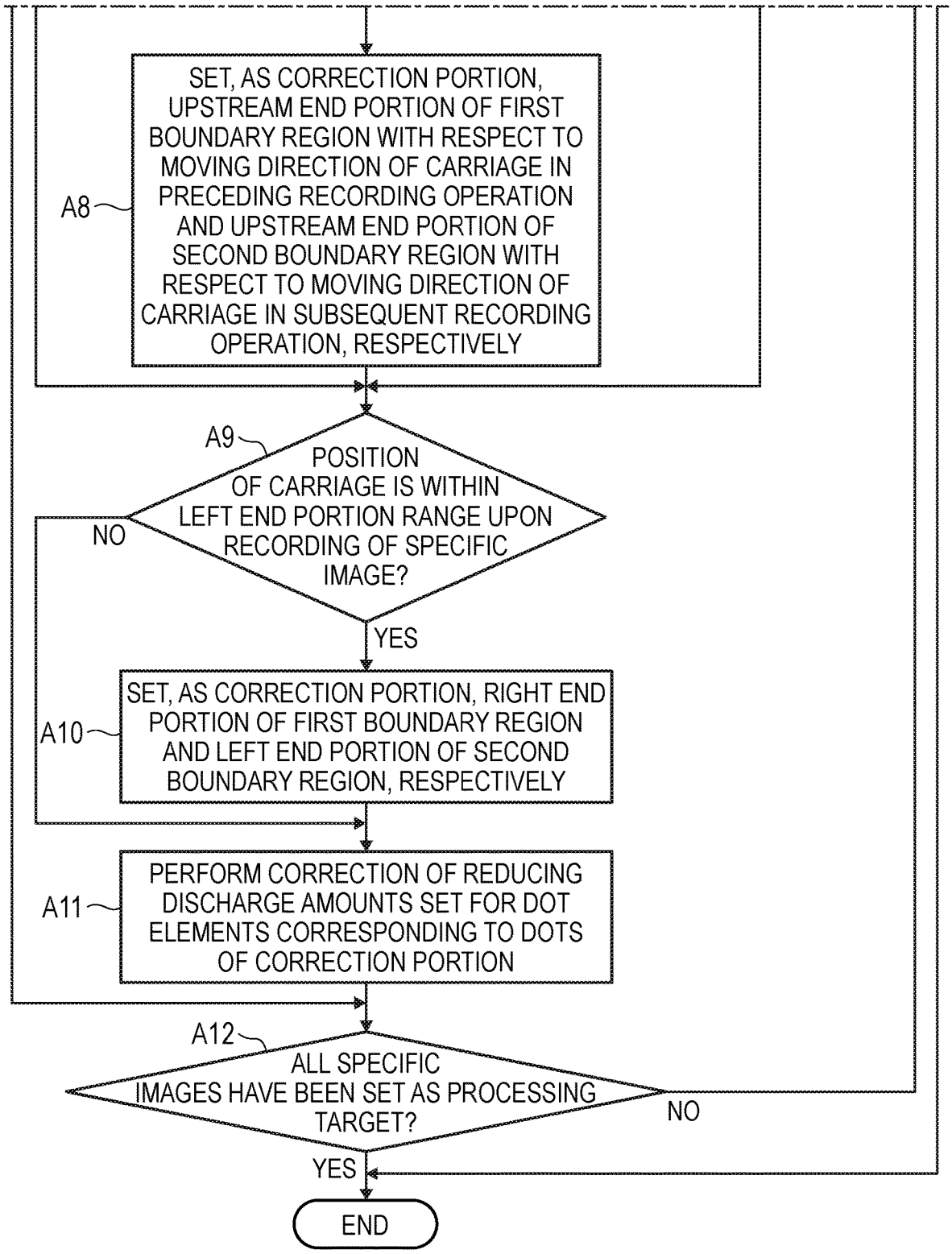

In the below, the flow of the image data correction processing is described with reference to FIGS. 12A and 12B.

The control device 50 determines whether an image to be recorded by the recording processing includes the specific image SI, based on the image data IM stored in the RAM 53 (A1). When it is determined that there is no specific image SI (A1: NO), the control device 50 ends the processing. On the other hand, when it is determined that there is the specific image SI (A1: YES), the control device 50 sets one of the specific images SI, as a specific image SI of the processing target (A2). Then, the control device 50 determines whether or not to record the specific image SI of the processing target over the boundary between the first dot formation range $K_P$ of the preceding recording operation and the second dot formation range $K_L$ of the subsequent recording operation, in the two consecutive recording operations (A3). In the meantime, it is possible to determine what recording operation the dot corresponding to each dot element E of the image data IM is formed, in correspondence to the position in the Y direction of the dot element E on the image data IM. For this reason, it is possible to determine whether or not to record the specific image SI over the boundary between the first dot formation range $K_P$ and the second dot formation range $K_L$, from the position in the Y direction of each dot element E of the specific image data ESI corresponding to the specific image SI.

When it is determined that the specific image SI of the processing target is not to be formed over the boundary between the first dot formation range $K_P$ and the second dot formation range $K_L$ (A3: NO), the control device 50 proceeds to processing of A12. On the other hand, when it is determined that the specific image SI is to be formed over the boundary (A3: YES), the control device 50 determines whether the recording mode upon recording of the image is the bidirectional recording mode or the unidirectional recording mode (A4). In the processing of A4, for example, the control device 50 performs the determination, based on a signal input together with the recording command and instructing the recording mode upon recording of the image. When it is determined that the recording is to be performed in the unidirectional recording mode (A4: NO), the control device 50 sets as, the correction portion AM, the right end portion of the first boundary region $B_P$ of the specific image SI of the processing target and the left end portion of the second boundary region $B_L$, respectively (A5). When the processing of A5 is over, the control device 50 proceeds to processing of A9.

When it is determined in the processing of A4 that the recording is to be performed in the bidirectional recording mode (A4: YES), the control device 50 sets as, the correction portion AM, the downstream end portion of the first boundary region $B_P$ of the specific image SI of the processing target with respect to the moving direction of the carriage 11 during the preceding recording operation and the downstream end portion of the second boundary region $B_L$ with respect to the moving direction of the carriage 11 during the subsequent recording operation (A6). Then, the control device 50 determines whether the recording positions of the first boundary region $B_P$ and the second boundary region $B_L$ of the specific image SI of the processing target are within the predetermined range about the convex apex Pt (A7). In the meantime, it is possible to determine at which position on the sheet S in the scanning direction the dot corresponding to each dot element E of the image data IM is to be formed, in correspondence to the position in the X direction of the dot element E on the image data IM. For this reason, it is possible to determine whether the recording positions of the first boundary region $B_P$ and the second boundary region $B_L$ are within the predetermined range about the convex apex Pt, from the positions in the X direction of the dot elements E corresponding to the dots of the first boundary region $B_P$ and the second boundary region $B_L$ of the specific image SI.

When it is determined that the recording positions of the first boundary region $B_P$ and the second boundary region $B_L$ are not within the predetermined range (A7: NO), the control device 50 proceeds to processing of A9. On the other hand, when it is determined that the recording positions of the first boundary region $B_P$ and the second boundary region $B_L$ are within the predetermined range (A7: YES), the control device 50 sets, as the correction portion AM, the upstream end portion of the first boundary region $B_P$ of the specific image SI of the processing target with respect to the moving direction of the carriage 11 during the preceding recording operation and the upstream end portion of the second boundary region $B_L$ with respect to the moving direction of the carriage 11 during the subsequent recording operation, respectively (A8). When the processing of A8 is over, the control device 50 proceeds to processing of A9.

In the processing of A9, the control device 50 determines whether the position of the carriage 11 upon recording of the specific image SI of the processing target is within the left end portion range. In the meantime, it is possible to determine the position of the carriage 11 upon formation of each dot, in correspondence to the position in the X direction of the corresponding dot element E on the image data IM. For this reason, it is possible to determine whether the position of the carriage 11 upon the recording of the specific image SI is within the left end portion range, from the position in the X direction of the corresponding dot element E of the specific image SI.

When it is determined that the position of the carriage 11 upon the recording of the specific image SI is not within the left end portion range (A9: NO), the control device 50 proceeds to processing of A11. On the other hand, when it is determined that the position of the carriage 11 upon the recording of the specific image SI is within the left end portion range (A9: YES), the control device 50 sets, as the correction portion AM, the right end portion of the first boundary region $B_P$ of the specific image SI of the processing target and the left end portion of the second boundary region $B_L$, respectively (A10). When the processing of A10 is over, the control device 50 proceeds to processing of A11.

In the processing of A11, the control device 50 performs correction of reducing the discharge amounts set for the dot elements E, which correspond to the discharged dots D placed at the correction portion AM, of the specific image data ESI of the specific image SI of the processing target from "outsize droplet" to "large droplet". When the processing of A11 is over, the control device 50 proceeds to processing of A12.

In the processing of A12, the control device 50 determines whether all the specific images SI to be recorded by the recording processing have been set as the specific image SI of the processing target. When it is determined that any one specific image SI has not been set as the specific image SI of the processing target (A12: NO), the control device 50 returns to the processing of A2 and sets one of the specific images SI, which have not been set as the specific image SI of the processing target yet, as the specific image SI of the processing target. On the other hand, when it is determined that all the specific images SI have been set as the specific image SI of the processing target (A12: YES), the control device 50 ends the processing.

As described above, according to the first embodiment, even when the step is generated in the specific image SI due to the gap difference at the upstream and downstream sides with respect to the conveyance direction, the variation in gap at the convex part of the sheet S and the posture change of the carriage 11 due to the reactive force of the supply tube 27, it is possible to reduce the size of the discharged dots D to be formed at the corner portion of the step. That is, it is possible to chamfer the corner portion of the step generated in the specific image SI. As a result, it is possible to record an image where a step in the specific image SI is inconspicuous.

Second Embodiment

A second embodiment of the present disclosure is described. A large printer or the like may be configured so that the user can mount and demount the ink cartridges 26 from a backside of the printer. Also in a printer 100 of the second embodiment, as shown in FIG. 13A, a holder 119 to which the ink cartridges 26 are detachably mounted is arranged at the rear of the carriage 11 so that the user can mount and demount the ink cartridges 26 from a backside of the printer 100.

A tube joint 128 is provided upstream of the intermediate position of the inkjet head 12 in the conveyance direction, with respect to the conveyance direction. Each of four supply tubes 127 is configured to interconnect each of the four ink cartridges 26 mounted to the holder 119 and the tube joint 128. Each of the four supply tubes 127 has a curved part 127*a* extending leftward from a connection part to the tube joint 128, bent at the left of the inkjet head 12 in the printer 100 and extending rightward. A contact member 129 configured to support the four supply tubes 127 is provided at the rear of the carriage 11. A contact surface 129*a* of the contact member 129 is in contact with the four supply tubes 127 in a state where it is located in the left end portion range of the moveable range of the carriage 11. At this time, the supply tube 127 is applied with the reactive force from the contact surface 129*a*, thereby pressing rightward the tube joint 128.

In the above configuration, in the state where the carriage 11 is located in the left end portion range, the carriage 11 is slightly rotated so that the upstream nozzles 10 of the nozzle rows 9 with respect to the conveyance direction are to be moved rightward and the downstream nozzles 10 are to be moved leftward. As a result, in the state where the carriage 11 is located in the left end portion range, regarding the respective formation positions of the discharged dots D, which are to be formed by the inks discharged from the respective nozzles 10 of the nozzle rows 9 within the same discharge period, the downstream discharged dots D with respect to the conveyance direction are located more leftward with respect to the scanning direction, in each of the recording operations.

Therefore, in the second embodiment, as countermeasures against the step in the specific image SI, which is caused due to the posture change of the carriage 11, the control device 50 corrects the specific image data ESI in the image data correction processing, as follows. That is, as shown in FIG. 13B, when the position of the carriage 11 upon the recording of the specific image SI is within the left end portion range, the control device 50 sets, as the correction portion AM, a left end portion of the first boundary region $B_P$ and a right end portion of the second boundary region $B_L$, respectively. Then, the control device 50 corrects the discharge amounts set for the dot elements E, which correspond to the discharged dot D placed at the correction portion AM, of the specific image data ESI from "outsize droplet" to "large droplet". By the correction, even when the step is generated in the specific image SI due to the posture change of the carriage 11, it is possible to record an image where a step in the image is inconspicuous.

In the second embodiment, as shown in FIG. 14A, a platen 115 is swingably supported to a swing shaft 115*a* provided at a downstream end portion with respect to the conveyance direction and extending in the scanning direction and is urged by a spring or the like (not shown), so that it is located at the position shown with the solid line in FIG. 14A in a state where the sheet S has not been conveyed thereto yet. The platen 115 is pressed downward due to the sheet S pressed by the plates 14, so that the platen swings about the swing shaft 115*a*, as shown with the dashed-dotted line in FIG. 14A. At this time, the platen 115 more swings when the sheet S has a larger thickness. In the second embodiment, the nozzle 10, which is located most downstream of the nozzle row 9 with respect to the conveyance direction, is set as a reference nozzle. The discharge timings of the inks are set so that positions of the dot row, which is to be formed by the inks discharged from the reference nozzles in each of the recording operations, are the same in the scanning direction. For this reason, in the case of the bidirectional recording mode, as shown in FIG. 14B, the second boundary region $B_L$ entirely deviates relative to the first boundary region $B_P$ toward the downstream side with respect to the moving direction of the carriage 11 in the subsequent recording operation.

Therefore, as countermeasures against the step in the specific image SI, which is caused due to the gap difference at the upstream and downstream sides with respect to the conveyance direction, the control device 50 corrects the specific image data ESI in the image data correction processing, as follows. That is, in the case of the bidirectional recording mode, as shown in FIG. 14B, the control device 50 sets, as the correction portion AM, a downstream end portion of the first boundary region $B_P$ with respect to the moving direction of the carriage 11 during the preceding recording operation and a downstream end portion of the second boundary region $B_L$ with respect to the moving direction of the carriage 11 during the subsequent recording operation, respectively. Then, the control device 50 performs correction of changing the discharge amounts set for the dot elements E, which correspond to the discharged dots D placed at the correction portion AM, of the specific image data ESI from "outsize droplet" to "large droplet".

In the meantime, as shown in FIG. 14C, in the case of the unidirectional recording mode, the control device 50 sets, as the correction portion AM, an upstream end portion (left end portion) of the first boundary region $B_P$ with respect to the RVS direction and a downstream end portion (right end portion) of the second boundary region $B_L$ with respect to the RVS direction, respectively.

Figure 15A:
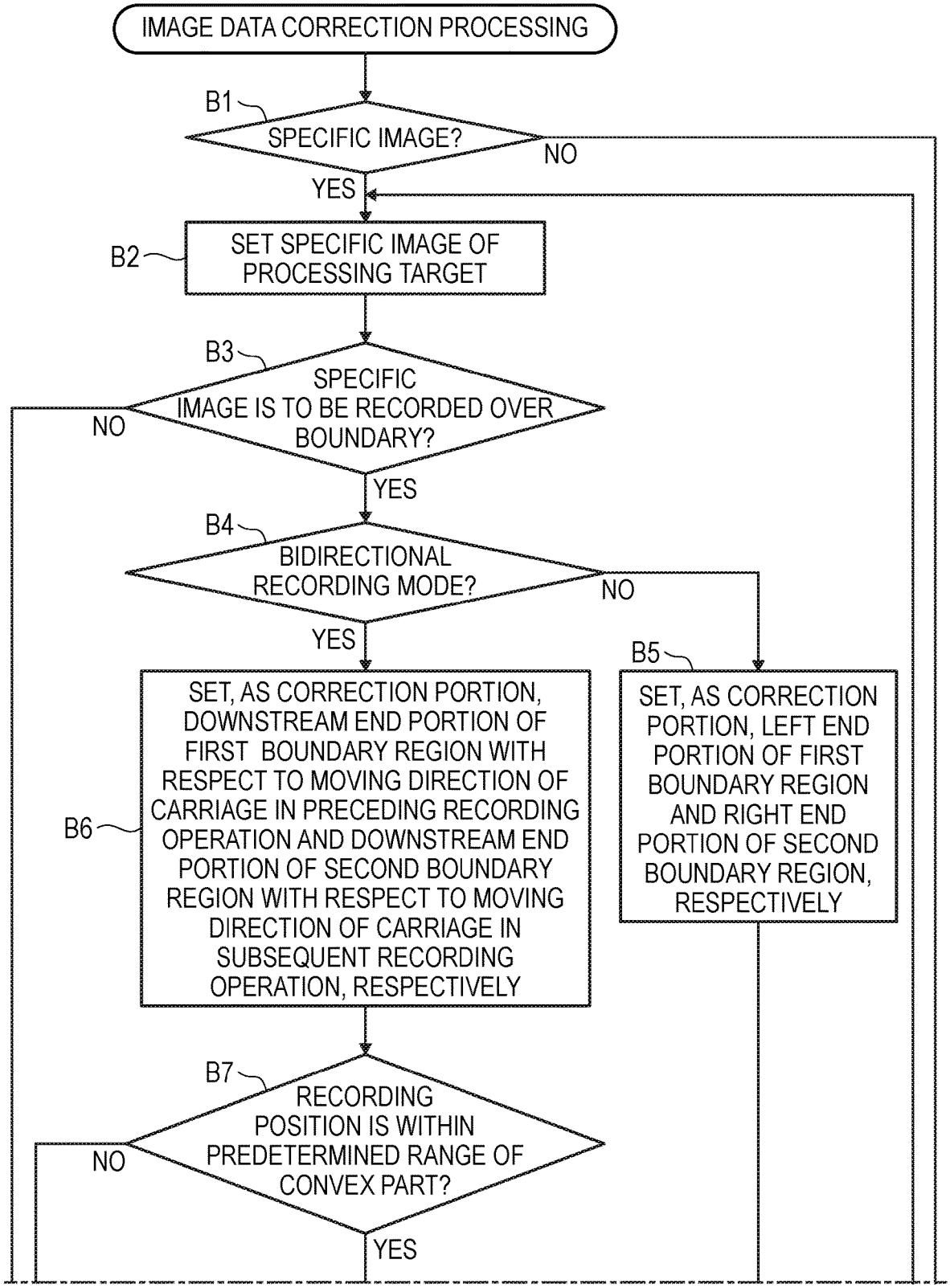
FIGS. 15A and 15B are flowcharts of image data correction processing of the second embodiment.
Figure 15B:
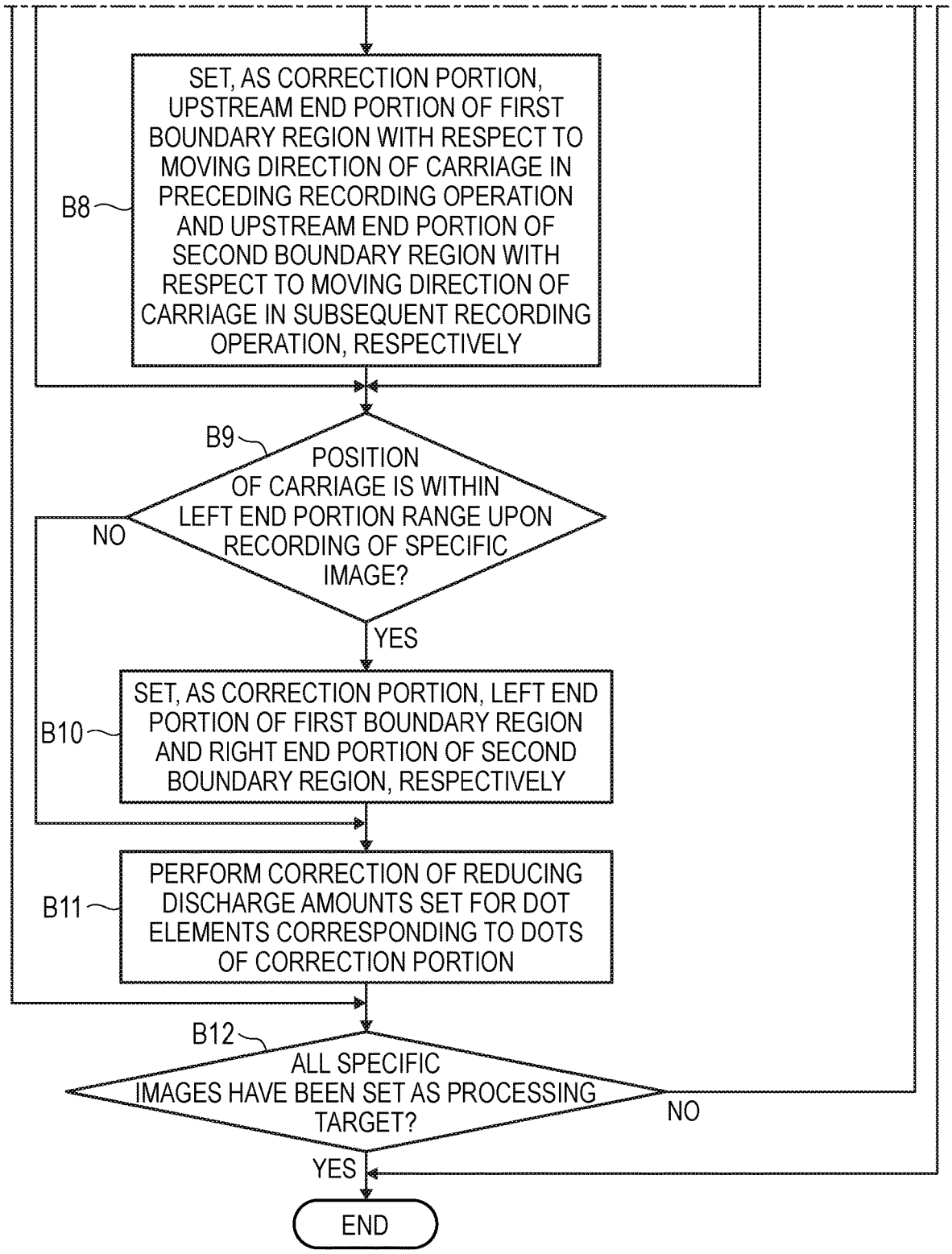

In the below, a flow of the image data correction processing is described with reference to FIGS. 15A and 15B.

First, the control device 50 executes the same processing of B1 to B4 as the processing of A1 to A4. When it is determined in the processing of B4 that the recording is to be executed in the unidirectional recording mode (B4: NO), the control device 50 sets, as the correction portion AM, the left end portion of the first boundary region $B_P$ of the specific image SI of the processing target and the right end portion of the second boundary region $B_L$, respectively (B5). When the processing of B5 is over, the control device 50 proceeds to processing of B9.

When it is determined in the processing of B4 that the recording is to be executed in the bidirectional recording mode (B4: YES), the control device 50 sets, as the correction portion AM, the downstream end portion of the first boundary region $B_P$ of the specific image SI of the processing target with respect to the moving direction of the carriage 11 during the preceding recording operation and the downstream end portion of the second boundary region $B_L$ with respect to the moving direction of the carriage 11 during the subsequent recording operation, respectively (B6). Then, the control device 50 executes the same processing of B7 and B8 as the processing of A7 and A8, and proceeds to the processing of B9.

In the processing of B9, the control device 50 determines whether the position of the carriage 11 upon recording of the specific image SI of the processing target is within the left end portion range. When it is determined that the position of the carriage 11 upon the recording of the specific image SI is not within the left end portion range (B9: NO), the control device 50 proceeds to processing of B11. On the other hand, when it is determined that the position of the carriage 11 upon the recording of the specific image SI is within the left end portion range (B9: YES), the control device 50 sets, as the correction portion AM, the left end portion of the first boundary region $B_P$ of the specific image SI of the processing target and the right end portion of the second boundary region $B_L$, respectively (B10). When the processing of B10 is over, the control device 50 proceeds to processing of B11.

Then, the control device 50 executes the same processing of B11 and B12 as the processing of A11 and A12.

Also in the second embodiment, even when the step is generated in the specific image SI due to the gap difference at the upstream and downstream sides with respect to the conveyance direction, the variation in gap at the convex part of the sheet S and the posture change of the carriage 11 caused due to the reactive force of the supply tube 127, it is possible to reduce the size of the discharged dots D to be formed at the corner portion of the step. That is, it is possible to chamfer the corner portion of the step generated in the specific image SI. As a result, it is possible to record an image where a step in the specific image SI is inconspicuous.

Third Embodiment

A third embodiment is described. In the third embodiment, the control device 50 executes countermeasures against the step in the specific image SI, which is caused due to an air stream generated in the printer 1, in the image data correction processing. In the below, it is assumed that the step is not generated in the specific image SI due to the other factors except the air stream.

Figure 16A:
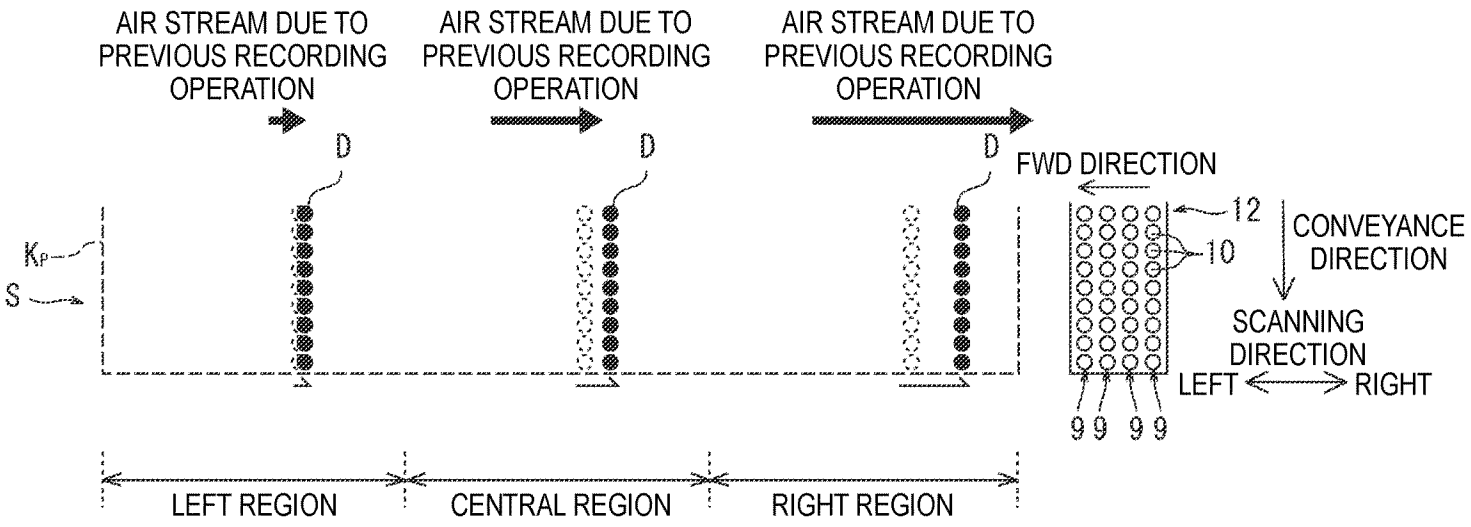
FIG. 16A illustrates deviation of a spotting position of ink due to an air stream.

First, the air stream that is generated in the printer 1 is described. When the carriage 11 is moved in the scanning direction, the air stream flowing in the moving direction of the carriage 11 is generated in the printer 1, in association with the movement of the carriage 11. The air stream remains for a while even when the movement of the carriage 11 is over. For this reason, just before the Nth (N: a positive integer) recording operation, when the carriage 11 is moved in a direction different from the moving direction of the carriage 11 in the Nth recording operation, the air stream flowing in an opposite direction to the moving direction of the carriage 11 remains when performing the Nth recording operation. As a result, as shown in FIG. 16A, the formation positions of the dots formed by the Nth recording operation deviate upward from the ideal formation positions (shown with the dotted line) with respect to the moving direction of the carriage 11 due to the air stream. The magnitude of the air stream decreases over time. For this reason, the deviation amount of the formation position of the dot to be formed by the Nth recording operation from the ideal formation position increases at the upstream side with respect to the moving direction of the carriage 11 in the Nth recording operation.

Here, in the unidirectional recording mode, the return operation is performed between the two consecutive recording operations. For this reason, when performing the second recording operation and thereafter, the air stream generated by the return operation remains. Therefore, the formation position of the dot to be formed by each recording operation after the second recording operation and thereafter deviates upward from the ideal formation position with respect to the moving direction of the carriage 11 due to the air stream. However, in the unidirectional recording mode, since the moving direction of the carriage 11 in each recording operation is always the RVS direction, the formation position of the dot to be formed by each recording operation uniformly deviates leftward from the ideal formation position. As a result, in the unidirectional recording mode, a possibility that the first boundary region $B_P$ of the specific image SI will deviate relative to the second boundary region $B_L$ due to the influence of the air stream is low.

Figure 16B:
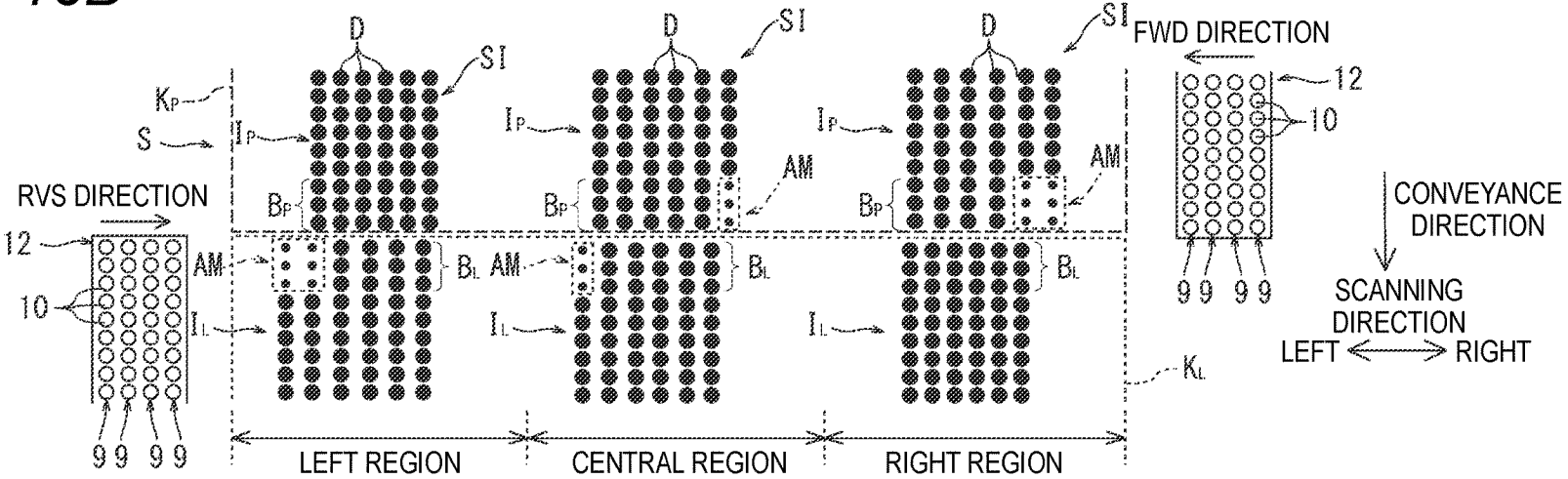
FIG. 16B depicts a specific image when the image data is corrected in the bidirectional recording mode, in a third embodiment.

On the other hand, in the bidirectional recording mode, the moving direction of the carriage 11 during the preceding recording operation of the two consecutive recording operations and the moving direction of the carriage 11 during the subsequent recording operation are different from each other. For this reason, the deviation directions of the formation positions of the dots formed in each of the two consecutive recording operations from the ideal formation position are different from each other. As a result, as shown in FIG. 16B, in the bidirectional recording mode, a possibility that the first boundary region $B_P$ of the specific image SI will deviate relative to the second boundary region $B_L$ due to the influence of the air stream is high.

In the third embodiment, as countermeasures against the step in the specific image SI caused due to the air stream, the control device 50 corrects the specific image data ESI in the image data correction processing, as follows. That is, when the recording mode of the recording processing is the bidirectional recording mode, the control device 50 sets, as the correction portion AM, the upstream end portion of the first boundary region $B_P$ with respect to the moving direction of the carriage 11 during the preceding recording operation and the upstream end portion of the second boundary region $B_L$ with respect to the moving direction of the carriage 11 during the subsequent recording operation. In the meantime, in the case where the carriage 11 just before the first recording operation does not move in a direction different from the moving direction of the carriage 11 in the first recording operation, the air stream is not generated and the formation position of each dot in the first boundary region $B_P$ is recorded at the ideal formation position when performing the first recording operation. Therefore, in the case where the first boundary region $B_P$ is recorded by the first recording operation, when the carriage 11 does not move just before the first recording operation, the end portion of the first boundary region $B_P$ is not set as the correction portion AM. In the below, for convenience of descriptions, it is assumed that the carriage has moved in a direction different from the moving direction of the carriage 11 in the first recording operation, just before the first recording operation.

Here, as described above, the deviation amount of the formation position of the dot from the ideal formation position due to the influence of the air stream increases toward the upstream side of the moving direction of the carriage 11 in the recording operation. Therefore, when the recording position of the first boundary region $B_P$ is located upstream of the moving direction of the carriage 11 of the recording operation upon the recording of the first boundary region $B_P$, the control device 50 increases an area of the correction portion AM. Likewise, when the recording position of the second boundary region $B_L$ is located upstream of the moving direction of the carriage 11 of the recording operation upon the recording of the second boundary region $B_L$, the control device 50 increases an area of the correction portion AM. Thereby, it is possible to record an image where a step in the specific image SI is inconspicuous.

Specifically, in the third embodiment, the magnitude set as the area of the correction portion AM includes three levels of "large area", "small area" and "zero". In the case of the correction portion AM of which the magnitude of the area is "large area", a length in the scanning direction is a length for two dots, and a length in the conveyance direction is a length for three dots. In the case of the correction portion AM of which the magnitude of the area is "small area", a length in the scanning direction is a length of one dot-part, and a length in the conveyance direction is a length for three dots. In the case of the correction portion AM of which the magnitude of the area is "zero", a length in in the scanning direction and a length in the conveyance direction are all zero. That is, for end portions in the scanning direction, to which the correction portion AM having the area of "zero" is set, of the first boundary region $B_P$ and the second boundary region $B_L$, the correction of reducing the size of the discharged dot D is not performed.

In the third embodiment, the sheet S is divided into three regions of a left region, a central region and a right region in the scanning direction. As shown in FIG. 16B, the control device 50 sets the area of the correction portion AM set in the boundary region, which is to be recorded by the recording operation in which the moving direction of the carriage 11 is the RVS direction, of the first boundary region $B_P$ and the second boundary region $B_L$ to "large area" when the recording position is in the left region, to "small area" when the recording position is in the central region, and to "zero" when the recording position is in the right region. On the other hand, the control device 50 sets the area of the correction portion AM set in the boundary region, which is to be recorded by the recording operation in which the moving direction of the carriage 11 is the FWD direction, of the first boundary region $B_P$ and the second boundary region $B_L$ to "large area" when the recording position is in the right region, to "small area" when the recording position is in the central region, and to "zero" when the recording position is in the left region.

Figure 17A:
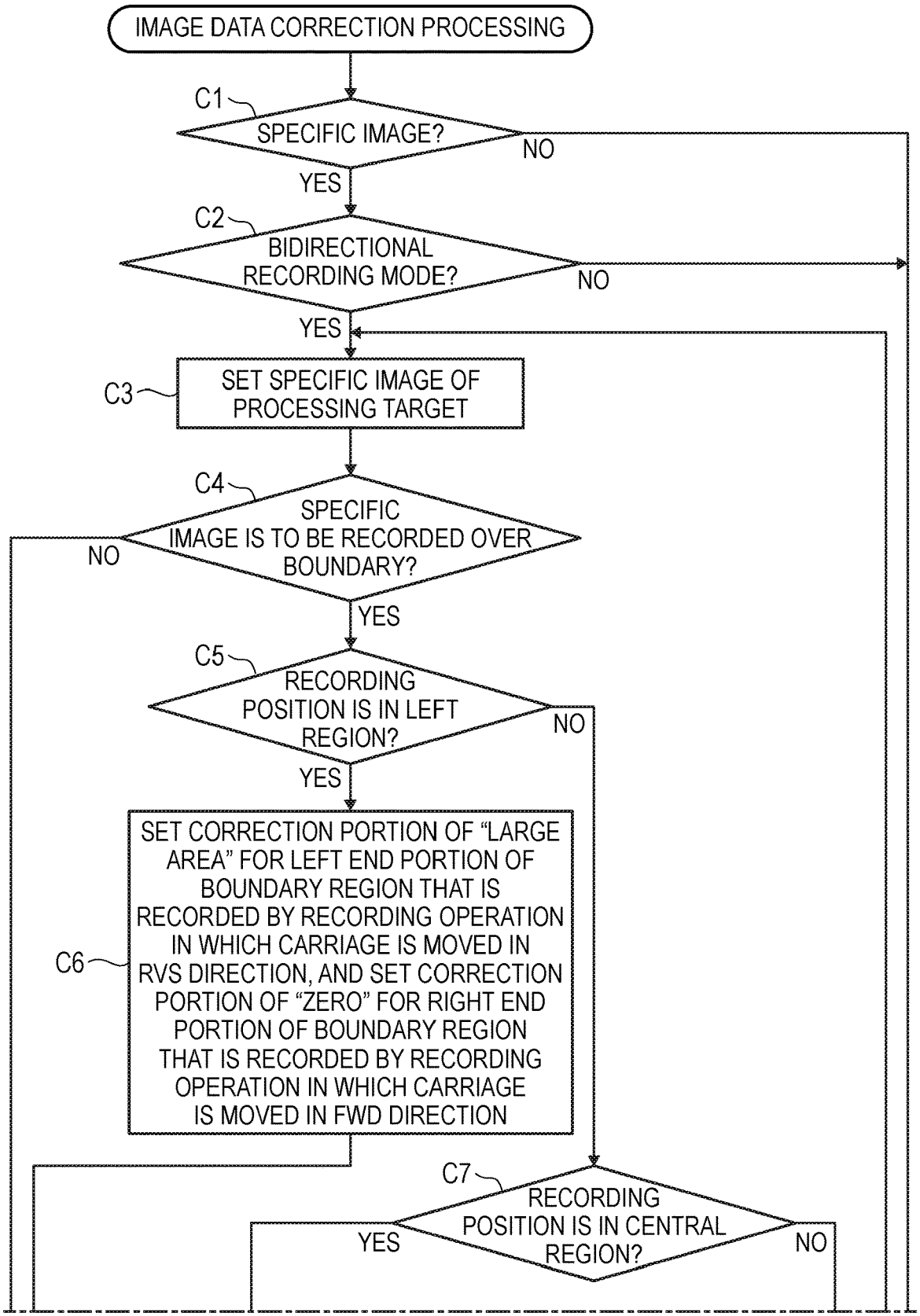
FIGS. 17A and 17B are flowcharts of image data correction processing of the third embodiment.
Figure 17B:
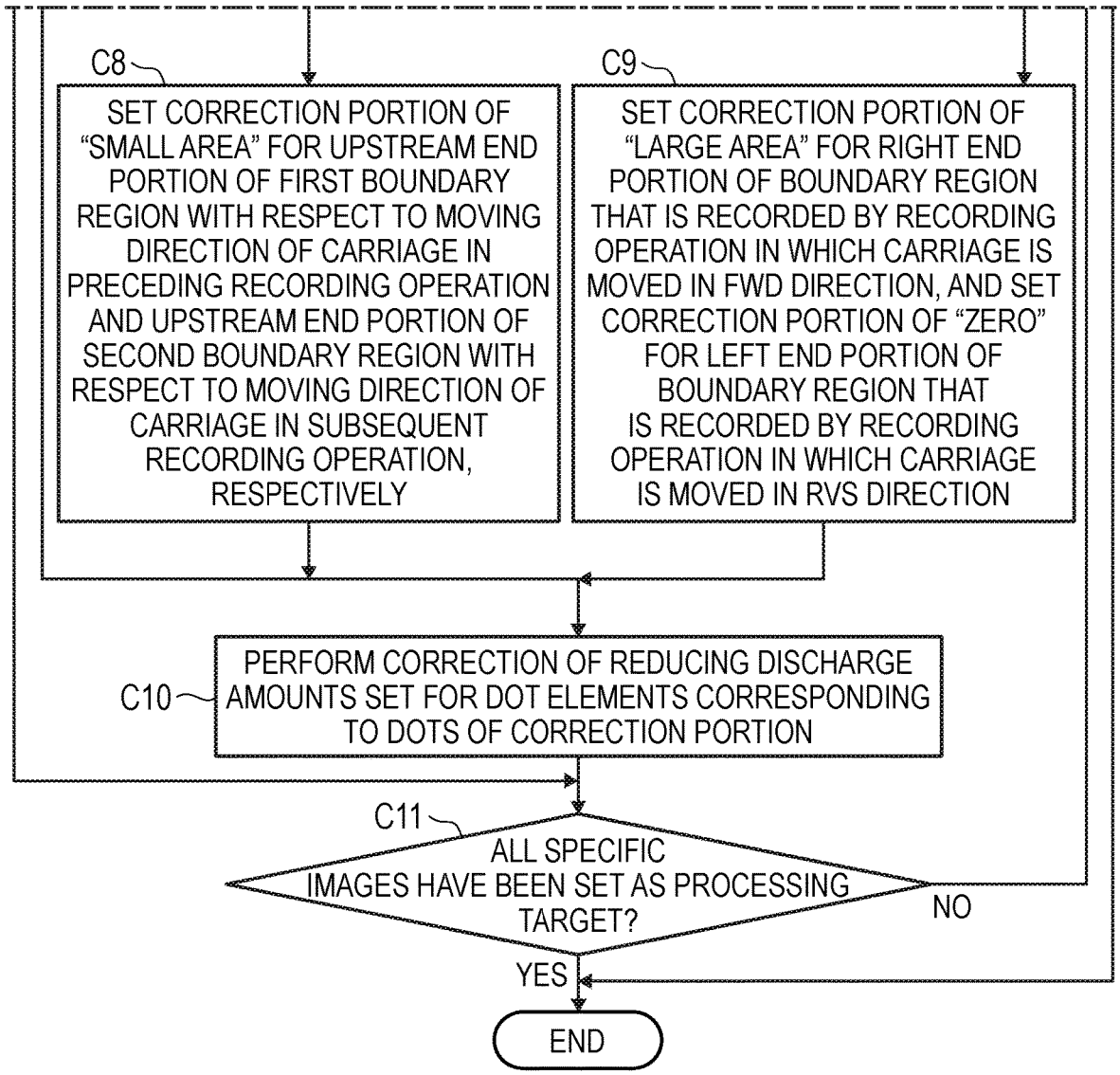

On the other hand, when the recording mode of the recording processing is the unidirectional recording mode, the control device 50 does not correct the specific image data ESI in the image data correction processing. In the below, a flow of the image data correction processing of the third embodiment is described with reference to FIGS. 17A and 17B.

The control device 50 executes the same processing of C1 as the processing of A1. When it is determined in the processing of C1 that there is the specific image SI (C1: YES), the control device 50 determines whether the recording mode upon recording the image is the bidirectional recording mode or the unidirectional recording mode (C2). When it is determined that the recording mode is the unidirectional recording mode (C2: NO), the control device 50 ends the processing. On the other hand, when it is determined that the recording mode is the bidirectional recording mode (C2: YES), the control device 50 executes the same processing of C3 and C4 as the processing of A2 and A3.

When it is determined in the processing of C4 that the specific image SI of the processing target is to be recorded over the boundary between the first dot formation range $K_P$ and the second dot formation range $K_L$ (C4: YES), the control device 50 determines whether the recording positions of the first boundary region $B_P$ and the second boundary region $B_L$ of the specific image SI of the processing target are in the left region on the sheet S (C5). When it is determined that the recording positions are in the left region on the sheet S (C5: YES), the control device 50 sets the correction portion AM having the magnitude of the area of "large area" for the left end portion of the boundary region, which is to be recorded by the recording operation in which the moving direction of the carriage 11 is the RVS direction, of the first boundary region $B_P$ and the second boundary region $B_L$, and sets the correction portion AM having the magnitude of the area of "zero" for the right end portion of the boundary region, which is to be recorded by the recording operation in which the moving direction of the carriage 11 is the FWD direction (C6). When the processing of C6 is over, the control device 50 proceeds to processing of C10.

When it is determined in the processing of C5 that the recording positions of the first boundary region $B_P$ and the second boundary region $B_L$ are not in the left region on the sheet S (C5: NO), the control device 50 determines whether the recording positions are in the central region or in the right region (C7). When it is determined that the recording positions are in the central region on the sheet S (C7: YES), the control device 50 sets the correction portion AM having the magnitude of the area of "small area" for each of the upstream end portion of the first boundary region $B_P$ with respect to the moving direction of the carriage 11 during the preceding recording operation and the upstream end portion of the second boundary region $B_L$ with respect to the moving direction of the carriage 11 during the subsequent recording operation (C8). When the processing of C8 is over, the control device 50 proceeds to processing of C10.

When it is determined in the processing of C7 that the recording positions of the first boundary region $B_P$ and the second boundary region $B_L$ are in the right region on the sheet S (C7: NO), the control device 50 sets the correction portion AM having the magnitude of the area of "large area" for the right end portion of the boundary region, which is to be recorded by the recording operation in which the moving direction of the carriage 11 is the FWD direction, of the first boundary region $B_P$ and the second boundary region $B_L$, and sets the correction portion AM having the magnitude of the area of "zero" for the left end portion of the boundary region, which is to be recorded by the recording operation in which the moving direction of the carriage 11 is the RVS direction (C9). When the processing of C9 is over, the control device 50 proceeds to processing of C10.

Then, the control device 50 executes the same processing of C10 and C11 as the processing of A11 and A12.

As described above, according to the third embodiment, even when the step is generated in the specific image SI due to the air stream, it is possible to reduce the size of the discharged dots D to be formed at the corner portion of the step. That is, it is possible to chamfer the corner portion of the step generated in the specific image SI. As a result, it is possible to record an image where a step in the specific image SI is inconspicuous. In a modified embodiment, the areas of the respective correction portions AM may be the same. In this case, it is possible to simplify the processing contents of the image data correction processing.

Fourth Embodiment

A fourth embodiment is described. As described above, when recording the specific image SI over the boundary between the first dot formation range $K_P$ and the second dot formation range $K_L$, the first boundary region $B_P$ of the specific image SI deviates relative to the second boundary region $B_L$ in the scanning direction due to the diverse factors. However, at this time, the deviation direction is different depending on the factors. For this reason, when the plurality of factors is premised as the factor due to which the first boundary region $B_P$ deviates relative to the second boundary region $B_L$ in the scanning direction, it may not possible to determine in advance in which side of the scanning direction the first boundary region $B_P$ deviates relative to the second boundary region $B_L$.

Figure 18:
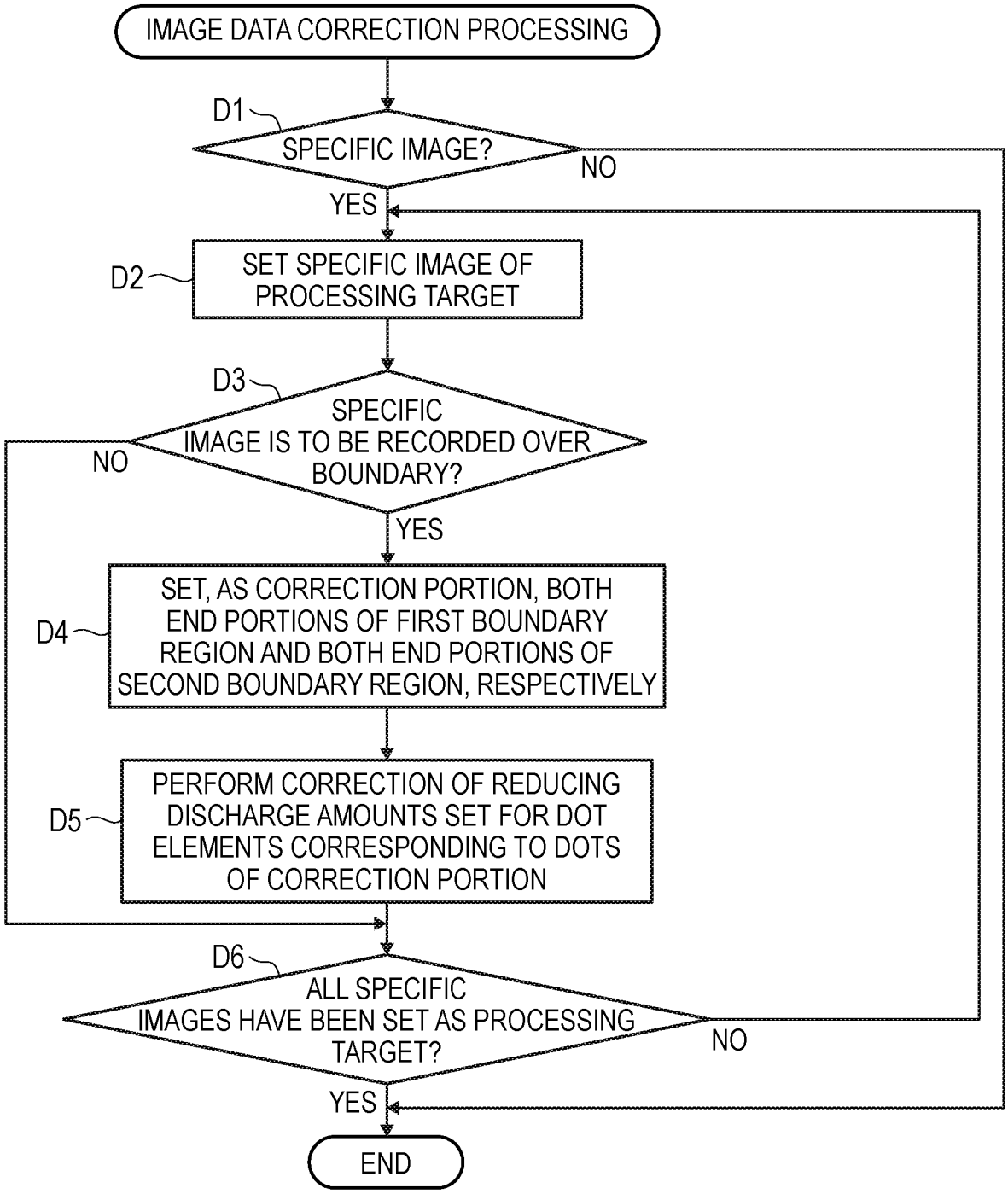
FIG. 18 is a flowchart of image data correction processing of a fourth embodiment.

Therefore, in the fourth embodiment, the control device 50 executes processing of making it difficult for the step generated in the specific image SI to be conspicuous when the first boundary region $B_P$ of the specific image SI deviates relative to the second boundary region $B_L$ in any side of the scanning direction. That is, when recording the specific image SI over the boundary between the first dot formation range $K_P$ and the second dot formation range $K_L$, the control device 50 sets, as the correction portion AM, both end portions of the first boundary region $B_P$ in the scanning direction and both end portions of the second boundary region $B_L$ in the scanning direction, respectively. In the below, a flow of the image data correction processing of the fourth embodiment is described with reference to FIG. 18.

First, the control device 50 executes the same processing of D1 to D3 as the processing of A1 to A3. When it is determined in the processing of D3 that the specific image SI of the processing target is to be recorded over the boundary between the first dot formation range $K_P$ and the second dot formation range $K_L$ (D3: YES), the control device 50 sets, as the correction portion AM, both end portions in the scanning direction of the first boundary region $B_P$ of the specific image SI of the processing target and both end portions of the second boundary region $B_L$ in the scanning direction, respectively (D4). Then, the control device 50 executes the same processing of D5 and D6 as the processing of A11 and A12.

According to the fourth embodiment, when the first boundary region $B_P$ of the specific image SI deviates relative to the second boundary region $B_L$ in any side of the scanning direction, it is possible to record an image where a step in the specific image SI is inconspicuous. In addition to this, it is possible to simplify the processing contents of the image data correction processing.

Fifth Embodiment

A fifth embodiment is described. In the fifth embodiment, as shown in FIG. 19A, the sheet S is conveyed by a length shorter than the length Ln of the nozzle row 9 so that the first dot formation range $K_P$ of the preceding recording operation and the second dot formation range $K_L$ of the subsequent recording operation partially overlap each other in the conveyance operation to be executed between the two consecutive recording operations. The control device 50 is configured to record an image in a mutual complementary manner by the two recording operations in an overlap region F where the first dot formation range $K_P$ and the second dot formation range $K_L$ overlap each other. That is, in the overlap region F, the line image of one line-part consisting of the plurality of dots in the scanning direction is recorded in a so-called multi scan manner of recording the image by the two consecutive recording operations. At this time, in the respective two recording operations, the different nozzles 10 are used and a thinned image in which some different portions of the line image are thinned out on the basis of mask data is recorded.

Specifically, in the preceding recording operation, a thinned image is recorded, based on image data in which image data $IM_P$ (refer to FIG. 20), which corresponds to the first dot formation range $K_P$ of the preceding recording operation, of the image data IM, is thinned out by first mask data. In the subsequent recording operation, a thinned image is recorded, based on image data in which image data $IM_L$ (refer to FIG. 20), which corresponds to the second dot formation range $K_L$ of the subsequent recording operation, of the image data IM is thinned out by second mask data having a complementary relation with the first mask data. Thereby, in the overlap region F, the thinned images recorded in each of the two consecutive recording operations overlap each other to complete the line image. In this way, in the overlap region F, the image is recorded in the multi scan manner, so that it is possible to prevent the image quality degradation such as a white stripe extending in the scanning direction and density unevenness from being generated in a connecting region of the images of the two consecutive recording operations due to inequality of a conveyance amount of the sheet S and the like.

However, also in the fifth embodiment, as shown in FIG. 19B, when recording the specific image SI over the overlap region F, a step may be generated in the specific image SI due to the diverse factors. Therefore, in the fifth embodiment, as shown in FIG. 19C, both end portions in the scanning direction of an image region IF, which is to be recorded in the overlap region F, of the specific image SI are set as the correction portion FM. A length of the correction portion FM in the conveyance direction is the same as a length of the overlap region F in the conveyance direction. In the meantime, in FIGS. 19B and 19C, for convenience sake, the discharged dots D formed by the preceding recording operation are shown with the black circles and the discharged dots D formed by the subsequent recording operation are shown with the white circles.

In the fifth embodiment, in order to record an image where a step in the image is inconspicuous, when forming the discharged dots D in the preceding recording operation and when forming the discharged dots D in the subsequent recording operation, the magnitude of the area of the correction portion FM is not changed but the shape thereof is slightly changed. That is, as can also be seen from FIG. 20, in the preceding recording operation, the length of the correction portion FM in the scanning direction increases toward the downstream side with respect to the conveyance direction. On the other hand, in the subsequent recording operation, the length of the correction portion FM in the scanning direction increases toward the upstream side with respect to the conveyance direction. In the meantime, in FIG. 20, the dot elements E corresponding to the dots placed at the correction portion FM and a correction portion OM (which will be described later) are all hatched.

In addition to this, a correction portion OM is set in an image region $I_{OP}$, which is to be recorded in a non-overlap region except the overlap region F of the first dot formation range $K_P$, of the specific image SI and in an image region $I_{OL}$, which is to be recorded in a non-overlap region except the overlap region F of the second dot formation range $K_L$, too. Specifically, both end portions in the scanning direction of a boundary region $B_{OP}$, which is adjacent to the overlap region F, in the image region $I_{OP}$ are set as the correction portion OM. Both end portions in the scanning direction of a boundary region $B_{OL}$, which is adjacent to the overlap region F, in the image region $I_{OL}$ are set as the correction portion OM. An area of the correction portion OM is smaller than the area of the correction portion FM.

Figure 20:
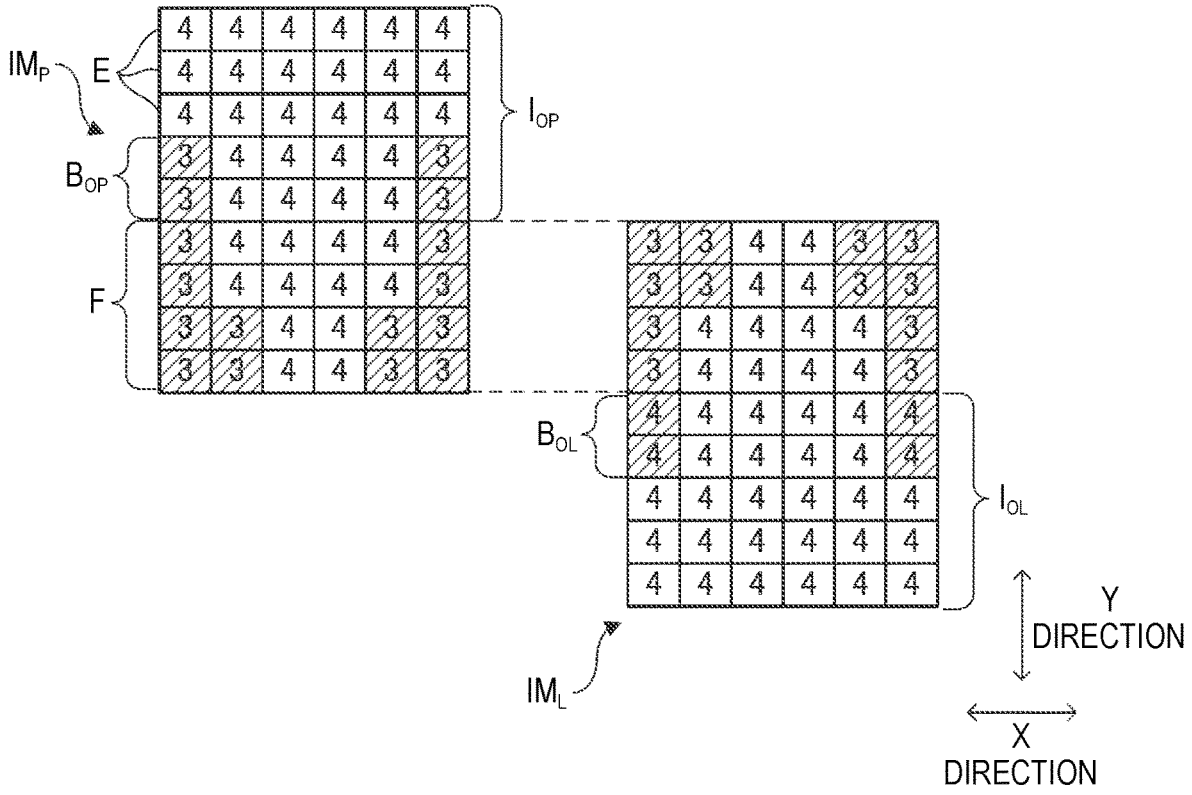
FIG. 20 depicts the image data correction processing of the fifth embodiment.

As shown in FIG. 20, the control device 50 performs correction of changing the discharge amounts set for the dot elements E, which correspond to the discharged dots D placed at the correction portion FM and the correction portion OM, of the specific image data ESI from "outsize droplet" to "large droplet".

By the above configuration, also in the fifth embodiment, even when the step is generated in the specific image SI, it is possible to reduce the size of the discharged dots D to be formed at the corner portion of the step. That is, it is possible to chamfer the corner portion of the step generated in the specific image SI. As a result, it is possible to record an image where a step in the specific image SI is inconspicuous.

Sixth Embodiment

A sixth embodiment is described. The printer of the first to fifth embodiments is a so-called serial type printer configured to record the image on the sheet S while moving the carriage 11 having the inkjet head 12 mounted thereto in the scanning direction intersecting with the conveyance direction of the printer. However, a printer 200 of the sixth embodiment is a line type printer configured to record the image on the sheet S, which is to be conveyed by a conveyance device 201, in a state where inkjet heads 222 are stationary.

As shown in FIG. 21A, the printer 200 includes a conveyance device 201, a recording head unit 220, and a control device 250. The conveyance device 201 includes two conveyance rollers 202, 203, and a platen 204.

The platen 204 is configured to support on its upper surface the sheet S that is to be conveyed by the two conveyance rollers 202, 203. The two conveyance rollers 202, 203 are respectively arranged at a rear side and a front side of the platen 204. The two conveyance rollers 202, 203 are configured to be driven by a conveyance motor (not shown), thereby conveying the sheet S on the platen 204 in the conveyance direction perpendicular to the right and left direction.

The recording head unit 220 is arranged above the platen 204. In the recording head unit 220, the inks of four colors (black, yellow, cyan and magenta) are supplied from ink cartridges (not shown). The recording head unit 220 includes two inkjet heads 222 arranged in the right and left direction. The two inkjet heads 222 are respectively supported to a support member 223.

The left inkjet head 222 of the two inkjet heads 222 is arranged at the rear side in the conveyance direction, and the right inkjet head 222 is arranged at the front side. The two inkjet heads 222 (more specifically, central positions thereof in the right and left direction) are arranged at different positions in the right and left direction. In addition, each of the two inkjet heads 222 is arranged so that arrangement regions 222*a* having nozzles 210 arranged therein do not overlap each other in the conveyance direction. That is, the arrangement regions 222*a* of the two inkjet heads 222 are arranged at different positions in the right and left direction.

Each of the two inkjet heads 222 has substantially the same structure as the inkjet head 12. One inkjet head 222 has a lower ink discharge surface in which the plurality of nozzles 210 is formed. More specifically, four nozzle rows 229 in each of which the plurality of nozzles 210 is arranged in the right and left direction are formed. The four nozzle rows 229 are arranged in the conveyance direction. From the plurality of nozzles 210, the inks of black, yellow, cyan and magenta are discharged in order of the nozzle row 229 located at a downstream side with respect to the conveyance direction.

The control device 250 has substantially the same configuration as the control device 50, and includes a RAM in which the image data IM is stored, and the like. The control device 250 is configured to discharge the inks from the nozzles 210 of the two inkjet heads 222 and to thereby form dots on the sheet S while conveying forward the sheet S with the conveyance device 201, in the recording processing of recording an image relating to the image data IM on the sheet S.

In the meantime, in the sixth embodiment, as described above, the arrangement regions 222*a* of the two inkjet heads 222 do not overlap each other in the conveyance direction. For this reason, as shown in FIG. 21B, a dot formation range K1 where dots are formed by the left inkjet head 222 and a dot formation range K2 where dots are formed by the right inkjet head 222 are adjacent to each other in the right and left direction without overlapping each other on the sheet S.

In the above configuration, when recording a specific image LI over a boundary between the dot formation range K1 and the dot formation range K2, a step may be generated in the specific image LI due to a difference of ink discharge characteristics, deviation of mounting positions and the like between the two inkjet heads 222. That is, a step is generated between an image region I1 that is recorded in the dot formation range K1 of the specific image LI and an image region I2 that is recorded in the dot formation range K2 of the specific image LI. More specifically, a boundary region B1 in the image region I1, which is adjacent to the dot formation range K2, entirely deviates in the conveyance direction relative to a boundary region B2 in the image region I2, which is adjacent to the dot formation range K1. In the meantime, the specific image LI is an image consisting of a plurality of discharged dots D and having widths for a plurality of dots in the conveyance direction and in the right and left direction. As the specific image LI, a ruled line sandwiched by not-discharged dots from both sides in the conveyance direction, having a width for a plurality of dots (for example, six dots) in the conveyance direction and extending in the right and left direction may be exemplified. A length of the boundary region B1 in the right and left direction is shorter than a length of the dot formation range K1. Likewise, a length of the boundary region B2 in the right and left direction is shorter than a length of the dot formation range K2 in the right and left direction.

As countermeasures against the step in the specific image LI, the control device 250 performs image data correction processing of correcting the image data IM. In the meantime, in the first to fourth embodiments, the step in the image that is to be generated in the connecting region of the dot formation ranges of the two consecutive recording operations is problematic, and in the sixth embodiment, the step in the image that is to be generated in the connecting region of the dot formation ranges of the two inkjet heads is problematic. That is, the steps in the image to be targeted are different. However, the countermeasures against the steps are basically the same.

In the sixth embodiment, the control device 250 sets, as a correction portion GM, both end portions of the boundary region B1 in the conveyance direction and both end portions of the boundary region B2 in the conveyance direction so as to make it difficult for the step in the specific image LI to be conspicuous when the boundary region B1 deviates upstream or downstream relative to the boundary region B2 with respect to the conveyance direction, as shown in FIG. 21C. A length of the correction portion GM in the conveyance direction is shorter than a length in the right and left direction. The control device 250 performs correction of reducing the discharge amounts set for the dot elements E, which correspond to the discharged dots D placed at the correction portion GM, of the image data IM.

When an image is recorded on the sheet S in accordance with the image data IM corrected as described above, even though a step is generated in the specific image LI, it is possible to reduce the size of the discharged dots D to be formed at the corner portion of the step. That is, it is possible to chamfer the corner portion of the step generated in the specific image LI. As a result, it is possible to record an image where a step in the specific image LI is inconspicuous.

Seventh Embodiment

A seventh embodiment is described. A printer 300 of the seventh embodiment is a line type printer, like the printer 200 of the sixth embodiment. However, as shown in FIG. 22A, in the printer 300 of the seventh embodiment, the arrangement regions 222*a* of the two inkjet heads 222 are arranged to partially overlap each other in the conveyance direction. For this reason, as shown in FIG. 22B, the dot formation range K1 where dots are formed by the left inkjet head 222 and the dot formation range K2 where dots are formed by the right inkjet head 222 partially overlap with each other on the sheet S. The control device 250 is configured to record an image in a mutual complementary manner by the two inkjet heads 222 in an overlap region J where the dot formation range K1 and the dot formation range K2 overlap each other. That is, in the overlap region J, a thinned image in which some different portions of the line image of one line-part consisting of the plurality of dots in the conveyance direction are thinned out on the basis of mask data is recorded by each of the two inkjet heads 222. Thereby, in the overlap region J, the thinned images recorded by each of the two inkjet heads 222 are superimposed to complete the line image. In this way, in the overlap region J, the image is recorded by the two inkjet heads 222, so that it is possible to prevent the image quality degradation such as a white stripe extending in the conveyance direction and density unevenness from being generated in the connecting region of the images of the two inkjet heads 222 due to the mounting errors of the inkjet heads 22. In the meantime, in FIGS. 22B and 22C, for convenience sake, the discharged dots D formed by the left inkjet head 222 are shown with the black circles and the discharged dots D formed by the right inkjet head 222 are shown with the white circles.

In the above configuration, when recording the specific image LI over the overlap region J, a step may be generated in the specific image LI due to a difference of ink discharge characteristics, deviation of mounting positions and the like between the two inkjet heads 222. Therefore, the control device 250 performs the image data correction processing of correcting the image data IM, as countermeasures against the step in the specific image LI. In the meantime, in the fifth embodiment, the step in the image that is to be generated in the overlap region F of the dot formation ranges of the two consecutive recording operations is problematic, and in the seventh embodiment, the step in the image that is to be generated in the overlap region J of the two inkjet heads is problematic. That is, the steps in the image to be targeted are different. However, the countermeasures against the steps are basically the same.

In the seventh embodiment, the control device 250 sets, as a correction portion PM, both end portions in the conveyance direction of an image region which is to be recorded in the overlap region J, of the specific image LI, as shown in FIG. 22C. A length of the correction portion PM in the right and left direction is the same as a length of the overlap region J in the right and left direction.

In the seventh embodiment, when forming the discharged dots D by the left inkjet head 222 and when forming the discharged dots D by the right inkjet head 222, a magnitude of an area of the correction portion PM remains unchanged but a shape thereof is slightly changed. That is, in the left inkjet head 222, the length of the correction portion PM in the conveyance direction increases rightward. In the right inkjet head 222, the length of the correction portion PM in the conveyance direction increases leftward.

In addition, a correction portion QM is set in an image region $I_{O1}$ to be recorded in a non-overlap region except the overlap region J of the dot formation range K1 of the specific image LI and an image region $I_{O2}$ to be recorded in a non-overlap region except the overlap region J of the dot formation range K2, too. Specifically, both end portions in the conveyance direction of a boundary region $B_{O1}$, which is adjacent to the overlap region J, in the image region $I_{O1}$ are set as the correction portion QM. Both end portions in the conveyance direction of a boundary region Boa, which is adjacent to the overlap region J, in the image region $I_{O2}$ are set as the correction portion QM. An area of the correction portion QM is smaller than the area of the correction portion PM.

The control device 250 performs correction of reducing the discharge amounts set for the dot elements E, which correspond to the discharged dots D placed at the correction portion PM and the correction portion QM, of the image data IM.

When an image is recorded on the sheet S in accordance with the image data IM corrected as described above, even though a step is generated in the specific image LI, it is possible to reduce the size of the discharged dots D to be formed at the corner portion of the step. That is, it is possible to chamfer the corner portion of the step generated in the specific image LI. As a result, it is possible to record an image where a step in the specific image LI is inconspicuous.

Eighth Embodiment

An eighth embodiment is described. A printer of the eighth embodiment is a serial type printer 1, like the first embodiment. However, the discharge amount of the ink that can be discharged from the nozzle 10 within one discharge period includes "super-outsize droplet", in addition to the five types of "outsize droplet", "large droplet", "medium droplet", "small droplet" and "not-discharge". "Super-outsize droplet" indicates a discharge amount larger than "outsize droplet". The control device 50 can discharge the ink of "super-outsize droplet" from the nozzle 10 by driving the actuator of the inkjet head 12 so that at least one of the number of droplets to be discharged from the nozzle 10 and a droplet amount (volume) per one droplet within one discharge period is greater than "outsize droplet".

In the eighth embodiment, processing content of the image data correction processing that is to be executed by the control device 50 is different from the first embodiment. Specifically, in the first embodiment, for example, when it is assumed that the first boundary region $B_P$ entirely deviates rightward relative to the second boundary region $B_L$, the right end portion of the first boundary region $B_P$ and the left end portion of the second boundary region $B_L$ are respectively set as the correction portion AM, as shown in FIG. 10A. On the other hand, in the eighth embodiment, when it is assumed that the first boundary region $B_P$ entirely deviates rightward relative to the second boundary region $B_L$, the left end portion of the first boundary region $B_P$ and the right end portion of the second boundary region $B_L$ are respectively set as a correction portion HM, as shown in FIG. 23A. Likewise, when it is assumed that the first boundary region $B_P$ entirely deviates leftward relative to the second boundary region $B_L$, the right end portion of the first boundary region $B_P$ and the left end portion of the second boundary region $B_L$ are respectively set as the correction portion HM. When the specific image SI is a ruled line having a width for six dots, a shape of the correction portion HM is set to a rectangular shape in which a length in the scanning direction is a length of one dot-part, and a length in the conveyance direction is a length of three dots, for example, like the correction portion AM.

In the eighth embodiment, the control device 50 performs correction of increasing the discharge amounts set for the dot elements E, which correspond to the discharged dots D placed at the correction portion HM, of the specific image data ESI. Specifically, the discharge amounts set for the dot elements E, which correspond to the discharged dots D placed at the correction portion HM, are changed from "outsize droplet" to "super-outsize droplet".

When an image is recorded on the sheet S in accordance with the image data IM corrected as described above, it is possible to increase the size of the discharged dots D placed at the correction portions HM of the first boundary region $B_P$ and the second boundary region $B_L$. As a result, even when the step is generated in the specific image SI, it is possible to reduce the size of the step in the specific image SI. Thereby, it is possible to record an image where a step in the specific image SI is inconspicuous.

Ninth Embodiment

A ninth embodiment is described. In the ninth embodiment, like the eighth embodiment, as the discharge amount of the ink that can be discharged from the nozzle 10 within one discharge period, "super-outsize droplet" is provided, in addition to the five types of "outsize droplet", "large droplet", "medium droplet", "small droplet" and "not-discharge". A printer of the ninth embodiment is the line type printer 200, like the sixth embodiment. Therefore, as shown in FIG. 23B, the dot formation range K1 where dots are formed by the left inkjet head 222 and the dot formation range K2 where dots are formed by the right inkjet head 222 are adjacent to each other in the right and left direction without overlapping each other. When recording the specific image LI over the boundary between the dot formation range K2 and the dot formation range K2, a step may be generated in the specific image LI.

As countermeasures against the step in the specific image LI, the control device 250 performs the image data correction processing of correcting the image data IM. In the meantime, in the eighth embodiment, the step in the image that is to be generated in the connecting region of the dot formation ranges of the two consecutive recording operations is problematic, and in the ninth embodiment, the step in the image that is to be generated in the connecting region of the dot formation ranges of the two inkjet heads is problematic. That is, the steps in the image to be targeted are different. However, the countermeasures against the steps are basically the same.

Specifically, when it is assumed that the boundary region B1 entirely deviates upstream relative to the boundary region B2 with respect to the conveyance direction, the downstream end portion of the boundary region B1 with respect to the conveyance direction and the upstream end portion of the boundary region B2 with respect to the conveyance direction are respectively set as a correction portion JM, as shown in FIG. 23B. Likewise, when it is assumed that the boundary region B1 entirely deviates downstream relative to the boundary region B2 with respect to the conveyance direction, the upstream end portion of the boundary region B1 with respect to the conveyance direction and the downstream end portion of the boundary region B2 with respect to the conveyance direction are respectively set as the correction portion JM.

In the ninth embodiment, the control device 50 performs correction of increasing the discharge amounts set for the dot elements E, which correspond to the discharged dots D placed at the correction portion JM, of the specific image data ESI. Specifically, the discharge amounts set for the dot elements E, which correspond to the discharged dots D placed at the correction portion JM, are changed from "outsize droplet" to "super-outsize droplet".

When an image is recorded on the sheet S in accordance with the image data IM corrected as described above, it is possible to increase the size of the discharged dots D placed at the correction portions JM of the boundary region B1 and the boundary region B2, as shown in FIG. 23B. As a result, even when the step is generated in the specific image LI, it is possible to reduce the size of the step in the specific image LI. Thereby, it is possible to record an image where a step in the specific image LI is inconspicuous.

Although the preferable embodiments of the present disclosure have been described, the present disclosure is not limited to the embodiments and can be diversely changed within the scope of the claims. In the below, modified embodiments are described.

A modified embodiment of the first embodiment is described with reference to FIG. 24A. In this modified embodiment, like the eighth embodiment, as the discharge amount of the ink that can be discharged from the nozzle 10 within one discharge period, "super-outsize droplet" is provided, in addition to the five types of "outsize droplet", "large droplet", "medium droplet", "small droplet" and "not-discharge". In the image data correction processing, when an end portion, which is located at the same side in the scanning direction as the end portion set as the correction portion AM of the first boundary region $B_P$, of the end portions in the scanning direction of the second boundary region $B_L$ is not set as the correction portion AM, the control device 50 sets the corresponding end portion as a specific end portion XM. Likewise, when an end portion, which is located at the same side in the scanning direction as the end portion set as the correction portion AM of the second boundary region $B_L$, of the end portions in the scanning direction of the first boundary region $B_P$ is not set as the correction portion AM, the control device 50 sets the corresponding end portion as a specific end portion XM. In the example of FIG. 24A, since the right end portion of the first boundary region $B_P$ is set as the correction portion AM and the right end portion of the second boundary region $B_L$ is not set as the correction portion AM, the right end portion of the second boundary region $B_L$ is set as the specific end portion XM. Since the left end portion of the second boundary region $B_L$ is set as the correction portion AM and the left end portion of the first boundary region $B_P$ is not set as the correction portion AM, the left end portion of the first boundary region $B_P$ is set the specific end portion XM.

Then, the control device 50 performs correction of changing the discharge amounts set for the dot elements E, which correspond to the discharged dots D placed at the specific end portion XM, of the specific image data ESI from "outsize droplet" to "super-outsize droplet", too.

When an image is recorded on the sheet S in accordance with the image data IM corrected as described above, it is possible to increase the size of the discharged dots D placed at the specific end portions XM of the first boundary region $B_P$ and the second boundary region $B_L$, as shown in FIG. 24A. As a result, it is possible to record an image where a step in the specific image SI is inconspicuous.

A modified embodiment of the sixth embodiment is described with reference to FIG. 24B. In this modified embodiment, the control device 250 does not set both end portions of the boundary region B1 in the conveyance direction, as the correction portion GM, and sets instead the correction portion GM only for one end portion of the boundary region B1 in the conveyance direction. Likewise, the control device 250 does not set both end portions of the boundary region B2 in the conveyance direction, as the correction portion GM, and sets instead the correction portion GM only for one end portion of the boundary region B2 in the conveyance direction. Specifically, when it is assumed that the boundary region B1 entirely deviates upstream relative to the boundary region B2 with respect to the conveyance direction, the control device 250 set, as the correction portion GM, the upstream end portion of the boundary region B1 with respect to the conveyance direction and the downstream end portion of the boundary region B2 with respect to the conveyance direction, respectively, as shown in FIG. 24B. Likewise, when it is assumed that the boundary region B1 entirely deviates downstream relative to the boundary region B2 with respect to the conveyance direction, the control device 250 set, as the correction portion GM, the downstream end portion of the boundary region B1 with respect to the conveyance direction and the upstream end portion of the boundary region B2 with respect to the conveyance direction, respectively.

Also in this modified embodiment, like the eighth embodiment, as the discharge amount of the ink that can be discharged from the nozzle 10 within one discharge period, "super-outsize droplet" is provided, in addition to the five types of "outsize droplet", "large droplet", "medium droplet", "small droplet" and "not-discharge". When an end portion, which is located at the same side in the conveyance direction as the end portion set as the correction portion GM of the boundary region B1, of the end portions in the conveyance direction of the boundary region B2 is not set as the correction portion GM, the control device 50 sets the corresponding end portion as a specific end portion YM. Likewise, when an end portion, which is located at the same side in the conveyance direction as the end portion set as the correction portion GM of the boundary region B2, of the end portions in the conveyance direction of the boundary region B1 is not set as the correction portion GM, the control device 50 sets the corresponding end portion as a specific end portion YM. In the example of FIG. 24B, since the downstream end portion of the boundary region B2 with respect to the conveyance direction is set as the correction portion GM and the downstream end portion of the boundary region B1 with respect to the conveyance direction is not set as the correction portion GM, the downstream end portion of the boundary region B1 with respect to the conveyance direction is set as the specific end portion YM. Since the upstream end portion of the boundary region B1 with respect to the conveyance direction is set as the correction portion GM and the upstream end portion of the boundary region B2 with respect to the conveyance direction is not set as the correction portion GM, the upstream end portion of the boundary region B2 with respect to the conveyance direction is set as the specific end portion YM.

Then, the control device 50 performs correction of changing the discharge amounts set for the dot elements E, which correspond to the discharged dots D placed at the specific end portions YM of the boundary region B1 and the boundary region B2, of the specific image data ESI from "outsize droplet" to "super-outsize droplet", too.

When an image is recorded on the sheet S in accordance with the image data IM corrected as described above, it is possible to increase the size of the discharged dots D placed at the specific end portions YM of the boundary region B1 and the boundary region B2, as shown in FIG. 24B. As a result, it is possible to record an image where a step in the specific image LI is inconspicuous.

In the below, the other modified embodiments are described.

In the above embodiments, the specific image is a ruled line. However, the present disclosure is not particularly limited thereto, and an image having widths for a plurality of dots in the conveyance direction and in the right and left direction may be used. For example, the specific image may be an image in which one end portion of the image in the right and left direction is located at one end portion of the sheet S in the right and left direction and only the other end portion of the image in the right and left direction is adjacent to the not-discharged dots in the right and left direction.

The method of setting the correction portion is not limited to the embodiments. For example, in the first to fourth embodiments, the correction portion AM is set in the first boundary region $B_P$ and the second boundary region $B_L$ of the specific image SI, respectively. However, the correction portion AM may be set in any one boundary region. Likewise, in the sixth embodiment, the correction portion GM is set in the boundary region B1 and the boundary region B2 of the specific image LI, respectively. However, the correction portion GM may be set in only one boundary region.

As described above, the first boundary region $B_P$ of the specific image SI deviates relative to the second boundary region $B_L$ due to the diverse factors. At this time, the deviation direction is different depending on the factors. In addition to this, the deviation amount by which the first boundary region $B_P$ deviates relative to the second boundary region $B_L$ due to each factor may be different depending on the printers. For this reason, the deviation direction in which the first boundary region $B_P$ deviates relative to the second boundary region $B_L$ may be different depending on the printers. Therefore, deviation information about the deviation direction is stored in a memory of the control device 50 such as the RAM 53, the flash memory and the like (not shown). The deviation information may be acquired by recording a test pattern or the like on the sheet S and reading out the recording result with the readout unit 5. When the deviation direction does not change over time, the deviation information may be acquired upon shipment at a factory and may be stored in advance in the memory of the control device 50. When recording the specific image LI over the boundary between the first dot formation range $K_P$ and the second dot formation range $K_L$, the control device 50 determines which end portion of both end portions of the first boundary region $B_P$ in the scanning direction is to be set as the correction portion AM and which end portion of both end portions of the second boundary region $B_L$ in the scanning direction is to be set as the correction portion AM, based on the deviation information. According to this configuration, it is possible to record an image where a step in the specific image LI is inconspicuous more securely.

The deviation direction in which the first boundary region $B_P$ deviates relative to the second boundary region $B_L$ may change depending on conveyance states of the sheet S. For example, the deviation direction may change between a conveyance state where the sheet S is nipped between both the conveyance roller pair 13 and the discharge roller pairs 16 and a conveyance state where the sheet S is nipped between any one pair of the conveyance roller pair 13 and the discharge roller pairs 16. Therefore, the deviation information of each conveyance state of the sheet S may be stored in the memory of the control device 50, and the correction portion may be changed in correspondence to the conveyance state of the sheet S, based on the deviation information.

In the fifth embodiment, both end portions in the scanning direction of the image region IF to be recorded in the overlap region F are set as the correction portion FM. However, only one end portion of the image region IF in the scanning direction may be set as the correction portion FM. In the fifth embodiment, the correction portion OM may not be set in the boundary region $B_{OP}$ and the boundary region $B_{OL}$.

Likewise, in the seventh embodiment, both end portions in the conveyance direction of the image region $I_J$ to be recorded in the overlap region J are set as the correction portion PM. However, only one end portion of the image region $I_J$ in the conveyance direction may be set as the correction portion PM. In the seventh embodiment, the correction portion QM may not be set in the boundary region $B_{O1}$ and the boundary region $B_{O2}$.

In the sixth, seventh and ninth embodiments, the number of the inkjet heads 222 of the recording head unit 220 is two. However, the present disclosure is not particularly limited thereto, and the number of the inkjet heads may be three or more. Also in this case, since the step in the image may be generated in the connecting region of the images of the two inkjet heads 222 adjacent to each other in the right and left direction, it is necessary to correct the image data, as described above.

In the image data correction processing, the discharge amounts set for the dot elements E corresponding to the dots placed at the correction portion are reduced from "outsize droplet" to "large droplet". However, the present disclosure is not particularly limited thereto. For example, any correction of reducing the discharge amount may be performed. That is, a correction of changing the discharge amount from "outsize droplet" to "not-discharge" may also be performed. The discharge amounts set for the dot elements corresponding to the dots placed at the correction portion are uniformly reduced by the same amount. However, the present disclosure is not particularly limited thereto. For example, the amount to be reduced may be changed depending on the position of the corresponding dot. That is, the discharge amounts of the inks to be discharged from the nozzles 10 when forming the respective dots placed at the correction portion may be different. For example, in the first to fifth embodiments, regarding the dots placed at the correction portions AM of the first boundary region $B_P$ and the second boundary region $B_L$, the dots closer to the boundary between the first dot formation range $K_P$ and the second dot formation range $K_L$ may be formed with the discharge amounts being reduced. In the sixth embodiment, regarding the dots placed at the correction portions GM of the boundary region B1 and the boundary region B2, the dots closer to the boundary between the dot formation range K1 and the dot formation range K2 may be formed with the discharge amounts being reduced. In the eighth embodiment, regarding the dots placed at the correction portions HM of the first boundary region $B_P$ and the second boundary region $B_L$, the dots closer to the boundary between the first dot formation range $K_P$ and the second dot formation range $K_L$ may be formed with the discharge amounts being increased. In the ninth embodiment, regarding the dots placed at the correction portions JM of the boundary region B1 and the boundary region B2, the dots closer to the boundary between the dot formation range K1 and the dot formation range K2 may be formed with the discharge amounts being increased.

In the first embodiment, the nozzle 10 located most upstream of the nozzle row 9 with respect to the conveyance direction is set as the reference nozzle. However, the present disclosure is not particularly limited thereto. For example, the nozzle 10 located most downstream of the nozzle row 9 with respect to the conveyance direction may be set as the reference nozzle, and the discharge timings of the inks may be set so that positions of the dot row, which is to be formed by the inks discharged from the reference nozzles in each of the recording operations, are the same in the scanning direction. At this time, in the case of the bidirectional recording mode, the second boundary region $B_L$ entirely deviates upstream relative to the first boundary region $B_P$ with respect to the moving direction of the carriage 11, in the subsequent recording operation. Therefore, the control device 50 sets, as the correction portion AM, the upstream end portion of the first boundary region $B_P$ with respect to the moving direction of the carriage 11 during the preceding recording operation and the upstream end portion of the second boundary region $B_L$ with respect to the moving direction of the carriage 11 during the subsequent recording operation, respectively.

Likewise, in the second embodiment, the nozzle 10 located most downstream of the nozzle row 9 with respect to the conveyance direction is set as the reference nozzle. However, the present disclosure is not particularly limited thereto. For example, the nozzle 10 located most upstream of the nozzle row 9 with respect to the conveyance direction may be set as the reference nozzle. At this time, the control device 50 sets, as the correction portion AM, the upstream end portion of the first boundary region $B_P$ with respect to the moving direction of the carriage 11 during the preceding recording operation and the upstream end portion of the second boundary region $B_L$ with respect to the moving direction of the carriage 11 during the subsequent recording operation, respectively.

In the first to fifth embodiments, the gap between the sheet S and the discharge surface 12*a*1 is different at the upstream and downstream sides with respect to the conveyance direction. However, the present disclosure is not particularly limited thereto. For example, the gap may be uniform without the difference at the upstream and downstream sides with respect to the conveyance direction. In this case, it is not necessary to take countermeasures against the step in the image, which is caused due to the gap difference at the upstream and downstream sides with respect to the conveyance direction. The waveform generation mechanism may not be provided, and the gap between the sheet S and the discharge surface 12*a*1 may be uniform without changing in the scanning direction. In this case, it is not necessary to take countermeasures against the step in the image, which is caused due to the variation in gap at the convex part of the sheet S. The carriage 11 may be configured so that the posture thereof is not to change. In this case, it is not necessary to take countermeasures against the step in the image, which is caused due to the posture change of the carriage 11.

In the first to fifth embodiments, the waveform generation mechanism configured to generate the waveform for the sheet S is a mechanism having the ribs 20, the lower rollers 16*b*, the plates 14 and the spurs 17. However, the present disclosure is not particularly limited thereto. For example, the waveform generation mechanism may be configured to press the sheet S from above only by the plates 14, without the spurs 17. Like this, even when the sheet S is pressed from above only by the plates 14, it is possible to generate the waveform for the sheet S.

The pressing member configured to press the sheet S from above is not limited to the plate 14 and the spur 17. For example, the pressing member may be a member configured to press the sheet S from above at an upstream side than the inkjet head 12 with respect to the conveyance direction so as to prevent the sheet S from floating to contact the discharge surface 12*a*1.

In the second embodiment, the holder 119 to which the ink cartridge 26 is detachably mounted and the contact member 129 configured to be in contact with the curved part 127*a* of the supply tube 127 are arranged at the rear of the carriage 11. However, like the first embodiment, they may be arranged in front of the carriage 11. Also in this case, when the tube joint 128 to which the supply tube 127 is connected is provided at an upstream position than the intermediate position of the inkjet head 12 in the conveyance direction, with respect to the conveyance direction, in the state where the carriage 11 is located within the left end portion range, the carriage 11 is slightly rotated so that the upstream nozzle 10 of the nozzle row 9 with respect to the conveyance direction is to move rightward and the downstream nozzle 10 is to move leftward.

In the embodiments, the supply tube 27; 127 is directly connected to the ink cartridge 26 mounted to the holder 19; 119. However, the present disclosure is not particularly limited thereto. For example, when a flow path configured to communicate with the ink cartridge 26 is provided in the holder 19; 119 or at a side thereof, the supply tube 27; 127 may be connected to the ink cartridge 26 via the flow path.

In the above, the example where the present disclosure is applied to the printer configured to record the image on the sheet S by discharging the inks from the nozzles has been described. However, the present disclosure is not limited thereto. For example, the present disclosure can be applied to an image recording apparatus configured to record an image by discharging inks from nozzles to a medium other than the sheet S, for example, a case of a portable terminal such as a smart phone, a corrugated board and the like, too. The present disclosure can be applied to an image recording apparatus configured to record an image by performing a printing, as a background, white ink on a medium made of a transparent resin such as a transparent film and then discharging inks of black, yellow, cyan and magenta from a head, too. In the embodiments, the image recording apparatus is configured to record an image by discharging the inks of four colors of black, yellow, cyan and magenta from the head. However, the present disclosure is not limited thereto. For example, the present disclosure can be applied to an image recording apparatus configured to record an image by discharging inks of six colors of black, yellow, cyan, magenta, light cyan and light magenta from the head, too. The present disclosure can be applied to an image recording apparatus configured to record an image on a medium by a liquid other than the ink.

In the above, the conveyance mechanism configured to convey the medium is a roller conveyance mechanism using the conveyance rollers. However, the present disclosure is not limited thereto. For example, a conveyance mechanism configured to place the medium on a belt, to cause the belt to travel, and to thereby convey the medium is also possible. A conveyance mechanism configured to place the medium on a table, to move the table by a moving means such as a ball screw and the like, and to thereby convey the medium is also possible.

What is claimed is:

1. An image recording apparatus comprising:

a conveyer configured to convey a medium in a conveyance direction;

a carriage configured to reciprocally move in a scanning direction intersecting with the conveyance direction;

a recording head mounted to the carriage and including a discharge surface in which a plurality of nozzles are aligned in the conveyance direction;

a memory configured to store image data including a plurality of dot elements corresponding to a plurality of dots to be formed on a medium, a discharge amount of liquid discharged for forming a corresponding dot is set for each of the plurality of dot elements in the image data; and a controller configured to alternately execute a recording operation in which while moving the carriage in the scanning direction, the recording head discharges liquid of the discharge amount set for the dot elements of the image data from the plurality of nozzles to form dots on the medium, and a conveyance operation in which the conveyer conveys the medium in the conveyance direction, to record an image on the medium, wherein in a case of recording the image, the controller:

causes the conveyer, in the conveyance operation, to convey a medium in the conveyance direction such that dot formation ranges where dots are to be formed in two consecutive recording operations partially overlap each other; and forms a dot row for one line in the scanning direction in a mutual complementary manner by the two consecutive recording operations, in an overlap region where the dot formation ranges of the two consecutive recording operations overlap each other, and wherein in a case of recording a specific image over the overlap region, the specific image consisting of a plurality of discharged dots corresponding to dot elements having the set discharge amounts greater than zero among the plurality of dot elements of the image data, and the specific image having widths for a plurality of dots in the conveyance direction and in the scanning direction, the controller:

sets, as a correction portion, an end portion in the scanning direction of an image region in the specific image, the image region being formed in the overlap region; and forms the dot placed at the correction portion by discharging liquid of a discharge amount smaller than the discharge amount set for the dot element corresponding to the dot from at least one of the plurality of nozzles.

2. The image recording apparatus according to claim 1, wherein the correction portion has the same length with the overlap range in the conveyance direction.

3. The image recording apparatus according to claim 1, wherein the controller sets, as the correction portion, an end in the scanning direction of a boundary region adjacent to the overlap region in an image region of the specific image, the image region being formed in a non-overlap range except the overlap range of the dot formation ranges where dot are formed in the two consecutive recording operations, and the controller sets an area of the correction portion in the non-overlap range to be smaller than an area of the correction portion in the overlap range.

4. An image recording apparatus comprising:

a conveyer configured to convey a medium in a conveyance direction;

a recording head unit including a plurality of recording heads each of which includes a nozzle row having a plurality of nozzles aligned in an intersection direction intersecting with the conveyance direction, the plurality of recording heads being aligned in the intersection direction such that arrangement regions having the nozzles arranged in two recording heads being adjacent to each other in the intersection direction among the plurality of recording heads, do not overlap each other in the conveyance direction;

a memory configured to store image data including a plurality of dot elements corresponding to a plurality of dots to be formed on a medium, a discharge amount of liquid discharged for forming a corresponding dot is set for each of the plurality of dot elements in the image data; and a controller configured to cause the conveyer to convey a medium in the conveyance direction and cause the recording head unit to discharge liquid of the discharge amount set for the dot elements of the image data from the plurality of nozzles to form dots on the medium, to record an image on the medium, and wherein in a case of recording a specific image over a boundary between a first dot formation range where dots are to be formed by one of the two adjacent recording heads and a second dot formation range where dots are to be formed by the other of the two adjacent recording heads, the specific image consisting of a plurality of discharged dots corresponding to dot elements having the set discharge amounts greater than zero among the plurality of dot elements of the image data, and the specific image having widths for a plurality of dots in the conveyance direction and in the scanning direction, the controller:

sets, as a correction portion, an end portion in the conveyance direction of a specific region including at least one of a first boundary region and a second boundary region in the specific image, the first boundary region being located in a first image region recorded within the first dot formation range, the first boundary region being adjacent to the second dot formation range and having a length shorter than a length of the first dot formation range in the intersection direction, and the second boundary region being located in a second image region recorded within the second dot formation range, the second boundary region being adjacent to the first dot formation range and having a length shorter than a length of the second dot formation range in the intersection direction; and forms the dot placed at the correction portion by discharging liquid of a discharge amount different from the discharge amount set for the dot element corresponding to the dot from at least one of the plurality of nozzles.

5. The image recording apparatus according to claim 4, wherein in a case where the controller sets, as the correction portion, a first end portion in the conveyance direction of one of the first boundary region and the second boundary region, and the controller does not set, as the correction portion, a second end portion the other of the first boundary region and the second boundary region, the second end portion being located at the same side in the conveyance direction as the first end portion, the controller forms the dot placed at the second end portion by discharging liquid of a discharge amount greater than the discharge amount set for the dot element corresponding to the dot from at least one of the plurality of nozzles.

6. An image recording apparatus comprising:

a conveyer configured to convey a medium in a conveyance direction;

a recording head unit including a plurality of recording heads each of which includes a nozzle row having a plurality of nozzles aligned in an intersection direction intersecting with the conveyance direction, the plurality of recording heads being aligned in the intersection direction such that arrangement regions having the nozzles arranged in two recording heads being adjacent to each other in the intersection direction among the plurality of recording heads, overlap each other in the conveyance direction;

a memory configured to store image data including a plurality of dot elements corresponding to a plurality of dots to be formed on a medium, a discharge amount of liquid discharged for forming a corresponding dot is set for each of the plurality of dot elements in the image data; and a controller configured to cause the conveyer to convey a medium in the conveyance direction and cause the recording head unit to discharge liquid of the discharge amount set for the dot elements of the image data from the plurality of nozzles to form dots on the medium, to record an image on the medium, wherein in a case of recording the image, the controller forms a dot row for one line in the conveyance direction in a mutual complementary manner by the two adjacent recording heads, in an overlap region where dot formation ranges where dots are to be formed by the two adjacent recording heads overlap each other, and wherein in a case of recording a specific image over the overlap region, the specific image consisting of a plurality of discharged dots corresponding to dot elements having the set discharge amounts greater than zero among the plurality of dot elements of the image data, and the specific image having widths for a plurality of dots in the conveyance direction and in the intersection direction, the controller:

sets, as a correction portion, an end portion in the conveyance direction of an image region in the specific image, the image region being formed in the overlap region; and forms the dot placed at the correction portion by discharging liquid of a discharge amount smaller than the discharge amount set for the dot element corresponding to the dot from at least one of the plurality of nozzles.

7. An image recording apparatus comprising:

a conveyer configured to convey a medium in a conveyance direction;

a carriage configured to reciprocally move in a scanning direction intersecting with the conveyance direction;

a recording head mounted to the carriage and including a discharge surface in which a plurality of nozzles are aligned in the conveyance direction;

a memory configured to store image data including a plurality of dot elements corresponding to a plurality of dots to be formed on a medium, a discharge amount of liquid discharged for forming a corresponding dot is set for each of the plurality of dot elements in the image data; and a controller configured to alternately execute a recording operation in which while moving the carriage in the scanning direction, the recording head discharges liquid of the discharge amount set for the dot elements of the image data from the plurality of nozzles to form dots on the medium, and a conveyance operation in which the conveyer conveys the medium in the conveyance direction, to record an image on the medium, wherein in a case of recording the image, the controller causes the conveyer, in the conveyance operation, to convey a medium in the conveyance direction such that a first dot formation range where dots are to be formed in a preceding recording operation of two consecutive recording operations and a second dot formation range where dots are to be formed in a subsequent recording operation of the two consecutive recording operations do not overlap each other, and wherein in a case of recording a specific image over a boundary between the first dot formation range and the second dot formation range, the specific image consisting of a plurality of discharged dots corresponding to dot elements having the set discharge amounts greater than zero among the plurality of dot elements of the image data, and the specific image having widths for a plurality of dots in the conveyance direction and in the scanning direction, the controller:

sets, as a correction portion, an end portion in the scanning direction of a specific region including at least one of a first boundary region and a second boundary region in the specific image, the first boundary region being located in a first image region recorded within the first dot formation range, the first boundary region being adjacent to the second dot formation range and having a length shorter than a length of the first dot formation range in the conveyance direction, and the second boundary region being located in a second image region recorded within the second dot formation range, the second boundary region being adjacent to the first dot formation range and having a length shorter than a length of the second dot formation range in the conveyance direction; and forms the dot placed at the correction portion by discharging liquid of a discharge amount larger than the discharge amount set for the dot element corresponding to the dot from at least one of the plurality of nozzles.

* * * * *